US005774771A

United States Patent [19]

Kukimoto et al.

[11] Patent Number: 5,774,771

[45] Date of Patent: Jun. 30, 1998

[54] IMAGE FORMING METHOD AND APPARATUS USING A PARTICULAR TONER

[75] Inventors: Tsutomu Kukimoto, Yokohama; Motoo Urawa, Funabashi; Kenji Okado, Yokohama; Toshiyuki Ugai, Kawasaki; Keita Nozawa, Yokohama; Satoshi Yoshida, Tokyo; Yuki Karaki, Kawasaki, all of Japan

[73] Assignee: Canon Kabushiki Kaisha, Tokyo, Japan

[21] Appl. No.: 599,375

[22] Filed: Feb. 9, 1996

[30] Foreign Application Priority Data

| | | | |
|---|---|---|---|
| Feb. 10, 1995 | [JP] | Japan | 7-045059 |
| Feb. 10, 1995 | [JP] | Japan | 7-045120 |
| Mar. 28, 1995 | [JP] | Japan | 7-093164 |
| Mar. 29, 1995 | [JP] | Japan | 7-094160 |

[51] Int. Cl.[6] ..... G03G 15/08; G03G 15/14

[52] U.S. Cl. ..... 399/223; 399/231; 399/302; 430/109

[58] Field of Search ..... 399/222, 223, 399/231, 302; 430/105, 106, 109, 111

[56] References Cited

U.S. PATENT DOCUMENTS

| | | | |
|---|---|---|---|
| 4,851,960 | 7/1989 | Nakamura et al. | 361/225 |
| 4,904,558 | 2/1990 | Nagatsuka et al. | 430/122 |
| 5,024,915 | 6/1991 | Sato et al. | 430/110 |
| 5,116,711 | 5/1992 | Kobayashi et al. | 430/106 |
| 5,137,796 | 8/1992 | Takiguchi et al. | 430/106.6 |
| 5,139,914 | 8/1992 | Tomiyama et al. | 430/106.6 |
| 5,187,526 | 2/1993 | Zaretsky | 355/273 |
| 5,202,213 | 4/1993 | Nakahara et al. | 430/110 |
| 5,256,512 | 10/1993 | Kobayashi et al. | 430/106 |
| 5,270,143 | 12/1993 | Tomiyama et al. | 430/109 |
| 5,270,770 | 12/1993 | Kukimoto et al. | 355/274 |
| 5,450,180 | 9/1995 | Ohzeki et al. | 355/274 |
| 5,635,325 | 6/1997 | Inaba et al. | 430/106 |

FOREIGN PATENT DOCUMENTS

| | | |
|---|---|---|
| 0658816 | 6/1995 | European Pat. Off. . |
| 36-10231 | 7/1961 | Japan . |
| 56-13945 | 4/1981 | Japan . |
| 59-50473 | 3/1984 | Japan . |
| 59-53856 | 3/1984 | Japan . |
| 59-61842 | 4/1984 | Japan . |
| 59-125739 | 7/1984 | Japan . |
| 61-279864 | 12/1986 | Japan . |
| 63-149669 | 6/1988 | Japan . |
| 63-235953 | 9/1988 | Japan . |
| 2-123385 | 5/1990 | Japan . |
| 2258053 | 1/1993 | United Kingdom . |

OTHER PUBLICATIONS

Patent Abstracts of Japan, vol. 18, No. 211 (P–1726) of JP 6–011898.

"Polymer Handbook", edited by Brandrup et al., 2nd Ed., published by John Wiley & Sons, p. (III–139) –(III–192).

*Primary Examiner*—Nestor R. Ramirez

*Attorney, Agent, or Firm*—Fitzpatrick, Cella, Harper & Scinto

[57] ABSTRACT

An image forming method has a developing step of developing an electrostatic latent image by the use of a developer to form a toner image on an electrostatic latent image bearing member, a primary transfer step of transferring the toner image onto an intermediate transfer member to which a voltage is applied, and a secondary transfer step of transferring onto a transfer medium the toner image held on the intermediate transfer member, while a transfer means to which a voltage is applied is pressed against the transfer medium. The developer has a toner. The toner is a black toner having at least i) black toner particles formed of a binder resin with a colorant dispersed therein and ii) an inorganic fine powder. The black toner has the value of shape factor SF-1 of $110<SF\text{-}1\leqq 180$, the value of shape factor SF-2 of $110<SF\text{-}2\leqq 140$, and the value of ratio B/A of 1.0 or less which is the ratio of a value B obtained by subtracting 100 from the value of SF-2 to a value A obtained by subtracting 100 from the value of SF-1.

66 Claims, 6 Drawing Sheets

IMAGE FORMING METHOD AND APPARATUS USING A PARTICULAR TONER

BACKGROUND OF THE INVENTION

1. Field of the invention

This invention relates to an image forming method employing an intermediate transfer member in electrophotography or electrostatic recording, an image forming apparatus making use of such an image forming method, and a toner kit used in such method and apparatus. More particularly, the present invention relates to an image forming method applied in copying machines, printers, facsimile machines and so forth in which a toner image is formed on an electrostatic latent image bearing member, the toner image is thereafter transferred from the electrostatic latent image bearing member to an intermediate transfer member, and the toner image is further transferred from the intermediate transfer member to a transfer medium, and also relates to an image forming apparatus making use of such an image forming method, and a toner kit used in such method and apparatus.

2. Related Background Art

A number of methods are conventionally known for electrophotography. Copies or prints are commonly obtained by forming an electrostatic latent image on a photosensitive member by utilizing a photoconductivity material and by various means, subsequently developing the electrostatic latent image by the use of a toner to form a toner image, transferring the toner image to a transfer medium such as paper if necessary, and thereafter fixing the toner image to the transfer medium by heat, pressure or heat-and-pressure.

In full-color copying machines, it has been common to use a method in which, using four photosensitive members, electrostatic latent images respectively formed on the photosensitive members are developed by the use of a cyan toner, a magenta toner, a cyan toner or a black toner, and, while transporting a transfer medium by means of a belt-like transfer member, the toner images of the respective colors are transferred to the transfer medium, followed by fixing to form a full-color image, or a method in which a transfer medium is wound on the surface of a transfer member holding member set opposingly to one photosensitive member, the transfer medium being wound by an electrostatic force or a mechanical action of a gripper or the like, and the process of from development to transfer is carried out four times to obtain a full-color image.

In recent years, as transfer mediums for full-color copying, it has become increasingly necessary to deal with not only sheets of paper conventionally used and films for overhead projectors (OHP) but also sheets of cardboard or small-sized sheets of paper such as cards and postcards. In the above method making use of four photosensitive members, the transfer medium is transported as a flat sheet, and hence the method can be widely applied to various types of transfer mediums. Since, however, a plurality of toner images must be exactly superimposed on the transfer medium at its preset position, even a little difference in registration causes a lowering of image quality. In order to enhance the accuracy of registration, the mechanism for transporting transfer mediums must be complicated, thus requiring that the number of parts be increased. As for the method in which the transfer medium is attracted and wound on the surface of a transfer medium holding member, the transfer medium may cause a faulty close contact at its rear end because of a high stiffness of the transfer medium, consequently tending to cause faulty images due to faulty transfer. Similar faulty images tend to occur also in small-sized sheets of paper.

Meanwhile, image forming methods employing an intermediate transfer member have been proposed.

For example, a full-color image forming apparatus making use of a drum type intermediate transfer member is proposed in U.S. Pat. No. 5,187,526. However, U.S. Pat. No. 5,187,526 has no specific disclosure as to the shape and constitution of toner particles.

Japanese Patent Application Laid-open No. 59-125739 discloses a recording method in which a toner image formed of a toner having an average particle diameter of 10 $\mu$m or smaller is transferred to an intermediate transfer member, and the toner image on the intermediate transfer member is further transferred to a transfer medium. To produce the toner, it further discloses a method in which toner particles are directly produced by suspension polymerization.

However, in the transfer step disclosed in Japanese Patent Application Laid-open No. 59-125739, the transfer is carried out by pressure transfer or adhesion transfer, where the surface of the intermediate transfer member tends to be contaminated during running on a large number of sheets, and the transfer step is quite different from the step of transferring the toner image by chiefly utilizing an electrical attraction force in an electric field.

Japanese Patent Application Laid-open No. 59-50473 also discloses an electrostatic recording process or electrophotographic copying process in which a toner image on an image bearing member is transferred to an intermediate transfer member comprising a support, which is heated to a given temperature, and provided thereon a heat-resistant elastic layer and a surface layer formed of an addition polymerization type silicone rubber, and the toner image on the intermediate transfer member is further transferred to a transfer medium.

However, the image forming method disclosed in Japanese Patent Application Laid-open No. 59-50473 tends to cause a deterioration of the image bearing member coming into contact with the heated intermediate transfer member. Also, it has no disclosure relating to the step of transfer by using an intermediate transfer member to which a voltage is applied. In the system making use of an intermediate transfer member, it is necessary to just first transfer the toner image from the electrostatic latent image bearing member such as a photosensitive member to the intermediate transfer member and further again transfer the toner image from the intermediate transfer member to a transfer medium, and hence the transfer efficiency of toner must be further improved.

Because account of a poor transfer efficiency of the toner image transferred from the intermediate transfer member to the transfer medium, it has been essential for the intermediate transfer member to have a cleaning member, which, however, is not preferable in view of the lifetime of the intermediate transfer member. Thus, it has been sought to improve the transfer efficiency.

Japanese Patent Application Laid-open No. 61-279864 discloses a toner whose shape factors SF-1 and SF-2 are defined. However, as a result of experiments to follow up the toner of Examples in this publication, such toner has been found to have a poor transfer efficiency and an insufficient transfer efficiency especially when used in an image forming apparatus employing an intermediate transfer member, and has been sought to be further improved.

Japanese Patent Application Laid-open No. 63-235953 discloses a magnetic toner whose particles have been made more spherical by a mechanical impact force. However, its transfer efficiency is still insufficient when used in the image forming apparatus employing an intermediate transfer member, and the toner must be further improved.

Recently, from the viewpoint of environmental protection, there is a tendency that, in place of the primary charging and transfer process utilizing corona discharge as conventionally used, a primary charging and transfer process employing a charging member contracting the photosensitive member is prevalent as being almost free from generation of ozone.

Stated specifically, it is a process in which a voltage is applied to a medium-resistance roller or medium-resistance brush serving as a charging member, and the roller or brush is brought into contact with a photosensitive member, to be charged, to electrostatically charge the surface of the photosensitive member to a given potential. For example, as disclosed in Japanese Patent Publication No. 50-13661, a roller comprising a mandrel covered with a dielectric material made of nylon or polyurethane rubber is used. This makes it possible to apply a low voltage when the photosensitive member is charged. In Japanese Patent Application Laid-open No. 63-149669 and No. 2-123385, a contact charging method and a contact transfer method are proposed. A conductive elastic roller is brought into contact with an electrostatic latent image bearing member, and the electrostatic latent image bearing member is uniformly electrostatically charged while applying a voltage to the conductive roller, followed by exposure to form an electrostatic latent image, and then development to obtain a toner image. Thereafter, while another conductive roller (a transfer member) to which a voltage is applied is pressed against the electrostatic latent image bearing member, a transfer medium is passed between them to transfer to the transfer medium the toner image held on the electrostatic latent image bearing member, followed by the step of fixing to obtain a copied image.

However, in such a contact transfer system utilizing no corona discharge, the transfer member is brought into contact with the photosensitive member via the transfer medium at the time of transfer, and hence the toner image is pressed when it is transferred to the transfer medium, so that a problem of partial faulty transfer tends to occur, which is called "blank areas caused by poor transfer" as shown in FIG. 5B.

In the case when a full-color copying machine or full-color printer in which a plurality of toner images are transferred after development, the quantity of toners on the intermediate transfer member is larger than the case of black and white copying machines making use of monochromatic black toners, and it is difficult to improve transfer efficiency when using conventional amorphous toners having large SF-1 and SF-2 values. Also when conventional amorphous toners are used, the melt-adhesion of toner or filming tends to occur on the surface of the photosensitive member or the surface of the intermediate transfer member because of a shear force or frictional force acting between the photosensitive member and the cleaning member, between the intermediate transfer member and the cleaning member and/or between the photosensitive member and the intermediate transfer member. Moreover, the transfer efficiency tends to become poor, so that in the formation of a full-color image the toner images corresponding to the four colors can be uniformly transferred with difficulty. Thus, when the intermediate transfer member is used, problems tend to occur in respect of uneven colors and color balance, and it is not easy to stably output full-color images of a high-quality.

SUMMARY OF THE INVENTION

An object of the present invention is to provide an image forming method employing an intermediate transfer member, having solved the problems involved in the prior art.

Another object of the present invention is to provide an image forming method that can achieve a superior transfer efficiency of toner images, and an image forming apparatus making use of such a method.

Still another object of the present invention is to provide an image forming apparatus that can also transfer toner images to sheets of cardboard or small-sized sheets of paper such as cards and post-cards, and an image forming apparatus making use of such a method.

A further object of the present invention is to provide an image forming apparatus that can prevent toner melt-adhesion and filming from occurring on the surface of the electrostatic latent image bearing member and the surface of the intermediate transfer member, and an image forming apparatus making use of such a method.

A still further object of the present invention is to provide an image forming apparatus that can achieve superior formation of multi-color images or full-color images , and an image forming apparatus making use of such a method.

A still further object of the present invention is to provide a toner kit preferably applicable to the above full-color image forming apparatus.

A still further object of the present invention is to provide a toner kit that can achieve a high image density and superior fine-line reproduction and highlight gradation.

A still further object of the present invention is to provide a toner kit that may cause no toner scatter and can promise a superior transfer performance.

A still further object of the present invention is to provide a toner kit that may cause no changes in performance when used for a long time.

The present invention provides an image forming method comprising;

a developing step of developing an electrostatic latent image by the use of a developer to form a toner image on an electrostatic latent image bearing member;

a primary transfer step of transferring the toner image onto an intermediate transfer member to which a voltage is applied; and a secondary transfer step of transferring onto a transfer medium the toner image held on the intermediate transfer member, while a transfer means to which a voltage is applied is pressed against the transfer medium;

wherein the developer has a toner, and the toner is a black toner having at least i) black toner particles formed of a binder resin with a colorant dispersed therein and ii) an inorganic fine powder; the black toner having the value of shape factor SF-1 of $110<SF\text{-}1\leqq 180$, the value of shape factor SF-2 of $110<SF\text{-}2\leqq 140$, and the value of ratio B/A of 1.0 or less which is the ratio of a value B obtained by subtracting 100 from the value of SF-2 to a value A obtained by subtracting 100 from the value of SF-1.

The present invention also provides an image forming apparatus comprising;

an electrostatic latent image bearing member;

a developing means having a developer for forming a toner image on the electrostatic latent image bearing member;

an intermediate transfer member for holding the toner image transferred from the electrostatic latent image bearing member; the intermediate transfer member having a bias applying means; and a transfer means for transferring the toner image held on the intermediate transfer member, onto a transfer medium; the transfer means having a bias applying means and being provided in the manner that it is pressed against the intermediate transfer member;

wherein the developer has a toner, and the toner is a black toner having at least i) black toner particles formed of a binder resin with a colorant dispersed therein and ii) an inorganic fine powder; the black toner having the value of shape factor SF-1 of 110<SF-1≦180, the value of shape factor SF-2 of 110<SF-2≦140, and the value of ratio B/A of 1.0 or less which is the ratio of a value B obtained by subtracting 100 from the value of SF-2 to a value A obtained by subtracting 100 from the value of SF-1.

The present invention also provides a toner kit comprising a yellow toner comprising i) yellow toner particles containing a yellow colorant and a binder resin and ii) an inorganic fine powder, a magenta toner comprising i) magenta toner particles containing a magenta colorant and a binder resin and ii) an inorganic fine powder, a cyan toner comprising i) cyan toner particles containing a cyan colorant and a binder resin and ii) an inorganic fine powder, and a black toner comprising i) black toner particles containing at least one of carbon black and a magnetic material and a binder resin and ii) an inorganic fine powder, wherein;

the black toner has the value of shape factor SF-2of 140 or less, and greater than the values of shape factor SF-2 of said yellow toner, magenta toner and cyan toner.

DESCRIPTION OF THE PREFERRED EMBODIMENTS

Figure 1:
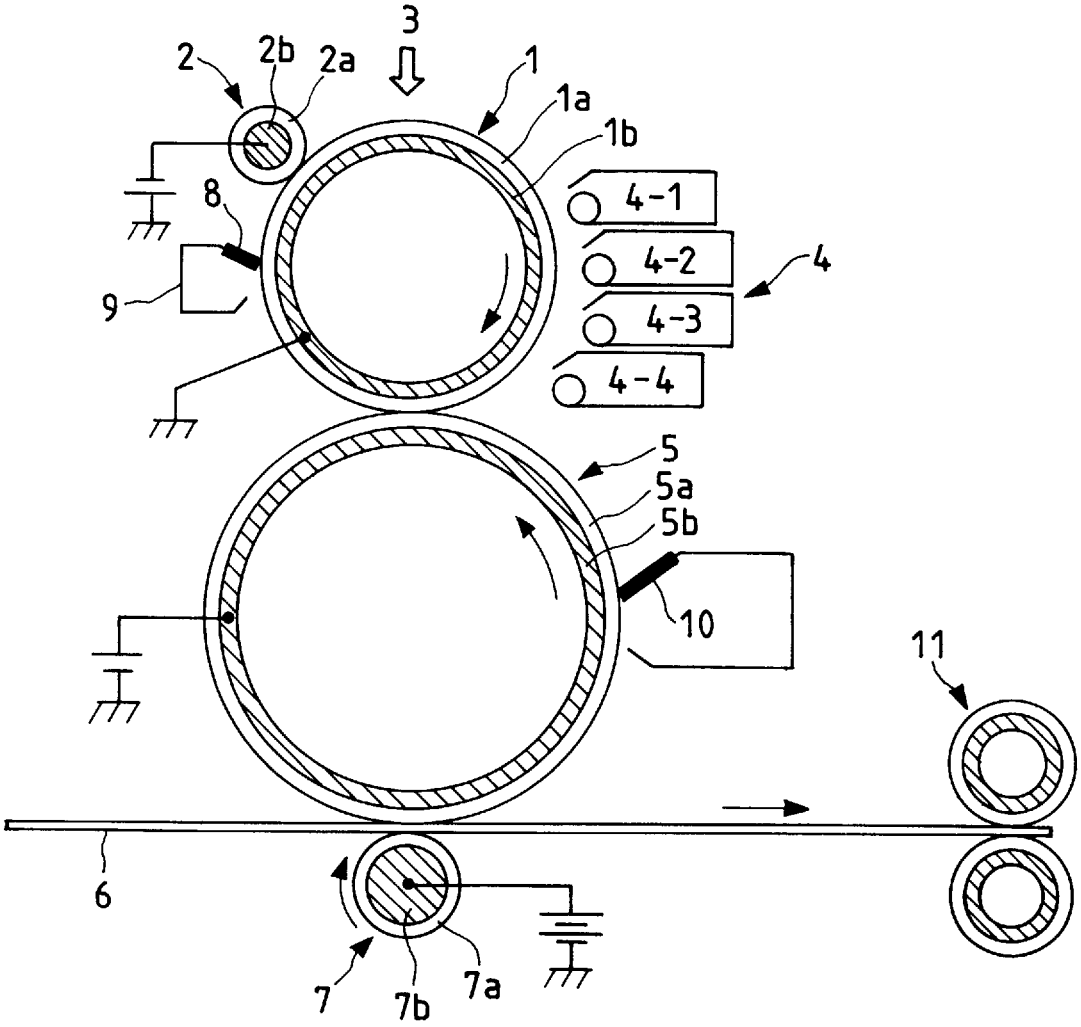
FIG. 1 is a schematic illustration of an example of a full-color image forming electrophotographic apparatus preferably used in the present invention.

In the present invention, a black toner having at least i) black toner particles formed of a binder resin with a colorant dispersed therein and ii) an inorganic fine powder is used. The black toner has the value of shape factor SF-1 of 110<SF-1≦180, the value of shape factor SF-2 of 110<SF-2≦140, and the value of ratio B/A of 1.0 or less which is the ratio of a value B obtained by subtracting 100 from the value of SF-2 to a value A obtained by subtracting 100 from the value of SF-1.

In the present invention, the shape factor SF-1 and shape factor SF-2 are the values obtained by sampling at random 100 particle images of a toner with particle diameters of 2 μm or larger by the use of, e.g., FE-SEM (S-800; a scanning electron microscope manufactured by Hitachi Ltd.), introducing their image information in an image analyzer (LUZEX-III; manufactured by Nikore Co.) through an interface to make analysis, and calculating the data according to the following expression. The values obtained are defined as shape factor SF-1 and shape factor SF-2.

$$SF\text{-}1=(MXLNG)^2/AREA\times\pi/4\times100$$

$$SF\text{-}2=(PERIME)^2/AREA\times\tfrac{1}{4}\pi\times100$$

wherein MXLNG represents an absolute maximum length of a toner particle, PERIME represents a peripheral length of a toner particle, and AREA represents a projected area of a toner particle.

The shape factor SF-1 indicates the degree of sphericity of toner particles. SF-2 indicates the degree of surface irregularity of toner particles.

If the shape factor SF-1 of the black toner is more than 180 or SF-2 is more than 140, toner particles become less spherical and become more closely amorphous (shapeless), and the toner particles tend to be crushed in the developing assembly, so that the particle size distribution may vary or the charge quantity distribution tends to become broad to tend to cause ground fog and reversal fog. The transfer efficiency of toner images may also lower when the toner images are transferred from the electrostatic latent image bearing member to the intermediate transfer member, the transfer efficiency of toner images may also lower when the toner images are transferred from the intermediate transfer member to the transfer member, and the blank areas caused by poor transfer may occur on line images. Thus, such values are not preferable.

If the shape factor SF-1 of the black toner is 110 or less or the shape factor SF-2 is 110 or less, and the value of ratio B/A is more than 1.0, faulty cleaning usually tends to occur.

The present invention has solved these problems by making the shape of black toner particles satisfy the conditions as defined in the present invention.

More preferably, the value of SF-1 may be 120≦SF-1≦160, and the value of SF-2 may be 115≦SF-2≦140. It is preferable to use toner particles produced by pulverization and having been treated to become spherical.

In a full-color toner kit having a cyan toner, a yellow toner, a magenta toner and a black toner, it is preferable to make the SF-2 of the black toner largest.

For the purpose of improving transfer efficiency, it has been attempted to normalize the toner image formed on the electrostatic latent image bearing member, by again charging it or destatisizing it. However, such a measure may causes, e.g., an increase in occurrence of black spots around images on the transfer medium, and can not necessarily be satisfactory. This remarkably tends to occur especially in black toners, and it is necessary to well achieve both the developing performance and the transfer performance.

As a result of studies made on the shape of toner particles, it has been found that the shape of particles of black toner may be made less spherical than that of particles of other color toners to become irregular, whereby the development or transfer electric field effectively acts on convexes of such irregular particle surfaces, and also, because of an appropriate surface resistance of such particles, the electric field uniformly acts on the toner particles to make it possible to achieve a higher image quality.

The convexes appropriately present over the toner particle surfaces effectively function to produce an electrode effect, so that a transfer performance free of black spots around images can be obtained.

The shape factor SF-2 of the black toner may preferably be larger by at least 5 than the shape factor SF-2 of the cyan toner, SF-2 of the yellow toner and SF-2 of the magenta toner. In the cyan toner, the yellow toner and the magenta toner each, the shape factor SF-1 may preferably be from 100 to 170, more preferably from 100 to 160, and still more preferably from 100 to 150, and the SF-2 may preferably be from 100 to 139, more preferably from 100 to 130, and still more preferably from 100 to 125.

Figure 6:
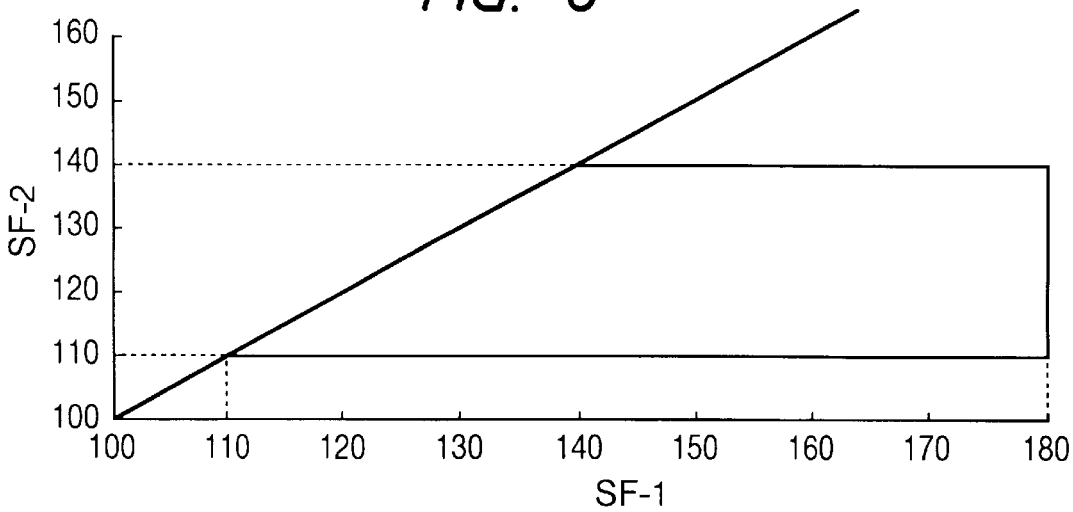
FIG. 6 shows the scope of the present invention in relation to the shape factors SF-1 and SF-2.
Figure 5A:
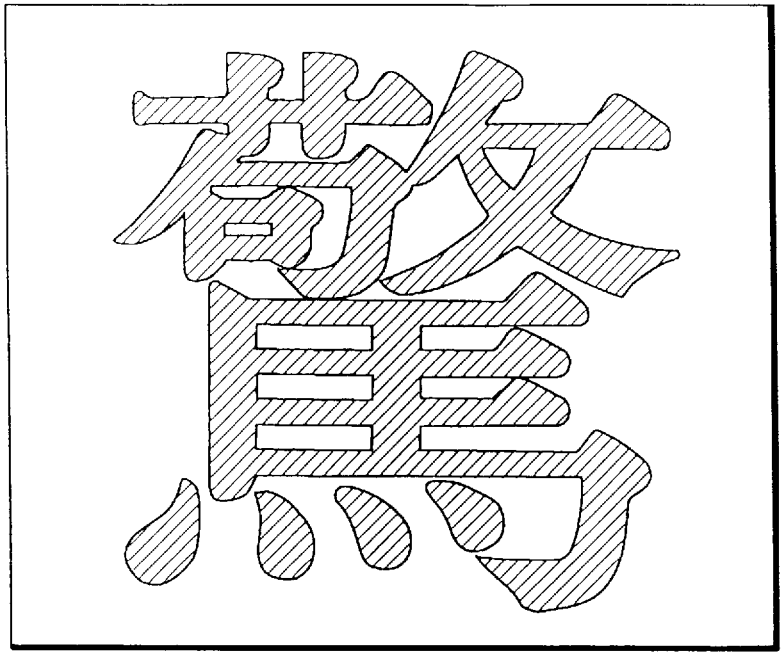
FIG. 5A illustrates a good image free of "blank areas caused by poor transfer", and FIG. 5B a poor image having caused "blank areas caused by poor transfer".
Figure 5B:
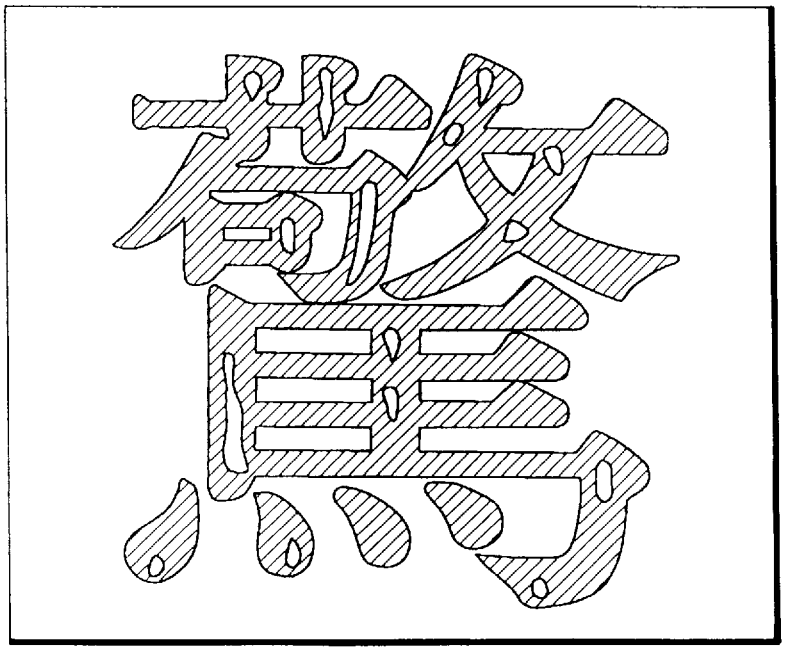

In the black toner, the value of ratio B/A which is the ratio of a value B obtained by subtracting 100 from SF-2 to a value A obtained by subtracting 100 from SF-1 indicates the slope of a straight line that passes an origin in FIG. 6. In order to improve the transfer performance while maintaining developing performance, the ratio B/A may preferably be from 0.20 to 0.95, and more preferably from 0.35 to 0.85.

The toner used in the present invention also has an inorganic fine powder on its toner particle surfaces. This contributes to the improvement in transfer efficiency and the better prevention of blank areas caused by poor transfer in characters or line images. Here, as the toner, its specific surface area Sb per unit volume as measured by the BET method and specific surface area St ($St=6/D_4$) per unit volume as calculated from weight average particle diameter ($D_4$) on the assumption that the toner particles are truly spherical may preferably be in the relationship (ratio) of $3.0 \leqq Sb/St \leqq 7.0$ and $Sb \geqq St \times 1.5+1.5$. More preferably, the Sb may range from 3.2 to 6.8 $m^2/cm^3$, and more preferably from 3.4 to 6.3 $m^2/cm^3$.

If the above ratio is less than 3.0, the transfer efficiency may lower, and if it is more than 7.0, the image density may lower. This is presumably because the particles of the inorganic fine powder added to the toner particles effectively behave as spacers between the toner particles and the toner carrying member.

The specific surface area of the toner in the above range can be achieved by controlling the specific surface area of the toner particles, the specific surface area and amount of the inorganic fine powder added to the toner particles, and the strength when it is added and mixed. If it is added and mixed at a too great strength, the inorganic fine powder particles may be buried in the toner particles, resulting in a less improvement in transfer efficiency.

In order for the inorganic fine powder to be effectively used, the toner particles may have a specific surface area Sr per unit volume which ranges from 1.2 to 2.5 $m^2/cm^3$, and preferably from 1.4 to 2.1 $m^2/cm^3$, and is from 1.5 to 2.5 times the theoretical specific surface area per unit volume as calculated from weight average particle diameter on the assumption that the toner particles are truly spherical.

As a result of the addition of the inorganic fine powder, the specific surface area of the toner particles may preferably increase by at least 1.5 $m^2/cm^3$. Before the addition of the inorganic fine powder, it is preferable for the toner particles to have a 60% pore radius of 3.5 nm or smaller in the integrating pore area percentage curve of pores of 1 nm to 100 nm in size. Here, the ratio of the BET specific surface area Sb of the toner to the BET specific surface area Sr of the toner particles, Sb/Sr, may preferably be in the range of from 2 to 5.

Thus, the pores in the toner particles, having a size larger than the primary particle diameter of the inorganic fine powder added to the toner particles, are decreased, so that the inorganic fine powder is presumed to more effectively behave to improve the transfer efficiency.

The BET specific surface area is determined by the BET method, where nitrogen is adsorbed on sample surfaces using a specific surface area measuring device AUTOSOBE 1 (manufactured by Yuasa Ionics Co.), and the specific surface area is calculated by the BET multiple point method. The 60% pore radius is determined from the integrating pore area percentage curve with respect to the pore radius on the side of desorption. In AUTOSOBE 1, the pore distribution is calculated by the B. J. H. method proposed by Barrett, Joyner and Harenda (B. J. H.).

In the present invention, since the intermediate transfer member is provided so that various types of transfer mediums can be dealt with and 2 transfer steps are substantially carried out, any lowering of transfer efficiency causes a lowering of utilization efficiency of the toner, and may come into question. In digital full-color copying machines or printers, a color image original must be previously color separated using a B (blue) filter, a G (green) filter and a R (red) filter and thereafter a 20 to 70 $\mu$m dot latent image must be formed on the photosensitive member so that a multicolor image faithful to the original can be reproduced by utilizing the action of subtractive mixture using a Y (yellow) toner, a M (magenta) toner, a C (cyan) toner and a B (black) toner. Here, the Y toner, M toner, C toner and B toner are laid superimposingly on the photosensitive member or intermediate transfer member in accordance with the color information of the original or of a CRT, and hence the toner used in the present invention is required to have a very high transfer performance.

The black toner may preferably be a magnetic toner. Other color toners may preferably be non-magnetic toner so that vivid colors can be reproduced.

In order to faithfully develop minute latent image dots to achieve a much higher image quality, the toner particles may preferably have a weight average particle diameter of from 4 $\mu$m to 9 $\mu$m. In the case of such toner particles having a weight average particle diameter of from 4 $\mu$m to 9 $\mu$m, the toner may less cause a lowering of transfer efficiency, may less remain on the photosensitive member or intermediate transfer member after transfer, and may hardly cause non-uniform or uneven images ascribable to fog and faulty transfer. Moreover, in the case of the toner particles having a weight average particle diameter of from 4 $\mu$m to 9 $\mu$m, the toner may hardly cause black spots around characters or line images.

The average particle diameter and particle size distribution of the toner can be measured using a measuring device such as a Coulter Counter Model TA-II or Coulter Multisizer (manufactured by Coulter Electronics, Inc.). An interface (manufactured by Nikkaki k. k.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (Coulter Scientific Japan Co.) may be used. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with diameters of not smaller than 2 $\mu$m by means of, e.g., the above Coulter Counter Model TA-II, using an aperture of 100 $\mu$m as its aperture. Then, the volume-based weight average particle diameter ($D_4$) according to the present invention, determined from volume distribution, and the number-based length average particle diameter ($D_1$) determined from number distribution are determined.

To improve transfer efficiency in the transfer method making use of a transfer means to which a voltage is applied, the toner according to the present invention may preferably have a charge quantity (quantity of triboelectricity) per unit volume, of from 30 to 80 C/m$^3$, and more preferably from 40 to 70 C/m$^3$ (as measured by the two-component method).

Figure 4:
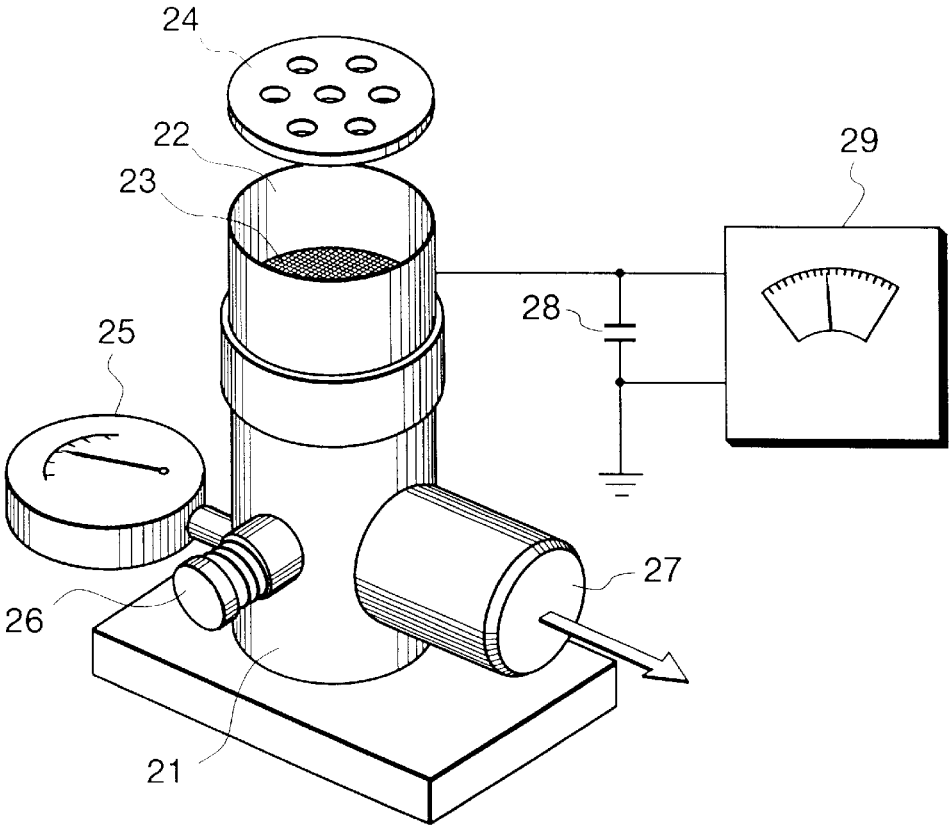
FIG. 4 is a schematic illustration of a charge quantity measuring device for measuring the quantity of triboelectricity of toners.

A method of measuring the charge quantity (two-component triboelectricity) of the toner according to the present invention by the two-component method will be described with reference to FIG. 4.

In an environment of 23° C. and relative humidity 60% and using an iron powder EFV200/300 (available from Powder Teck Co.) as a carrier, a mixture prepared by adding 0.5 g of the toner to 9.5 g of the carrier is put in a bottle with a volume of 50 to 100 ml, made of polyethylene, and manually shaked 50 times. 1.0 g to 1.2 g of the resulting mixture is put in a measuring container 22 made of a metal at the bottom of which a conductive screen 23 of 500 meshes is provided, and the container is covered with a plate 24 made of a metal. The total weight of the measuring container 22 at this time is weighed and is expressed as $W_1$ (g). Next, in a suction device 21 (made of an insulating material at least at the apart coming into contact with the measuring container 22), air is sucked from a suction opening 27 and an air-flow control valve 26 is operated to control the pressure indicated by a vacuum indicator 25 to be 2,450 hPa (250 mm Ag). In this state, suction is carried out for 1 minute to remove the toner by suction. The potential indicated by a potentiometer 29 at this time is expressed as V (volt). Reference numeral 28 denotes a capacitor, whose capacitance is expressed as C ($\mu$F). The total weight of the measuring container after completion of the suction is also weighed and is expressed as $W_2$ (g). The quantity of triboelectricity (mC/kg) of the toner is calculated as shown by the following expression. Quantity of triboelectricity (mC/kg)=$CV/(W_1-W_2)$ The above quantity of triboelectricity is multiplied by the true density to obtain the quantity of triboelectricity (C/m$^3$) per unit volume.

The true density of the toner is measured using a gas displacement type densitometer ACCUPYC 1330 (manufactured by Micromeritics Co.).

As the binder resin used in the toner, a peak of low-molecular weight in its molecular weight distribution as measured by gel permeation chromatography (GPC) may be in the range of from 3,000 to 15,000. This is preferable when the shape of toner particles produced by pulverization is controlled by thermomechanical impact force. If the peak of low-molecular weight is higher than 15,000, it is difficult to control the shape factors SF-1 and SF-2 within the range of the present invention, and the transfer efficiency can not be well improved. If the peak is lower than 3,000, the toner particles tend to melt-adhere at the time of surface treatment. The molecular weight is measured by GPC. As a specific method for measurement by GPC, the toner is beforehand extracted with tetrahydrofuran (THF) for 20 hours by means of a Soxhlet extractor. Using the sample thus obtained, and connecting as column constitution A-801, A-802, A-803, A-804, A-805, A-806 and A-807, available from Showa Denko K.K., the molecular weight distribution can be measured using a calibration curve of a standard polystyrene resin.

A resin having a ratio of weight average molecular weight (Mw) to number average molecular weight (Mn), Mw/Mn, of 2 to 100 is preferred in the present invention.

The toner may preferably have a glass transition point (Tg) of from 50° C. to 75° C., and more preferably from 52° C. to 70° C., in view of fixing performance and storage stability.

The glass transition point is measured using, for example, a differential scanning calorimeter of a high-precision inner heat input compensation type, such as DSC-7, manufactured by Parkin Elmer Co. Measured according to ASTM D3418-82. In the present invention, a DSC curve is used which is measured when the temperature of a sample is once raised to previously take a history, followed by rapid cooling, and the temperature is again raised at a rate of temperature rise of 10° C./min within the range of temperatures of from 0°to 200° C.

As the binder resin used in the present invention, it is possible to use polystyrene; styrene derivatives such as poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl a-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. A cross-linked styrene resin is also a preferred binder resin.

Comonomers copolymerizable with styrene monomers in the styrene copolymers may include vinyl monomers such as monocarboxylic acids having a double bond and derivatives thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof such as maleic acid, butyl maleate, methyl maleate and dimethyl maleate; vinyl esters such as vinyl chloride, vinyl acetate and vinyl benzoate; olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether; any of which may be used alone or in combination. As a cross-linking agent, compounds having at least two polymerizable double bonds may be used. For example, it may include aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

For the purposes of improving releasability from fixing members at the time of fixing and improving fixing performance, it is preferable to incorporate any of the following waxes in the toner particles. They may include paraffin wax and derivatives thereof, microcrystalline wax and derivatives thereof, Fischer-Tropsch wax and derivatives thereof, polyolefin wax and derivatives thereof, and carnauba wax and derivatives thereof. The derivatives may include oxides, block copolymers with vinyl monomers, and graft modified products.

Besides, long-chain alcohols, long-chain fatty acids, acid amides, ester waxes, ketones, hardened caster oil and derivatives thereof, vegetable waxes, animal waxes, mineral waxes and petrolatum may be used as occasion calls.

To produce the black toner, the binder resin, a wax, a pigment or dye as a colorant, a magnetic material, and optionally additives such as a charge control agent are thoroughly mixed using a mixing machine such as a Henschel mixer or a ball mill, and then the mixture is melt-kneaded using a heat kneading machine such as a heating roll, a kneader or an extruder to make the resin melt one another, in which the pigment, the dye or the magnetic material is dispersed or dissolved, followed by cooling for solidification and thereafter pulverization and classification. Thus the black toner can be obtained. In the step of classification, a multi-division classifier may preferably be used in view of production effeciency.

To make surface treatment of the black toner particles, there are methods including a hot-water bath method in which toner particles obtained by pulverization are dispersed in water, a heat treatment method in which the toner particles are passed through a hot-air stream, and a mechanical impact method in which a mechanical energy is imparted to the toner particles to make treatment. In the present invention, the mechanical impact method, in particular, a thermomechanical impact method in which the toner particles are treated at a temperature around the glass transition point Tg (Tg±10° C.) of the toner particles is preferred in view of the prevention of agglomeration and the productivity. More preferably, the treatment may be made at a temperature within a glass transition point Tg±5° C. of the black toner particles. This is especially effective for decreasing pores having a radius of 10 nm or larger, present in the surfaces of toner particles, and for effectively working the inorganic fine powder present on the toner particles.

The toner may also be produced by the method disclosed in Japanese Patent Publication No. 6-13945, in which a molten mixture is atomized or sprayed in the air by means of a disk or multiple fluid nozzles to obtain a spherical toner; the method disclosed in Japanese Patent Publication No. 36-10231 and Japanese Patent Applications Laid-open No. 59-53856 and No. 59-61842, in which toners are directly produced by suspension polymerization; a dispersion polymerization method in which toners are directly produced using an aqueous organic solvent in which monomers are soluble and polymers obtained are insoluble; or an emulsion polymerization method as typified by soap-free polymerization in which toners are produced by direct polymerization in the presence of a water-soluble polar polymerization initiator.

The toner particles may particularly preferably be produced by the suspension polymerization. Toner particles produced by seed polymerization, in which monomers are further adsorbed on polymer particles once obtained and thereafter a polymerization initiator is added to carry out polymerization, may also be preferably employed in the present invention.

It is also preferable to further add to the toner particles a polar resin such as a styrene- acrylate or methacrylate copolymer, a styrene-maleic acid copolymer and a saturated polyester resin.

When toner particles having a charge control agent are produced by the direct polymerization in the present invention, it is preferable to use charge control agents having neither polymerization inhibitory action nor solubilizates in an aqueous medium.

When the direct polymerization is employed to produce the toner particles, the toner particles can be produced by a process as described below. A monomer composition comprising polymerizable monomers and added therein a release agent comprised of a low-softening substance, a colorant, a charge control agent, a polymerization initiator and other additives, which are uniformly dissolved or dispersed by means of a homogenizer, an ultrasonic dispersion machine or the like, is dispersed in an aqueous phase containing a dispersion stabilizer, by means of a conventional stirrer, or a homomixer or a homogenizer. Granulation is carried out preferably while controlling the stirring speed and time so that droplets of the polymerizable monomer composition can have the desired toner particle size. After the granulation, stirring may be carried out to such an extent that the state of particles is maintained and the particles can be prevented from settling by the acton of the dispersion stabilizer. The polymerization may be carried out at a polymerization temperature set at 40° C. or above, usually from 50°to 90° C.

Preferred embodiments of the yellow toner, magenta toner and cyan toner will be described below.

The present invention can be more effective when toners whose particles have been partly or entirely formed by polymerization are used, In particular, with regard to toner particles whose surface portions have been formed by polymerization, toner particles are brought into presence in a dispersion medium as pre-toner (monomer composition) particles and their necessary portions are formed by the polymerization reaction. Hence, as to the surface properties, reasonably smoothed toner particles can be obtained.

Toner particles preferably used in the image forming method can be produced also when toner particles made to have a core/shell structure and whose shells are formed by polymerization are used.

Needless to say, the core/shell structure contributes to an improvement in blocking resistance without damaging a good fixing performance of the toner. Compared with polymerization toner particles formed as a bulk, having no cores, residual monomers can be more readily removed in a post-treatment step after the step of polymerization when only shells are polymerized.

As a main component of the core, it is preferable to use a low-softening substance, and it is preferable to use a compound having a main maximum peak value of endothermic peaks within a temperature range of from 40° to 90° C. as measured according to ASTM D3418-8. If the maximum peak value is lower than 40° C. the low-softening substance may have a weak self-cohesive force, undesirably resulting in a lowering of high-temperature anti-offset properties. If on the other hand the maximum peak value is higher than 90° C., fixing temperature may become higher.

The temperature of the maximum peak value of the low-softening substance is measured using, for example, DSC-7, manufactured by Perkin Elmer Co. The temperature at the detecting portion of the device is corrected on the basis of melting points of indium and zinc, and the calorie is corrected on the basis of heat of fusion of indium. The sample is put in a pan made of aluminum and an empty pan is set as a control, to make measurement at a rate of temperature rise of 10° C./min.

The low-softening substance may include paraffin waxes, polyolefin waxes, Fischer-Tropsch waxes, amide waxes, higher fatty acids, ester waxes, and derivatives of these or grafted or blocked compounds of these.

The low-softening substance may preferably be added in the toner in an amount of from 5 to 30 parts by weight based on 100 parts by weight of the binder resin. Its addition in an amount less than 5 parts by weight may impose a load on the removal of the residual monomers previously mentioned. On the other hand, its addition in an amount more than 30 parts by weight tends to cause toner particles to coalesce one another during granulation even when produced by polymerization, tending to produce toner particles having a broad particle size distribution.

The surfaces of the toner particles may preferably be coated with an external additive such as the inorganic fine powder so that the external additive on the toner particle surfaces may be in a coverage of from 5 to 99%, and more preferably from 10 to 99%. The coverage with the external additive on the toner particle surfaces is the value obtained by sampling at random 100 toner particle images (e.g., magnified 20,000 times) by the use of FE-SEM (S-800; a scanning electron microscope manufactured by Hitachi Ltd.), introducing their image information in an image analyzer (LUZEX-III; manufactured by Nikore Co.) through an interface to make analysis, and calculating the data obtained.

The external additive may preferably have a particle diameter not larger than 1/10 of a weight average particle diameter of the toner particles, in view of its durability when mixed with the toner particles. The particle diameter of this external additive refers to an average particle diameter obtained by observing the toner particles (e.g., magnified 20,000 times) on the electron microscope. As the external additive, it may include fine powders of metal oxides such as aluminum oxide, titanium oxide, strontium titanate, cerium oxide, magnesium oxide, chromium oxide, tin oxide and zinc oxide; fine powders of nitrides such as silicon nitride; fine powders of carbides such as silicon carbide; fine powders of metal salts such as calcium sulfate, barium sulfate and calcium carbonate; fine powders of fatty acid metal salts such as zinc stearate and calcium stearate; carbon black; and fine silica powder.

Any of these external additives may be used in an amount of from 0.01 to 10 parts by weight, and preferably from 0.05 to 5 parts by weight, based on 100 parts by weight of the toner particles. These external additives may be used alone or may be used in combination of plural ones. Those having been subjected to hydrophobic treatment are more preferred.

In the present invention, the toner particles may particularly preferably be produced by the suspension polymerization under normal pressure or under application of a pressure, which can obtain relatively with ease a fine-particle toner having a sharp particle size distribution and a particle diameter of from 4 to 8 μm. As a specific method by which the low-softening substance is encapsulated, the polarities of materials in an aqueous medium are set smaller on the low-softening substance than on the main polymerizable monomers and also a small amount of resin or polymerizable monomer with a great polarity may be added. Thus, toner particles having the core/shell structure wherein the low-softening substance is covered with the shell resin can be obtained. The particle size distribution and particle diameter of the toner particles may be controlled by a method in which the types and amounts of a sparingly water-insoluble inorganic salt and a dispersant having the action of protective colloids are changed, or by controlling mechanical device conditions (e.g., conditions for agitation, such as the peripheral speed of a rotor, pass times, the shape of agitating blades, the shape of a container), or the concentration of solid matter in the aqueous medium, whereby the desired toner particles can be obtained.

Cross sections of the toner particles can be observed by, for example, a method in which toner particles are well dispersed in a room temperature curing epoxy resin, followed by curing in an environment of temperature 40° C. for 2 days, and the cured product obtained is dyed with triruthenium tetraoxide (optionally in combination with triosmium tetraoxide), thereafter samples are cut out in slices by means of a microtome having a diamond cutter, to observe the cross sections of toner particles using a transmission electron microscope (TEM). It is preferable to use the triruthenium tetraoxide dyeing method in order to form a contrast between the materials by utilizing some difference in crystallinity between the low-softening substance and the resin constituting the shell.

The resin used to form the shell may include a styrene-acrylate or methacrylate copolymer, polyester resins, epoxy resins and a styrene-butadiene copolymer. In the method in which the toner particles are directly obtained by polymerization, what are preferably used are styrene; styrene type monomers such as o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile and acrylic acid amide. Any of these may be used in the polymerization, alone or in the form of an appropriate mixture of monomers so mixed that the theoretical glass transition temperature (Tg) as described in a publication POLYMER HANDBOOK, 2nd Edition III, pp.139–192 (John Wiley & Sons, Inc.) ranges from 40° to 75° C. If the theoretical glass transition temperature is lower than 40° C., problems may arise in respect of storage stability or running stability of the toner. If on the other hand it is higher than 75° C., the fixing point of the toner may become higher. Especially in the case of color toners used to form full-color images, the color mixing performance of the respective color toners at the time of fixing may lower, resulting in a poor color reproducibility. Also, the transparency of OHP images may lower.

Molecular weight of the shell resin is measured by gel permeation chromatography (GPC). As a specific method for measurement by GPC, the toner is beforehand extracted with a toluene solvent for 20 hours by means of a Soxhlet extractor, and thereafter the toluene is evaporated by means of a rotary evaporator, followed by addition of an organic solvent capable of dissolving the low-softening substance but dissolving no shell resin (e.g., chloroform), to thoroughly carry out washing. Thereafter, the solution is dissolved in tetrahydrofuran (THF), and then filtered with a solvent-resistant membrane filter of 0.3 μm in pore diameter to obtain a sample. Molecular weight of the sample is measured using a detector 150C, manufactured by Waters Co. As column constitution, A-801, A-802, A-803, A-804, A-805, A-806 and A-807, available from Showa Denko K.K., are connected, and molecular weight distribution can be measured using a calibration curve of a standard polystyrene resin. The resin component obtained may preferably have a number average molecular weight (Mn) of from 5,000 to 1,000,000, and a shell resin standing 2 to 100 as the ratio of weight average molecular weight (Mw) to number average molecular weight (Mn), Mw/Mn, is preferred.

When the toner particles having such core/shell structure are produced, in order to encapsulate the low-softening substance with the shell resin, it is particularly preferable to further add a polar resin as an additional shell resin. As the polar resin used in the present invention, copolymers of styrene with acrylic or methacrylic acid, maleic acid copolymers, saturated polyester resins and epoxy resins are preferably used. The polar resin may particularly preferably be those not containing in the molecule any unsaturated groups that may react with the shell resin or polymerizable monomers. If a polar resin having such unsaturated groups is contained, cross-linking reaction with the polymerizable monomers that form the shell resin takes place, so that the shell resin comes to have a too high molecular weight especially for the toners for forming full-color images and is disadvantageous for color mixture of four color toners. Thus, such a resin is not preferable.

The surfaces of the toner particles may be further provided with an outermost shell resin layer.

Such an outermost shell resin layer may preferably have a glass transition temperature so designed as to be higher than the glass transition temperature of the shell resin in order to more improve blocking resistance. The outermost shell resin layer may also preferably be cross-linked to such an extent that the fixing performance is not damaged. The outermost shell resin layer may preferably be incorporated with a polar resin or a charge control agent in order to improve charging performance.

There are no particular limitations on how to provide the outermost shell resin layer. For example, it may be provided by a method including the following.

1) A method in which, at the latter half or after the completion of polymerization reaction, a monomer composition prepared by dissolving or dispersing the polar resin, a charge control agent, a cross-linking agent and so forth as occasion calls is added, and adsorbed on polymerization particles, followed by addition of a polymerization initiator to carry out polymerization.
2) A method in which emulsion polymerization particles or soap-free polymerization particles produced from a monomer composition containing the polar resin, a charge control agent, a cross-linking agent and so forth as occasion calls are added in the reaction system, and are caused to cohere to the surfaces of polymerization particles, optionally followed by heating to fix them.
3) A method in which emulsion polymerization particles or soap-free polymerization particles produced from a monomer composition containing the polar resin, a charge control agent, a cross-linking agent and so forth as occasion calls are mechanically caused to fix to the surfaces of toner particles.

In the black toner used in the present invention, a charge control agent may preferably be used by compounding it into toner particles (internal addition) or blending it with toner particles (external addition). The charge control agent enables control of optimum charge quantity in conformity with developing systems. Particularly in the present invention, it can make more stable the balance between particle size distribution and charge quantity. Those capable of controlling the toner to be negatively chargeable may include the following materials.

For example, organic metal complexes or chelate compounds are effective. They include monoazo metal complexes, acetylacetone metal complexes, and metal complexes of an aromatic hydroxycarboxylic acid type or aromatic dicarboxylic acid type. Besides, they include aromatic mono- or polycarboxylic acids and metal salts, anhydrides or esters thereof, and phenol derivatives such as bisphenol.

Those capable of controlling the toner to be positively chargeable may include the following materials.

Nigrosine and products modified with a fatty acid metal salt; quaternary ammonium salts such as tributylbenzylammonium 1-hydroxy-4-naphthosulfonate and tetrabutylammonium tetrafluoroborate, and analogues of these, including onium salts such as phosphonium salts and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more kinds.

The charge control agents described above may preferably be used in the form of fine particles. These charge control agents may preferably have a number average particle diameter of 4 $\mu$m or smaller, and particularly preferably 3 $\mu$m or smaller. In the case when the charge control agent is internally added to the toner particles, it may preferably be used in an amount of from 0.1 to 20 parts by weight, and particularly from 0.2 to 10 parts by weight, based on 100 parts by weight of the binder resin.

Black colorants may include carbon black, magnetic materials, and colorants toned in black by the use of yellow, magenta and cyan colorants shown below.

The yellow colorants include compounds as typified by condensation azo compounds, isoindolinone compounds, anthraquinone compounds, azo metal complexes, methine compounds and allylamide compounds. Stated specifically, C.I. Pigment Yellow 12, 13, 14, 15, 17, 62, 74, 83, 93, 94, 95, 97, 109, 110, 111, 120, 127, 128, 129, 147, 168, 174, 176, 180, 181 and 191 are preferably used.

The magenta colorants include condensation azo compounds, diketopyrrolopyrrole compounds, anthraquinone compounds, quinacridone compounds, basic dye lake compounds, naphthol compounds, benzimidazolone compounds, thioindigo compounds and perylene compounds. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferable.

The cyan colorants include copper phthalocyanine compounds and derivatives thereof, anthraquinone compounds and basic dye lake compounds. Stated specifically, C.I. Pigment Blue 1, 7, 15, 15:1, 15:2, 15:3, 15:4, 60, 62 and 66 may be particularly preferably used.

These colorants may be used alone, in the form of a mixture, or in the state of a solid solution. The colorants are selected taking account of hue angle, chroma, brightness, weatherability, transparency on OHP films and dispersibility in toner particles. The non-magnetic colorant may preferably be used in an amount of from 1 to 20 parts by weight based on 100 parts by weight of the binder resin.

The magnetic material includes metal oxides containing an element such as iron, cobalt, nickel, copper, magnesium, manganese, aluminum or silicon. In particular, those mainly composed of an iron oxide such as triiron tetraoxide or γ-iron oxide are preferred. In view of the control of charging performance of the toner, the magnetic material may contain metal element such as silicon element or aluminum element. These magnetic materials may have a BET specific surface area, as measured by nitrogen gas absorption, of from 2 to 30 $m^2/g$, and particularly from 3 to 28 $m^2/g$, and may preferably magnetic materials having a Mohs hardness of from 5 to 7.

As to the shape of the magnetic material, it may be octahedral, hexahedral, spherical, acicular or flaky. Those having less anisotropy such as octahedral, hexahedral or spherical ones are preferred in view of an improvement in image density.

The magnetic material may preferably have an average particle diameter of from 0.05 to 1.0 pm, more preferably from 0.1 to 0.6 μm, and still more preferably from 0.1 to 0.4 μm.

The magnetic material may be in a content of from 30 to 200 parts by weight, preferably from 40 to 200 parts by weight, and more preferably from 50 to 150 parts by weight, based on 100 parts by weight of the binder resin. If it is in a content less than 30 parts by weight, the transport performance of the magnetic toner may lower to tend to make the toner layer on the toner carrying member uneven and cause uneven images in the case of developing assemblies where a magnetic force is utilized to transport the toner. Also, the quantity of triboelectricity of the magnetic toner may increase to tend to cause a decrease in image density. On the other hand, if it is in a content more than 200 parts by weight, the fixing performance tends to come into question.

As the inorganic fine powder mixed with the toner particles, known materials may be used. In order to improve charge stability, developing performance, fluidity and storage stability, it may preferably be selected from fine silica powder, fine alumina powder, fine titania powder, and fine powders of double oxides thereof. Fine silica powder is particularly preferred. Silica includes dry-process silica produced by vapor phase oxidation of silicon halides or alkoxides and wet-process silica produced from alkoxides or water glass, either of which can be used. The dry-process silica is preferred, as having less silanol groups on the surface and the inside of fine silica powder and leaving no production residue such as $Na_2O$ and $SO_3^{2-}$. In the dry-process silica, it is also possible to use, in its production step, a metal halide such as aluminum chloride or titanium chloride together with the silicon halide to give a composite fine powder of silica with other metal oxide. Such powders may also be used.

The inorganic fine powder used in the present invention may have a specific surface area, as measured by the BET method using nitrogen gas absorption, of 30 $m^2/g$ or above, and particularly ranging from 50 to 400 $m^2/g$, where good results can be obtained. The fine silica powder may be used in an amount of from 0.1 to 8 parts by weight, preferably from 0.5 to 5 parts by weight, and more preferably from 1.0 to 3.0 parts by weight, based on 100 parts by weight of the toner particles.

The inorganic fine powder used in the present invention may preferably have a primary particle diameter of 30 nm or smaller.

For the purposes of making hydrophobic, control of chargeability and so forth, the inorganic fine powder used in the present invention may preferably be treated, if necessary, with a treating agent such as silicone varnish, modified silicone varnish of various types, silicone oil, modified silicone oil of various types, a silane coupling agent, a silane coupling agent having a functional group, other organic silicon compound or an organic titanium compound. The treating agent may be used in combination of two or more kinds.

In order for the toner to maintain a high charge quantity and achieve a low toner consumption and a high transfer efficiency, the inorganic fine powder may more preferably be treated with silicone oil.

In the present invention, in order to improve transfer performance and/or cleaning performance, inorganic or organic, closely spherical fine particles having a primary particle diameter larger than 30 nm (preferably having a specific surface area smaller than 50 $m^2$), and more preferably 50 nm or larger (preferably having a specific surface area smaller than 50 $m^2$) may be further added in addition to the inorganic fine powder described above. This is one of preferred forms of the inorganic fine powder. For example, spherical silica particles, spherical polymethylsilsesquioxane particles and spherical resin particles are preferably used.

Other additives may also be used so long as they substantially do not adversely affect the toner. They may include, for example, lubricant powders such as Teflon powder, stearic acid zinc powder and polyvinylidene fluoride powder; abrasives such as cerium oxide powder, silicon carbide powder and strontium titanate powder; fluidity-providing agents such as titanium oxide powder and aluminum oxide powder; anti-caking agents; conductivity-providing agents such as carbon black powder, zinc oxide powder and tin oxide powder; and reverse-polarity organic fine particles and inorganic fine particles.

As the inorganic fine powder externally added to the yellow toner, magenta toner and cyan toner, titanium oxide or alumina is preferred which has been treated while hydrolyzing a specific coupling agent in the presence of water, and has an average particle diameter of from 0.01 to 0.2 μm, a hydrophobicity of from 20 to 98% and a light transmittance at 400 nm, of 40% or more. In water, homogeneous hydrophobic treatment can be carried out, and also no particles may coalesce one another. Thus, such powder is very effective in view of charge stabilization of the toner and providing fluidity to the toner.

When such powder is surface-treated by hydrolyzing a coupling agent while dispersing inorganic fine particles in the presence of water so as to mechanically turn into primary particles, the particles may hardly coalesce one another, and also the charge repulsion acts between particles because of the treatment, so that the inorganic fine particles can be surface-treated substantially in the state of primary particles.

Since a mechanical force for dispersing the inorganic fine particles into primary particles is applied when surface-treated while hydrolyzing a coupling agent in the presence of water, it is unnecessary to use coupling agents which are gasifiable such as chlorosilanes and silazanes. Moreover, highly viscous coupling agents or silicone oil that have not been usable because of the particles coalescing one another can be used in combination.

The coupling agent may include silane coupling agents or titanium coupling agents. Those particularly preferably used are silane coupling agents, including the compounds represented by the following formula.

$$R_mSiY_n$$

wherein R is an alkoxyl group; m is an integer of 1 to 3; Y is a hydrocarbon group such as an alkyl group, a vinyl group, a glycidoxyl group or a methacrylic group; and n is an integer of 1 to 3.

For example, the compounds may include vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane.

Trialkoxyalkylsilane coupling agents represented by the following formula are more preferred.

$$C_aH_{a+1}—Si—(—OC_bH_{2b+1})_3$$

wherein a represents an integer of 4 to 12 and b represents an integer of 1 to 3.

If a is smaller than 4, the treatment becomes easier but the hydrophobicity may lower. If a is greater than 12, a satisfactory hydrophobicity can be achieved but the particles tend to coalesce one another.

If b is larger than 3, the reactivity may lower.

Hence, a should be 4 to 12, and preferably 4 to 8, and b should be 1 to 3, and preferably 1 or 2.

The treatment may be made in a quantity of from 1 to 50 parts by weight, and preferably from 3 to 40 parts by weight, based on 100 parts by weight of the inorganic fine powder. The inorganic fine powder may be treated to have a hydrophobicity of from 20 to 98%, preferably from 30 to 90%, and more preferably from 40 to 80%.

If its hydrophobicity is smaller than 20%, the charge quantity tends to lower when the toner is left for a long term in an environment of high humidity. If its hydrophobicity is higher than 98%, the toner tends to cause charge-up in an environment of low humidity.

In view of the improvement in fluidity of the toner particles, the inorganic fine powder made hydrophobic may preferably have an average particle diameter of from 0.01 to 0.2 μm. If its average particle diameter is larger than 0.2 μm, the uniformity in the charging of toner may lower, consequently tending to cause toner scatter and fog. If its average particle diameter is smaller than 0.01 μm, the treated fine powder tends to be buried in the toner particle surfaces to cause a deterioration of the toner, tending to result in a lowering of durability or running performance.

As methods for the above treatment, it is effective to use a method in which the powder is treated by hydrolyzing the coupling agent while dispersing the particles in an aqueous medium so as to mechanically turn into primary particles.

The inorganic fine powder made hydrophobic in the manner as described above may also preferably have a light transmittance at 400 nm, of 40% or more.

In order to improve transfer performance and/or cleaning performance, inorganic or organic, closely spherical fine particles having a primary particle diameter larger than 50 nm (preferably having a specific surface area smaller than 30 $m^2$) may be further added. This is one of preferred forms of the inorganic fine powder. For example, spherical silica particles, spherical polymethylsilsesquioxane particles and spherical resin particles are preferably used.

The black toner used in the present invention may preferably hold a liquid lubricant.

A small amount of the liquid lubricant coats the surface of the electrostatic latent image bearing member and intermediate transfer member and imparts a good releasability to the toner particles, so that the toner on the surface of the electrostatic latent image bearing member can be uniformly and effectively transferred to the intermediate transfer member.

The liquid lubricant may preferably be supported on supporting particles such as magnetic material particles by adsorption, granulation, agglomeration, impregnation or encapsulation so as to be incorporated into the toner particles. This enables the liquid lubricant to be present on the toner particle surfaces uniformly and in a proper quantity, so that the releasability and lubricity of the toner particles can be made stable.

As the liquid lubricant for imparting the releasability and lubricity to the toner, animal oil, vegetable oil, petroleum oil or synthetic lubricating oil may be used. Synthetic lubricating oil is preferably used in view of its stability. The synthetic lubricating oil may include silicone oils such as dimethylsilicone oil, methylphenylsilicone oil, modified silicone oil of various types; polyol esters such as pentaerythritol ester and trimethylolpropane ester; polyolefins such as polyethylene, polypropylene, polybutene and poly(α-olefin); polyglycols such as polyethylene glycol and polypropylene glycol; silicic esters such as tetradecyl silicate and tetraoctyl silicate; diesters such as di-2-ethylhexyl sebacate and di-2-ethylhexyl adipate; phosphoric esters such as tricresyl phosphate and propylphenyl phosphate; fluorinated hydrocarbon compounds such as polychlorotrifluoroethylene, polytetrafluoroethylene, polyvinylidene fluoride and polyethylene fluoride; polyphenyl ethers, alkylnaphthenes, and alkyl aromatics. In particular, from the viewpoint of thermal stability and oxidation stability, silicone oils or fluorinated hydrocarbons are preferred. The silicone oils may include reactive silicone oils such as amino-modified silicone oil, epoxy-modified silicone oil, carboxyl-modified silicone oil, carbinol-modified silicone oil, methacryl-modified silicone oil, mercapto-modified silicone oil, phenol-modified silicone oil and heterofunctional group-modified silicone oil; non-reactive silicone oils such as polyether-modified silicone oil, methylstyryl-modified silicone oil, alkyl-modified silicone oil, fatty acid-modified silicone oil, alkoxy-modified silicone oil and fluorine-modified silicone oil; and straight silicone oils such as dimethylsilicone oil, methylphenylsilicone oil and methylhydrogensilicone oil.

The liquid lubricant supported on the particle surfaces of the magnetic material, or on the supporting particles, is partly liberated to become present on the surfaces of the toner particles and thereby exhibits its efficacy. Hence, curable silicone oils are less effective on account of their nature. Reactive silicone oils or silicone oils having polar groups may be strongly adsorbed on the supporting medium of the liquid lubricant or may become compatible with the binder resin. They may be liberated in a small quantity depending on the degree of adsorption or compatibility, and can not be so effective in some cases. Non-reactive silicone oils may also become compatible with the binder resin, depending on the structure of the side chain, and can be less effective in some cases. Hence, dimethylsilicone oil, fluorine-modified silicone oils or fluorinated hydrocarbons are preferably used because of less polarity, no strong adsorption and no compatibility with binder resins. The liquid lubricant may preferably have a viscosity at 25° C. of from 10 to 200,000 cSt, more preferably from 20 to 100,000 cSt, and still more preferably from 50 to 70,000 cSt. If it has a viscosity lower than 10 cSt, low-molecular weight components increase to tend to cause problems in developing performance and storage stability. If it has a viscosity higher than 200,000 cSt, its movement through or dispersion in the toner particles tend to be non-uniform to tend to cause problems in developing performance, transfer performance, anti-contamination properties and so forth. The viscosity of the liquid lubricant is measured using, for example, Viscotester VT500 (manufactured by Haake Co.).

One of sensors of some viscosity sensors for VT500 is arbitrarily selected, and a specimen to be measured is put in a cell for the sensor to make measurement. Viscosities (pas) indicated on the device are calculated into cSt.

The liquid lubricant is used in such a way that it is supported on the magnetic material or supporting particles, and hence can achieve better dispersibility than the case when the liquid lubricant such as silicone oil is merely added as it is. It is not intended to merely improve dispersibility. The liquid lubricant must be liberated from the supporting particles so that the releasability and lubricity attributable thereto can be exhibited, and at the same time the liquid lubricant must be made to have an appropriate adsorption strength so that it can be prevented from being liberated in excess.

The liquid lubricant is held on the surfaces of supporting particles so as to be made present on the surfaces of the toner particles or in the vicinity thereof, whereby the quantity of the liquid lubricant on the surfaces of the toner particles can be appropriately controlled.

As a specific method for making the liquid lubricant of the present invention supported on the particle surfaces of the magnetic material, a wheel type kneading machine or the like may be used. When the wheel type kneading machine or the like is used, the liquid lubricant present between magnetic particles is, by virtue of compression action, pressed against magnetic particle surfaces and at the same time passed through gaps between the magnetic particles to widen the gaps by force to increase its adhesion to the magnetic particle surfaces. While the liquid lubricant is extended by virtue of shear action, the shear force acts on the magnetic particles at different positions to loosen their agglomeration. Moreover, by virtue of the action of as if spreading with a spatula, the liquid lubricant present on the magnetic particle surfaces is uniformly spread. These actions are repeated to completely loosen the agglomeration between magnetic particles, so that the liquid lubricant is uniformly supported on the surfaces of individual magnetic particles in such a state that the individual magnetic particles are kept apart one by one. Thus, this is a particularly preferred means. As the wheel type kneading machine, it is preferable to use a Simpson mix muller, a multi-muller, a Stotz mill, an Eirich mill or a reverse-flow kneader.

It is also known to use a method in which the liquid lubricant is, as it is or after diluted with a solvent, directly mixed with magnetic particles so as to be supported thereon, by means of a mixing machine such as a Henschel mixer or a ball mill, or a method in which the liquid lubricant is directly sprayed on magnetic material particles so as to be supported thereon. According to these methods, however, in the case of magnetic material particles, it is difficult to make a small quantity of liquid lubricant uniformly supported on the supporting particles, or shear force and heat are locally applied to cause the liquid lubricant to be firmly adsorbed on the particles. Moreover, in the case of silicone oils, the liquid lubricant may seize (or burn to stick) on the supporting particles and hence can not be effectively liberated therefrom in some cases.

As to the amount of the liquid lubricant supported on the magnetic material, the relative amount of the liquid lubricant with respect to the binder resin is important from the viewpoint of its efficacy. As its optimum range, the liquid lubricant may preferably be added and made supported on the magnetic material so as to be in an amount of from 0.1 to 7 parts by weight, more preferably from 0.2 to 5 parts by weight, and particularly from 0.3 to 2 parts by weight, based on 100 parts by weight of the binder resin.

As lubricant-supported particles (or lubricating particles) other than the lubricant-supported magnetic material described above, containing the liquid lubricant, fine particles of an organic compound or inorganic compound which are prepared by granulation or agglomeration using the liquid lubricant may be used as the lubricant-supported particles.

The organic compound that constitutes organic fine particles may include resins such as styrene resin, acrylic resin, silicone resin, polyester resin, urethane resin, polyamide resin, polyethylene resin and fluorine resin. The inorganic compound that constitutes inorganic fine particles may include oxides such as $SiO_2$, $GeO_2$, $TiO_2$, $SnO_2$, $Al_2O_3$, $B_2O_3$ and $P_2O_5$; metal oxide salts such as silicate, borate, phosphate, borosilicate, aluminosilicate, aluminoborate, aluminoborosilicate, tungstate, molybdate and tellurate; composite compounds of any of these; silicon carbide, silicon nitride, and amorphous carbon. These may be used alone or in the form of a mixture.

Of these, inorganic compounds, in particular, metal oxides are preferable in view of their appropriate electrical resistance. In particular, oxides or double oxides of Si, Al or Ti are preferred. Especially when used in the color toners other than the black toner, substantially white inorganic compounds are preferably used.

Fine particles whose surfaces have been made hydrophobic by a coupling agent may also be used. However, some liquid lubricants tend to cause excessive charging when the surfaces of the toner particles are coated. Use of those having not been made hydrophobic enables the charges to be appropriately leaked to make it possible to maintain good developing performance. Hence, it is one of preferred embodiments to use supporting particles having been subjected to hydrophobic treatment.

The supporting fine particles may preferably have a particle diameter of from 0.001 to 20 $\mu$m, and particularly from 0.005 to 10 $\mu$m. The supporting particles may preferably have a BET specific surface area, as measured by the BET method using nitrogen gas absorption, of from 5 to 500 $m^2/g$, more preferably from 10 to 400 $m^2/g$, and still more preferably from 20 to 350 $m^2/g$. If the particles have a BET specific surface area smaller than 5 $m^2/g$, it is difficult for the liquid lubricant of the present invention to be held to form lubricant-supported particles having preferable particle diameters.

The liquid lubricant in the lubricant-supported particles may be in an amount of from 20 to 90% by weight, preferably from 27 to 87% by weight, and particularly preferably from 40 to 80% by weight. If the liquid lubricant is in an amount less than 20% by weight, good releasability and lubricity can be less effectively imparted to the toner particles. If it is in an amount more than 90% by weight, it is difficult to obtain lubricant-supported particles uniformly containing the liquid lubricant.

In order to enable liberation of the liquid lubricant while holding it, the lubricant-supported particles may preferably have a particle diameter of 0.5 $\mu$m or larger, and more preferably 1 $\mu$m or larger. The main component thereof according to volume-based distribution may preferably have a larger particle diameter than the toner particles. These lubricant-supported particles hold the liquid lubricant in so large a quantity and are so brittle that they collapses in part during the production of the toner and are uniformly dispersed in the toner particles and at the same time can liberate the liquid lubricant to impart the lubricity and releasability to the toner particles. On the other hand, the remaining lubricant-supported particles can be present in the toner particles in such a state that they maintain the ability to hold the liquid lubricant.

Hence, the liquid lubricant is by no means moved in excess to the surfaces of the toner particles and also the toner can be prevented from causing a lowering of fluidity and developing performance. Meanwhile, even if the liquid lubricant has gone away in part from the surfaces of the toner particles, it can be supplemented from the lubricant-supported particles, and hence it is possible to maintain the releasability and lubricity of the toner particles for a long period of time. These lubricant-supported particles can be produced by granulation according to a method in which liquid droplets of the liquid lubricant or of a solution prepared by diluting it in a desired solvent are adsorbed on the supporting fine particles. The solvent is evaporated after the granulation, and the product may further be pulverized if necessary. Alternatively, a method may also be used in which the liquid lubricant or a dilute solution thereof is added to the supporting particles and the mixture obtained is kneaded, optionally followed by pulverization to carry out granulation, and thereafter the solvent is evaporated. The lubricant-supported particles may preferably be contained in an amount of from 0.01 to 50 parts by weight, more preferably from 0.05 to 50 parts by weight, and particularly preferably from 0.1 to 20 parts by weight, based on 100 parts by weight of the binder resin. If it is in an amount less than 0.01 part by weight, its addition can be less effective. If it is in an amount more than 50 parts by weight, charging stability may come into question.

As the lubricant-supported particles, those comprising a porous powder impregnated with or internally holding the liquid lubricant may also be used.

The porous powder includes clay minerals such as zeolite, molecular sieves and bentonite, as well as aluminum oxide, titanium oxide, zinc oxide and resin gels. Of these porous powders, powders such as resin gels whose particles collapse with ease in the step of kneading when the toner is produced may have any particle diameters without a limitation. Porous powders collapsible with difficulty may preferably have a primary particle diameter of 15 $\mu$m or smaller. Those having a primary particle diameter larger than 15 $\mu$m tend to be non-uniformly dispersed in the toner particles. The porous powder, before it is impregnated with the liquid lubricant, may preferably have a specific surface area, as measured by the BET method using nitrogen gas absorption, of from 10 to 50 $m^2/g$. If its specific surface area is smaller than 10 $m^2/g$, it is difficult to hold the liquid lubricant in a large quantity. If larger than 50 $m^2/g$, the porous powder has so small a pore size that the liquid lubricant can permeate through the pores with difficulty. As a method of impregnating the porous powder with the liquid lubricant, the porous powder may be treated under reduced pressure and the powder thus treated may be immersed in the liquid lubricant to produced the impregnated powder. The porous powder impregnated with the liquid lubricant may preferably be mixed in an amount ranging from 0.1 to 20 parts by weight based on 100 parts by weight of the binder resin. If it is in an amount less than 0.1 part by weight, its addition can be less effective. If it is in an amount more than 20 parts by weight, the charging performance of the toner may come into question. Besides these, it is also possible to use capsule type lubricant-supported particles internally holding the liquid lubricant, or resin particles with the liquid lubricant internally dispersed or held therein or those swelled or impregnated with the liquid lubricant.

In the electrostatic latent image bearing member used in the present invention, the surface of the electrostatic latent image bearing member may have a contact angle to water, not smaller than 85 degrees, preferably not smaller than 90 degrees. When its contact angle to water is not smaller than 85 degrees, the transfer efficiency of toner images is improved and also the toner may hardly cause filming.

The image forming method of the present invention is effective especially when the surface of the electrostatic latent image bearing member is mainly formed of a polymeric binder; for example, when a protective film mainly formed of a resin is provided on an inorganic photosensitive layer comprised of a material such as selenium or amorphous silicon; when a function-separated photosensitive layer has as a charge transport layer a surface layer formed of a charge-transporting material and a resin; and when the protective layer as described above is further provided thereon. As a means for imparting releasability to such a surface layer, it is possible (1) to use a material with a low surface energy in the resin itself constituting the layer, (2) to add an additive capable of imparting water repellency or lipophilicity, and (3) to disperse in a powdery form a material having a high releasability. As an example of means (1) , the object is achieved by introducing into the resin structure a fluorine-containing group or a silicone-containing group. As means (2), a surface active agent or the like may be used as the additive. As means (3), the material may include powders of compounds containing fluorine atoms, such as polytetrafluoroethylene, polyvinylidene fluoride and carbon fluoride. Of these, polytetrafluoroethylene is particularly preferred. In the present invention, the means (3) is particularly preferred, i.e., to disperse the powder with releasability, such as fluorine-containing resin, in the outermost surface layer.

In order to incorporate such powder into the surface, a layer comprising a binder resin with the powder dispersed therein may be provided on the outermost surface of the electrostatic latent image bearing member. Alternatively, in the case of an organic photosensitive layer originally mainly comprised of a resin, the powder may be merely dispersed in the outermost layer without anew providing the surface layer.

The powder may preferably be added to the surface layer in an amount of from 1 to 60% by weight, and more preferably from 2 to 50% by weight, based on the total weight of the surface layer. Its addition in an amount less than 1% by weight can be less effective for intended improvement. Its addition in an amount more than 60% by weight is not preferable since the film strength may lower or the amount of light incident on the electrostatic latent image bearing member may decrease.

The present invention is effective especially in the case of a direct charging method where charging means is a charging member brought into contact with the electrostatic latent image bearing member. Since the load on the surface of the electrostatic latent image bearing member is great in such direct charging, compared with the corona charging where charging means is not in contact with the electrostatic latent image bearing member, such an electrostatic latent image bearing member can be remarkably effective for improving its lifetime.

A preferred embodiment of the electrostatic latent image bearing member used in the present invention will be described below.

It basically comprises a conductive substrate, and a photosensitive layer functionally separated into a charge generation layer and a charge transport layer.

Materials used to form the conductive substrate may include metals such as aluminum and stainless steel; plastics having a coat layer of an alloy such as an aluminum alloy or an indium oxide-tin oxide alloy; papers or plastics impregnated with conductive particles; and plastics having a conductive polymer. As the substrate, a cylindrical member or a film is used.

On the conductive substrate, a subbing layer may be provided for the purposes of improving adhesion of the photosensitive layer, improving coating properties, protecting the substrate, covering defects on the substrate, improving the performance of charge injection from the substrate and protecting the photosensitive layer from electrical breakdown. The subbing layer may be formed of a material such as polyvinyl alcohol, poly-N-vinyl imidazole, polyethylene oxide, ethyl cellulose, methyl cellulose, nitrocellulose, an ethylene-acrylic acid copolymer, polyvinyl butyral, phenol resin, casein, polyamide, copolymer nylon, glue, gelatin, polyurethane or aluminum oxide. The subbing layer may usually be in a thickness of from 0.1 to 10 $\mu$m, and preferably from 0.1to 3 $\mu$m.

The charge generation layer is formed by coating a solution prepared by dispersing a charge-generating material in a suitable binder, or by vacuum deposition of the charge-generating material. The charge-generating material may include organic materials such as azo pigments, phthalocyanine pigments, indigo pigments, perylene pigments, polycyclic quinone pigments, squarilium dyes, pyrylium salts, thiopyrylium salts, triphenylmethane dyes, and inorganic materials such as selenium and amorphous silicon. The binder can be selected from a vast range of binder resins, including, for example, resins such as polycarbonate resin, polyester resin, polyvinyl butyral resin, polystyrene resin, acrylic resin, methacrylic resin, phenol resin, silicone resin, epoxy resin and vinyl acetate resin. The binder contained in the charge generation layer may be in an amount not more than 80% by weight, and preferably from 0 to 40% by weight. The charge generation layer may preferably have a thickness of 5 $\mu$m or smaller, and particularly from 0.05 to 2 $\mu$m.

The charge transport layer has the function to receive charge carriers from the charge generation layer in an electric field and transport them. The charge transport layer is formed by coating a solution prepared by dispersing a charge-transporting material in a solvent optionally together with a binder resin. Usually, the charge transport layer may preferably have a layer thickness of from 5 to 40 $\mu$m. The charge-transporting material may include polycyclic aromatic compounds having in the main chain or side chain a structure such as biphenylene, anthracene, pyrene and phenanthrene; nitrogen-containing cyclic compounds such as indole, carbazole, oxadiazole and pyrazoline; hydrazone compounds; styryl compounds; and inorganic compounds such as selenium, selenium-tellurium, amorphous silicone and cadmium sulfide.

The binder resin in which the charge-transporting material is dispersed may include resins such as polycarbonate resin, polyester resin, polymethacrylate, polystyrene resin, acrylic resin and polyamide resin; and organic photoconductive polymers such as poly-N-vinyl carbazole and polyvinyl anthracene.

A protective layer may be provided as the surface layer. As resins for the protective layer, resins such as polyester, polycarbonate, acrylic resin, epoxy resin and phenol resin, or a product obtained by curing any of these resins with a curing agent, may be used. These resins may be used alone or may be used in combination of two or more kinds.

In the resin of the protective layer, conductive fine particles may be dispersed. As examples of the conductive fine particles, they may include fine particles of a metal or metal oxide. Preferably, they are fine particles of a material such as zinc oxide, titanium oxide, tin oxide, antimony oxide, indium oxide, bismuth oxide, tin oxide-coated titanium oxide, tin-coated indium oxide, antimony-coated tin oxide or zirconium oxide. These may be used alone or may be used in the form of a mixture of two or more kinds. In general, when the conductive fine particles are dispersed in the protective layer, the conductive fine particles may preferably have a particle diameter smaller than the wavelength of incident light in order to prevent the conductive fine particles from causing scattering of incident light. The conductive fine particles dispersed in the protective layer may preferably have particle diameters of 0.5 $\mu$m or smaller. Such particles in the protective layer may preferably be in a content of from 2 to 90% by weight, and more preferably from 5 to 80% by weight, based on the total weight of the protective layer. The protective layer may preferably have a layer thickness of from 0.1 to 10 $\mu$m, and more preferably from 1 to 7 $\mu$m.

The surface layer can be formed by coating a resin dispersion by spray coating, beam coating or dip coating.

In the case when one-component development is used in the present invention, in order to obtain a high image quality it is preferable to coat a magnetic toner on the toner carrying member in a layer thickness which is smaller than the closest distance between the toner carrying member and the electrostatic latent image bearing member (S-D gap) and to develop a latent image through the step of development carried out under application of an alternating electric field.

The toner carrying member used in the present invention may preferably be in the range of from 0.2 to 3.5 $\mu$m as JIS center-line average roughness (Ra). If Ra is smaller than 0.2 $\mu$m, the charge quantity on the toner carrying member tends to increase to tend to cause a lowering of developing performance. If Ra exceeds 3.5 $\mu$m, the toner coat layer on the toner carrying member tends to become uneven. The Ra may more preferably be in the range of from 0.5 to 3.0 $\mu$m.

In order for the magnetic toner of the present invention to have a high chargeability, the total charge quantity of the toner may preferably be controlled at the time of development. The surface of the toner carrying member may preferably be covered with a resin layer with conductive fine particles and/or lubricant dispersed therein.

The conductive fine particles contained in the resin layer that covers the surface of the toner carrying member may include fine particles of conductive metal oxides such as carbon black, graphite, conductive zinc oxide, and fine particles of metal double oxides. These may be used alone or in combination of two or more. As the resin in which the conductive fine particles are dispersed, resins such as phenol resins, epoxy resins, polyamide resins, polyester resins, polycarbonate resins, polyolefin resins, silicone resins, fluorine resins, styrene resins and acrylic resins may be used. In particular, thermosetting or photocurable resins are preferred.

The toner may be thickness-controlled by means of an elastic member which is a member that controls the layer thickness of toner on the toner carrying member and is brought into touch with the toner carrying member via the toner. This is especially preferable in view of uniform charging of the magnetic toner. In the present invention, in view of environmental protection, a charging member and a transfer member are brought into contact with the electrostatic latent image bearing member so that no ozone may be generated.

The image forming method of the present invention will be specifically described below with reference to FIG. 1.

In the apparatus system shown in FIG. 1, a developer having a cyan toner, a developer having a magenta toner, a developer having a yellow toner and a developer having a black toner are put into developing assemblies 4-1 , 4-2 , 4-3 ad 4-4, respectively. An electrostatic latent image formed on a photosensitive member 1 serving as the electrostatic latent image bearing member is developed by magnetic brush development, non-magnetic one-component development or magnetic jumping development to successively form toner images of respective colors on the photosensitive member 1. The photosensitive member 1 may be a photosensitive drum or photosensitive belt having a photoconductive insulating material layer formed of amorphous selenium, cadmium sulfide, zinc oxide, an organic photoconductor, or amorphous silicon. The photosensitive member 1 is rotated in the direction of an arrow by means of a drive mechanism (not shown). As the photosensitive member 1, a photosensitive member having an amorphous silicon photosensitive layer or organic photosensitive layer is preferably used.

The organic photosensitive layer may be of either a single-layer type in which the charge-generating material and the charge-transporting material are contained in the same layer, or a function-separated photosensitive layer formed of the charge transport layer and the charge generation layer. A multi-layer type photosensitive layer comprising the conductive support and superposingly formed thereon the charge generation layer and the charge transport layer in this order is one of preferred examples.

As binder resins for the organic photosensitive layer, polycarbonate resins, polyester resins or acrylic resins have a very good cleaning performance, and may hardly cause faulty cleaning and melt-adhesion of toner or filming to the photosensitive member.

In the present invention, the step of charging has a system making use of a corona charging assembly and being in non-contact with the photosensitive member 1 or a contact type system making use of a charging roller, a charging brush or a charging belt, and either system may be used. The contact charging system as shown in FIG. 1 is preferably used so as to enable efficient and uniform charging, simplify the system and make ozone less occur.

A charging roller 2 is basically comprised of a mandrel 2*b* at the center and a conductive elastic layer 2*a* that forms the periphery. The charging roller 2 is brought into contact with the surface of the photosensitive member 1 under a pressure, and is rotated in connection with the rotation of the photosensitive member 1.

When the charging roller 2 is used, preferable process conditions are as follows: Contact pressure of the charging roller 2 is 5 to 500 g/cm; and when an AC voltage is superimposed on a DC voltage, AC voltage is 0.5 to 5 kvpp, AC frequency is 50 to 5 kHz, and DC voltage is ±0.2 to ±5 kV.

As other charging means, a method making use of a charging blade and a method making use of a conductive brush are known in the art. These contact charging means have the advantages that no high voltage is required and ozone less occurs.

The charging roller or the charging blade, serving as the contact charging means, may preferably be made of conductive rubber, and a release coating may be provided on its surface. To form the release coating, it is possible to use nylon resins, polyvinylidene fluoride (PVDF), polyvinylidene chloride (PVDC), fluorine acrylic resins or the like.

Figure 8:
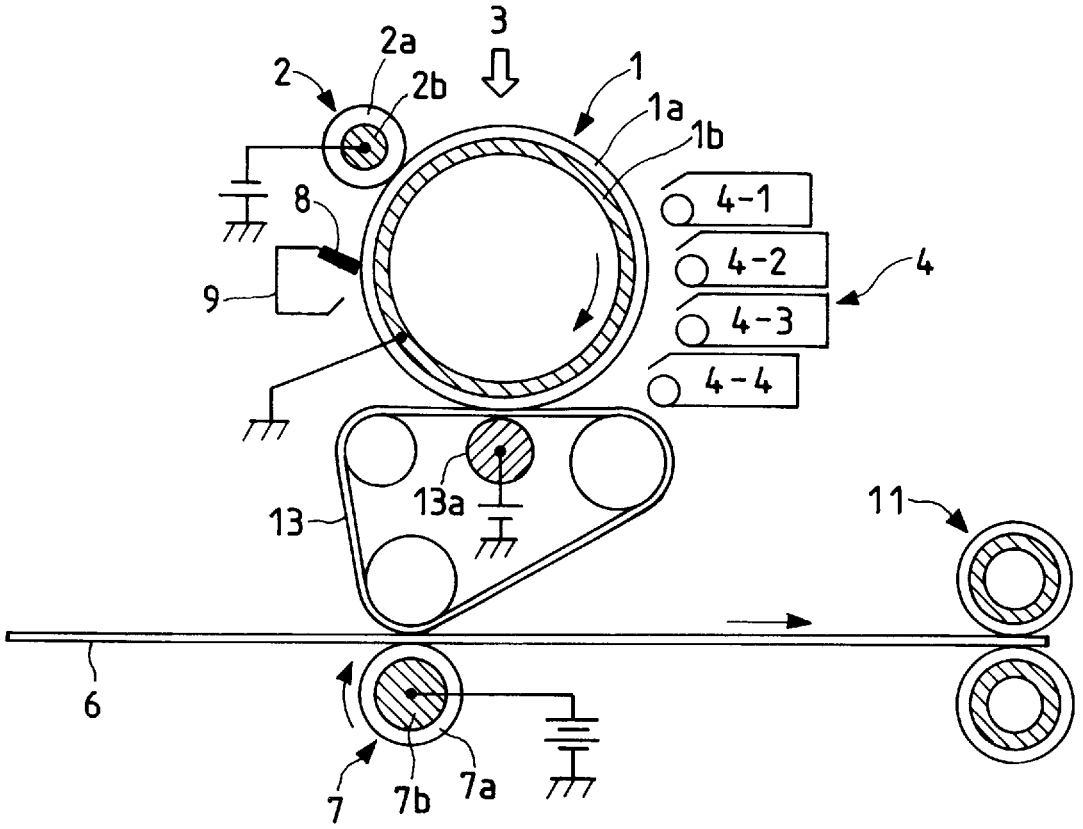
FIG. 8 is a schematic illustration of an example of a full-color image forming electrophotographic apparatus preferably used in the present invention, having an endless belt as the intermediate transfer member.

The toner image formed on the photosensitive member 1 is transferred to an intermediate transfer member 5 to which a voltage (e.g., ±0.1 to 5 kV) is applied. The intermediate transfer member may also be, as shown in FIG. 8, a belt-like intermediate transfer member having a transfer belt 13 and a bias applying means 13*a*. The intermediate transfer member 5 is comprised of a pipe-like conductive mandrel 5*b* and a medium-resistance elastic layer 5*a* that forms the periphery. The mandrel 5*b* may have a plastic surface provided thereon with a conductive layer (e.g., a conductive coating).

The medium-resistance elastic layer 5*a* is a solid or foamed-material layer made of an elastic material such as silicone rubber, Teflon rubber, chloroprene rubber, urethane rubber or an ethylene-propylene-diene terpolymer (EPDM) in which a conductivity-providing agent such as carbon black, zinc oxide, tin oxide or silicon carbide has been mixed and dispersed to adjust electrical resistance (volume resistivity) to a medium resistance of from $10^5$ to $10^{11}\Omega\cdot$CM.

The intermediate transfer member 5 is axially supported in parallel to the photosensitive member 1 so as to be provided in contact with the underside of the photosensitive member 1, and is counterclockwise rotated in the direction of an arrow at the same peripheral speed as that of the photosensitive member 1.

In the course where a first-color toner image formed on the surface of the photosensitive member 1 is passed through the transfer nip at which the photosensitive member 1 and the intermediate transfer member 5 come into contact, the toner image is transferred onto the intermediate transfer member 5 by the aid of an electric field formed at the transfer nip by a transfer bias applied to the intermediate transfer member 5.

Figure 7:
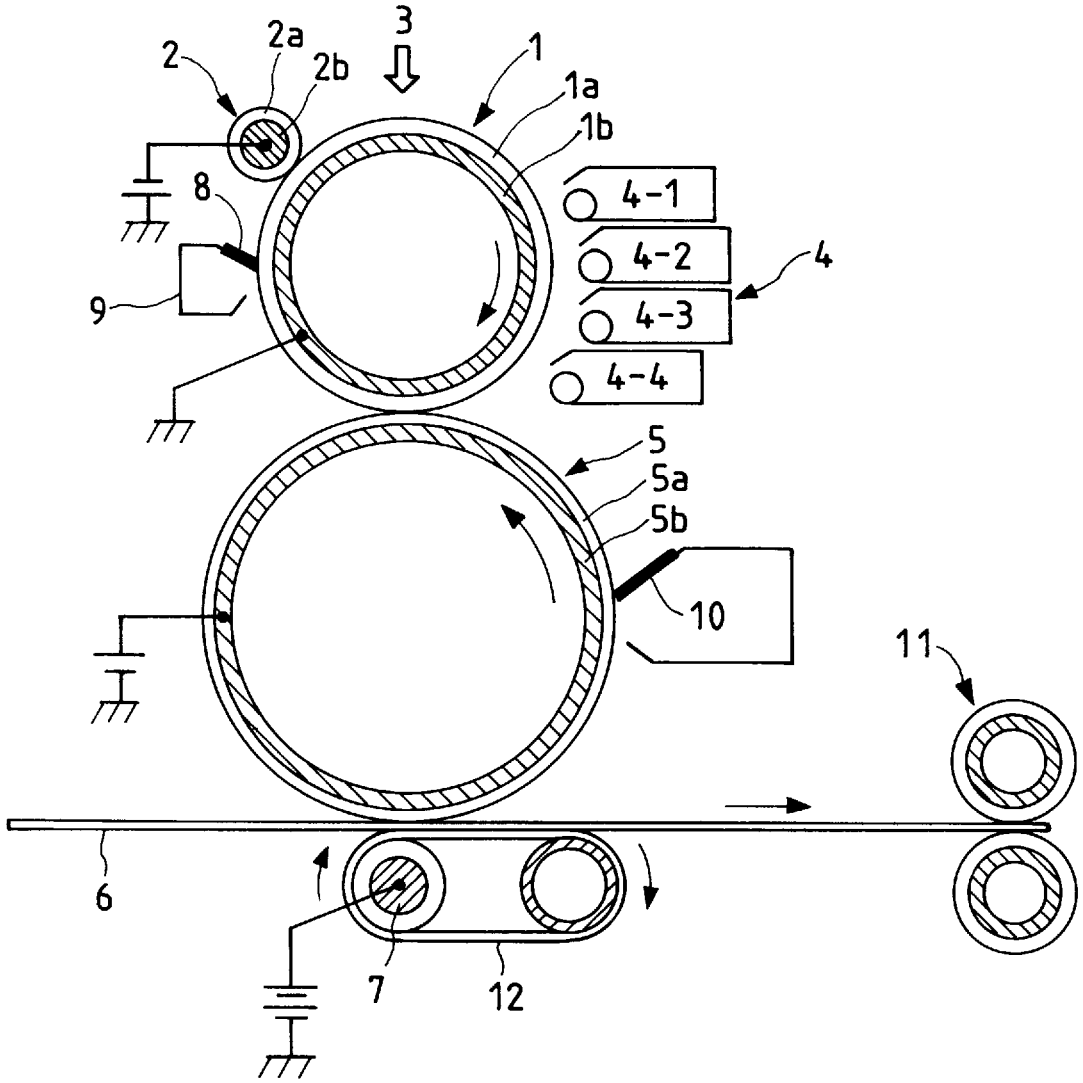
FIG. 7 is a schematic illustration of an example of a full-color image forming electrophotographic apparatus preferably used in the present invention, having a transfer belt as the transfer means of the secondary transfer step.

A transfer means is axially supported in parallel to the intermediate transfer member 5 so as to be provided in contact with the underside of the intermediate transfer member 5. The transfer means is, for example, a transfer roller 7, which is clockwise rotated in the direction of an arrow at the same peripheral speed as that of the intermediate transfer member 5. The transfer roller 7 may be provided in the manner that it comes in direct contact with the intermediate transfer member 5, or as shown in FIG. 7 in the manner that it comes in indirect contact with it via a transfer belt 12 provided between the intermediate transfer member 5 and the transfer roller 7.

The transfer roller 7 is basically comprised of a mandrel 7*b* at the center and a conductive elastic layer 7*a* that forms the periphery.

To form the intermediate transfer member and transfer means used in the present invention, materials commonly available can be used. In the present invention, the volume resistivity of the transfer means may be set smaller than the volume resistivity of the intermediate transfer member, whereby the voltage applied to the transfer means can be decreased. Thus, good toner images can be formed on the transfer medium and at the same time the transfer medium can be prevented from winding around the intermediate transfer member. In particular, what is preferred is that the elastic layer of the intermediate transfer member has a volume resistivity at least 10 times higher than the elastic layer of the transfer means.

Hardness of the intermediate transfer member and transfer means is measured according to JIS K-6301. The intermediate transfer member used in the present invention may preferably be formed of an elastic layer having a hardness in the range of from 10 to 40 degrees. As for the elastic layer of the transfer means, it may preferably have a hardness greater than the hardness of the electric layer of the intermediate transfer member and has the value of from 41 to 80 degrees so that the transfer means can be pressed against the intermediate transfer member so as to form a concave nip on the side of the intermediate transfer member. This is preferable in order to prevent the transfer medium from winding around the intermediate transfer member. If inversely the hardness is greater in the intermediate transfer member than in the transfer means, a concave is formed on the side of the transfer means, so that the transfer medium tends to wind around the intermediate transfer member.

The transfer roller 7 is rotated at a peripheral speed equal to, or different from, the peripheral speed of the intermediate transfer member 5. The transfer medium 6 is transported to the part between the intermediate transfer member 5 and the transfer roller 7, and at the same time a bias with a polarity reverse to that of triboelectric charges possessed by the toner is applied to the transfer roller 7 from a transfer bias applying means, so that the toner images on the intermediate transfer member 5 is transferred to the surface of the transfer medium 6.

The transfer roller 7 may also be made of the same material as the charging roller. Preferable process conditions are as follows: Contact pressure of the transfer roller 7 is 2.94 to 490 N/m (3 to 500 g/cm), and more preferably 19.6 N/m to 294 N/m, and DC voltage is ±0.2 to ±10 kV.

When the linear pressure as the contact pressure is 2.94 to 490 N/m, transport aberration of transfer mediums and faulty transfer may hardly occur.

The conductive elastic layer 7*a* of the transfer roller 7 is a solid or foamed-material layer made of an elastic material such as polyurethane rubber or EPDM in which a conductivity-providing agent such as carbon black, zinc oxide, tin oxide or silicon carbide has been mixed and dispersed to adjust electrical resistance (volume resistivity) to a medium resistance of from $10^6$ to $10^{10}$ Ω·CM.

Next, the transfer medium 6 is transported to a fixing assembly 11 basically comprised of a heating roller internally provided with a heating element such as a halogen heater and an elastic body pressure roller brought into contact with the heating roller under a pressure, and is passed between the heating roller and the pressure roller, where the toner images are fixed by heat-and-pressure. Another method may also be used in which the toner images are fixed by a heater through a film.

The present invention will be specifically described below by giving production examples and working examples, which, however, by no means limit the present invention.

An electrophotographic apparatus used in Examples of the present invention will be described in detail.

FIG. 1 cross-sectionally illustrates an electrophotographic apparatus used in Example 1. The photosensitive member 1 comprises a substrate 1*a* and provided thereon a photosensitive layer 1*b* having an organic photo-semiconductor, and is rotated in the direction of an arrow. By means of the charging roller 2 (the conductive elastic layer 2*a* and the mandrel 2*b*), the surface of the photosensitive member 1 is electrostatically charged to have a surface potential of about −600 V is formed. Exposure is carried out using a polygon mirror by on-off control on the photosensitive member 1 in accordance with digital image information, whereby an electrostatic latent image with an exposed-area potential of −100 V and a dark-area potential of −600 V. Using a plurality of developing assemblies 4-1, 4-2, 4-3 and 4-4, the magenta toner, cyan toner, yellow toner or black toner are respectively imparted to the surface of the photosensitive member 1 to form toner images by reverse development. The toner images are transferred to the intermediate transfer member 5 (the elastic layer 5*a*, the mandrel 5*b* as a support) for each color to form four color, color-superimposed developed images on the intermediate transfer member 5. The toner remaining on the photosensitive member 1 after transfer is collected in a residual toner container 9 by means of a cleaning member 8.

When toners having a high transfer efficiency are used, a system having a simple bias roller or having no cleaning member may be used.

The intermediate transfer member 5 is comprised of the pipe-like mandrel 5*b* and the elastic layer 5*a* provided thereon by coating, formed of nitrile-butadiene rubber (NBR) in which carbon black conductivity-providing agent has been well dispersed. The coat layer thus formed has a hardness according to JIS K-6301, of 30 degrees and a volume resistivity $10^9$ Ω·cm. Transfer electric current necessary for the transfer from the photosensitive member 1 to the intermediate transfer member 5 is about 5 μA, which can be obtained by applying a voltage of +2,000 V to the mandrel 5*b* from a power source. After the toner images have been transferred from the intermediate transfer member 5 to the transfer medium 6, the surface of the intermediate transfer member may be cleaned by means of a cleaning member 10.

The transfer roller 7 is formed by coating on a mandrel 7*b* of 20 mm diameter, a foamable material of EPDM in which carbon black conductivity-providing agent has been well dispersed. A transfer roller whose elastic layer 7*a* shows a volume resistivity of $10^6$ Ω·cm and a hardness according to JIS K-6301, of 35 degrees is used. A voltage is applied to the transfer roller to flow a transfer current of 15 μA. With regard to the toner remaining as a contaminant on the transfer roller 7 when the toner images are one-time transferred from the intermediate transfer member 6 to the transfer medium 5, it is common to use a fur brush cleaner as a cleaning member or to use a cleanerless system. Since in the present invention the toner has the shape factors of 110<SF-1≦180 (preferably 120≦SF-1≦160) and 110<SF-2≦140, (preferably 115≦SF-2≦140) to ensure a high transfer efficiency, the cleanerless system can be employed.

In the present invention, the developing assemblies 4-1, 4-2, 4-3 and 4-4 may be developing assemblies for two-component magnetic brush development or developing assemblies for non-magnetic one-component development. When a magnetic one-component jumping development system making use of a magnetic tone is used, the black developing assembly 4-4 constituted as shown in FIG. 2 may be used as the developing assembly for black color.

Figure 2:
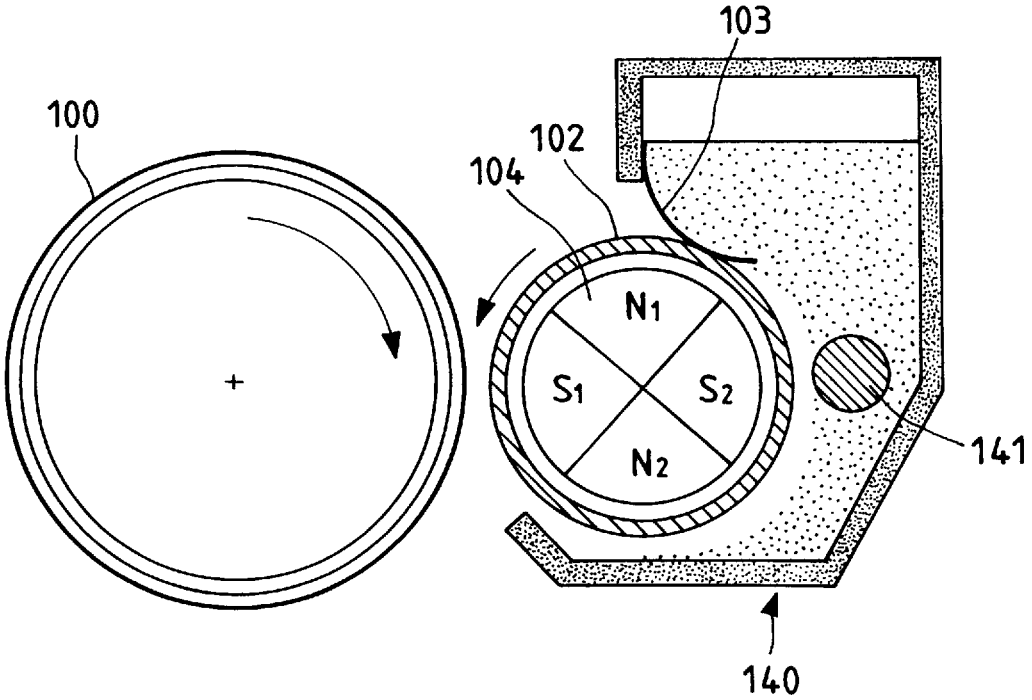
FIG. 2 is a schematic illustration of an example of a black-color developing assembly used for one-component magnetic development.

In FIG. 2, the electrostatic latent image formed on a photosensitive member 100 is developed by a one-component magnetic toner, using a developing assembly 140 having an agitator 141. As shown in FIG. 2, the developing assembly 140 is provided, in proximity to the photosensitive drum 100, with a cylindrical toner carrying member 102 (hereinafter "developing sleeve") made of a non-magnetic material such as aluminum or stainless steel. The gap between the photosensitive drum 100 and the developing sleeve 102 is set at about 300 μm by the aid of a sleeve-to-drum gap holding member or the like (not shown). The developing sleeve 102 is internally provided with a magnet roller 104, which is secured concentrically with the developing sleeve 102. The developing sleeve 102 is set rotatable. The magnet roller 104 has a plurality of magnetic poles as shown in the drawing. Magnetic pole S1 participates in development; N1, control of magnetic toner coating (layer thickness); S2, intake and transport of the magnetic toner; and N2, prevention of the magnetic toner from spouting. As a member to control the coat quantity of the magnetic toner transported while adhering to the developing sleeve 102, a resilient blade 103 is provided so that the coat quantity of the magnetic toner transported to the development zone is controlled to provide a layer thickness smaller than the gap between the developing sleeve and the photosensitive drum (S-D gap), according to the pressure under which the resilient blade 103 is brought in touch with the developing sleeve 102. In the developing zone, DC and AC development biases are applied to the developing sleeve 102, and the magnetic toner on the developing sleeve 102 is caused to fly onto the photosensitive drum 100 in conformity with the electrostatic latent image to form the toner image.

TONER PRODUCTION EXAMPLE 1

| | |
|---|---|
| Magnetic material (magnetic iron oxide powder; average particle diameter: 0.22 μm) | 100 parts |
| Binder resin (styrene/butyl acrylate/butylmaleic acid half ester copolymer; low-molecular weight side peak: about 5,000; glass transition point Tg: 58° C.) | 100 parts |
| Negative charge control agent (iron complex of monoazo dye) | 2 parts |
| Release agent (low-molecular weight polyolefin) | 2 parts (all by weight) |

The above materials were mixed using a blender, and then melt-kneaded using a twin-screw extruder heated to 130° C. The kneaded product obtained was cooled, and then crushed with a hammer mill. The crushed product was finely pulverized by means of a jet mill, and the finely pulverized product obtained was strictly classified using a multi-division classifier utilizing the Coanda effect, to obtain magnetic toner particles. The magnetic toner particles obtained were surface-treated by thermomechanical impact force (treatment temperature: 60° C.). To 100 parts by weight of the magnetic toner particles thus obtained, 1.8 parts by weight of dry-process silica with a primary particle diameter of 12 nm made hydrophobic by treatment with silicone oil and hexamethyldisilazane (BET specific surface area after treatment: 120 $m^2/g$) and 0.5 part by weight of spherical silica (BET specific surface area: 20 $m^2/g$; primary particle diameter: 0.1 μm) were added as the inorganic fine powder, which were then mixed by means of a mixing machine to obtain magnetic toner A.

The magnetic toner A obtained had a weight average particle diameter of 6.5 μm, a number average particle diameter of 5.3 μm, SF-1 of 141, SF-2 of 125, and a BET specific surface area of 5.3 $m^2/cm^3$. The BET specific surface area of the magnetic toner particles was 1.7 $m^2/cm^3$.

Physical properties of the magnetic toner A thus obtained are shown in Table 1. The average particle diameter of the magnetic toner was measured using Coulter Counter Multisizer (manufactured by Coulter Electronics, Inc.).

TONER PRODUCTION EXAMPLE 2

To 100 parts by weight of the magnetic toner particles as obtained in Toner Production Example 1, 1.3 parts by weight of dry-process silica with a primary particle diameter of 12 nm made hydrophobic by treatment with hexamethyldisilazane (BET specific surface area: 160 $m^2/g$) was added, which were then mixed by means of a mixing machine to obtain a magnetic toner B.

Physical properties of the magnetic toner B thus obtained are shown in Table 1.

TONER PRODUCTION EXAMPLE 3

| | |
|---|---|
| Magnetic material (magnetic iron oxide powder; average particle diameter: 0.22 μm) | 90 parts |
| Binder resin (styrene/butyl acrylate/butylmaleic acid half ester copolymer; low-molecular weight side peak: about 10,000; glass transition point Tg: 62° C.) | 100 parts |
| Negative charge control agent (iron complex of monoazo dye) | 2 parts |
| Release agent (low-molecular weight polyolefin) | 2 parts (all by weight) |

A magnetic toner C with a weight average particle diameter of 7.0 μm was obtained in the same manner as in Toner Production Example 1 except that the above materials were used, the surface treatment of the magnetic toner particles by thermomechanical impact force was made at a temperature of 64° C., and the dry-process silica with a primary particle diameter of 20 nm made hydrophobic with silicone oil was used as the inorganic fine powder in an amount of 1.8 parts by weight.

Physical properties of the magnetic toner C thus obtained are shown in Table 1.

TONER PRODUCTION EXAMPLE 4

A magnetic toner D was obtained in the same manner as in Toner Production Example 1 except that 1.8 parts by weight of dry-process silica with a primary particle diameter of 12 nm made hydrophobic by treatment with silicone oil and hexamethyldisilazane (BET specific surface area: 120 $m^2/g$) and 0.5 part by weight of spherical silica (BET specific surface area: 5 $m^2/g$; primary particle diameter: 1 μm) were used as the inorganic fine powder.

Physical properties of the magnetic toner D thus obtained are shown in Table 1.

TONER PRODUCTION EXAMPLES 5 AND 6

Magnetic toners E and F were obtained in the same manner as in Toner Production Example 1 except that fine titanium oxide particles with a primary particle diameter of 20 nm made hydrophobic with silicone oil (BET specific surface area: 100 $m^2/g$) and fine alumina particles with a primary particle diameter of 20 nm (BET specific surface area: 90 $m^2/g$) were Each used in an amount of 1.5 parts by weight as the inorganic fine powder.

Physical properties of the magnetic toners E and F thus obtained are shown in Table 1.

TONER PRODUCTION EXAMPLE 7

(Comparative Production Example)

A magnetic toner G was obtained in the same manner as in Toner Production Example 1 except that the surface treatment by thermomechanical impact force was not made.

Physical properties of the magnetic toner G thus obtained are shown in Table 1.

TONER PRODUCTION EXAMPLE 8

| | |
|---|---|
| Magnetic material (magnetic iron oxide powder; average particle diameter: 0.24 μm) | 110 parts |
| Binder resin (polyester resin; low-molecular weight side peak: about 7,000; glass transition point Tg: 63° C.) | 100 parts |

-continued

| | |
|---|---|
| Negative charge control agent (chromium complex of monoazo dye) | 2 parts |
| Release agent (low-molecular weight polyolefin) | 2 parts |
| | (all by weight) |

A magnetic toner H with a weight average particle diameter of 6.7 μm was obtained in the same manner as in Toner Production Example 1 except that the above materials were used and the surface treatment of the magnetic toner particles by thermomechanical impact force was made at a temperature of 64° C.

Physical properties of the magnetic toner H thus obtained are shown in Table 1.

TONER PRODUCTION EXAMPLE 9

| (Comparative Production Example) | |
|---|---|
| Magnetic material (magnetic iron oxide powder; average particle diameter: 0.22 μm) | 60 parts |
| Binder resin (styrene/butyl acrylate copolymer; low-molecular weight side peak: about 18,000; glass transition point Tg: 71° C.) | 100 parts |
| Negative charge control agent (iron complex of monoazo dye) | 2 parts |
| Release agent (low-molecular weight polyolefin) | 2 parts |
| | (all by weight) |

The above materials were mixed using a blender, and then melt-kneaded using a twin-screw extruder heated to 130° C. The kneaded product obtained was cooled, and then crushed with a hammer mill. The crushed product was finely pulverized by means of a jet mill, and the finely pulverized product obtained was strictly classified using a multi-division classifier utilizing the Coanda effect, to obtain magnetic toner particles. To 100 parts by weight of the magnetic toner particles thus obtained, 0.4 part by weight of dry-process silica with a primary particle diameter of 16 nm made hydrophobic by treatment with hexamethyldisilazane (BET specific surface area after treatment: 100 $m^2/g$) was added as the inorganic fine powder, which were then mixed by means of a mixing machine to obtain magnetic toner I. The magnetic toner I obtained had a weight average particle diameter of 12 μm.

Physical properties of the magnetic toner I thus obtained are shown in Table 1.

TONER PRODUCTION EXAMPLE 10

(Comparative Production Example)

A magnetic toner J was obtained in the same manner as in Toner Production Example 1 except that the inorganic fine powder was not externally added to the magnetic toner particles.

Physical properties of the magnetic toner J thus obtained are shown in Table 1.

TONER PRODUCTION EXAMPLES 11 TO 14

(Production Examples of Non-magnetic Toners)

Into a four-necked flask having a high-speed stirrer TK-type homomixer, 710 parts by weight of ion-exchanged water and 450 parts by weight of an aqueous 0.1 mol/liter $Na_3PO_4$ solution were introduced, and the mixture was heated to 65° C., followed by stirring at number of revolutions adjusted to 12,000 rpm. Then, 68 parts by weight of an aqueous 1.0 mol/liter $CaCl_2$ solution was added thereto little by little to prepare an aqueous dispersion medium containing fine-particle slightly water-soluble dispersion stabilizer $Ca_3(P0_4)_2$.

| | |
|---|---|
| Styrene monomers | 165 parts |
| n-Butyl acrylate monomers | 35 parts |
| Divinylbenzene monomers | 0.5 part |
| Cyan colorant (C.I. Pigment Blue 15:3) | 14 parts |
| Saturated polyester resin (terephthalic acid/propylene oxide modified bisphenol A; acid value: 15 mg KOH/g) | 10 parts |
| Negative charge control agent (dialkylsalicylic acid metal compound) | 2 parts |
| Release agent (ester wax) | 40 parts |
| | (all by weight) |

The above materials were dispersed for 3 hours by means of an attritor, and thereafter 10 parts by weight of a polymerization initiator 2,2'-azobis(2,4-dimethylvaleronitrile) was added to obtain a polymerizable monomer composition. The monomer composition obtained was introduced into the aqueous dispersion medium to carry out granulation for 15 minutes while maintaining the number of revolution at 12,000 rpm. Thereafter, the high-speed stirrer was changed for a stirrer having propeller stirring blades, the internal temperature was raised to 80° C., and the polymerization was continued for 10 hours at 50 rpm. After the polymerization was completed, the slurry was cooled, and diluted hydrochloric acid was added to remove the dispersion stabilizer.

The slurry thus treated was further washed and then dried to obtain a non-magnetic negatively chargeable cyan toner particles having a weight average particle diameter of 6.2 μm, SF-1 of 107 and SF-2 of 115. To 100 parts by weight of the cyan toner particles thus obtained, 2.0 parts by weight of fine titanium oxide particles with a primary particle diameter of 20 nm made hydrophobic with silicone oil (BET specific surface area: 100 $m^2/g$) was externally added to obtain a cyan toner K, having a good fluidity.

With regard to other yellow toner, magenta toner and black toner, the above procedure was repeated except for replacing the colorant with C.I. Pigment Yellow 17, C.I. Pigment Red 202 and graft carbon black, respectively. Thus, the respective color toners (yellow toner L, magenta toner M and black toner N) were obtained. These toners of four colors were each blended with a silicone resin-coated magnetic ferrite carrier having an average particle diameter of about 50 μm, in a weight ratio of 6:94, to produce two-component developers of the respective colors, used for magnetic brush development.

Physical properties of the respective color toners are shown in Table 1.

TONER PRODUCTION EXAMPLES 15 TO 18

| (Production Examples of Non-magnetic Toners) | |
|---|---|
| Binder resin (polyester resin; low-molecular weight side peak: about 6,000; glass transition point Tg: 55° C.) | 100 parts |
| Colorant (C.I. Pigment Blue 15:3) | 7 parts |
| Negative charge control agent (dialkylsalicylic acid metal compound) | 2 parts |
| | (all by weight) |

The above materials were thoroughly melt-kneaded using an extruder. The kneaded product obtained was cooled, and then crushed by a mechanical means. The crushed product was finely pulverized by causing it to collide against an impact plate by the use of jet streams, and the finely pulverized product was classified using an air classifier utilizing the Coanda effect, to obtain a non-magnetic negatively chargeable cyan toner particles by pulverization, having a weight average particle diameter of 7.9 μm, SF-1 of 170 and SF-2 of 157. To 100 parts by weight of the cyan toner particles thus obtained, 2 parts by weight of fine titanium oxide particles with a primary particle diameter of 20 nm made hydrophobic with isobutyltrimethoxysilane (BET specific surface area: 100 $m^2/g$) was externally added to obtain a cyan toner O, having a good fluidity.

With regard to other yellow toner, magenta toner and black toner, the above procedure was repeated except for replacing the colorant with C.I. Pigment Yellow 17, C.I. Pigment Red 202 and graft carbon black, respectively. Thus, a yellow toner P, a magenta toner Q and a black toner R, produced by pulverization, were obtained. These toners of four colors were each blended with a silicone resin-coated magnetic ferrite carrier having an average particle diameter of about 50 μm, in a weight ratio of 5:95 to produce two-component developers of the respective colors, used for magnetic brush development.

Physical properties of the toners of the respective colors are shown in Table 1.

TONER PRODUCTION EXAMPLES 19 TO 22

(Production Examples of Non-magnetic Toners)

The toner particles of the respective colors as obtained in Toner Production Examples 15 to 18 were surface-treated by thermomechanical impact force (treatment temperature: 60° C.). Thereafter, to 100 parts by weight of the toner particles thus treated, 2 parts by weight of fine titanium oxide particles with a primary particle diameter of 20 nm made hydrophobic with isobutyltrimethoxysilane and silicone oil (BET specific surface area: 100 $m^2/g$) was externally added to obtain a cyan toner S, a yellow toner T, a magenta toner U and a black toner V. These toners of four colors were each blended with a silicone resin-coated magnetic ferrite carrier having an average particle diameter of about 50 μm, in a weight ratio of 5:95 to produce two-component developers of the respective colors, used for magnetic brush development.

Physical properties of the toners of the respective colors are shown in Table 1.

TONER PRODUCTION EXAMPLE 23

A magnetic toner W was obtained in the same manner as in TONER PRODUCTION Example 1 except that 1.8 parts by weight of dry-process silica with a primary particle diameter of 12 nm made hydrophobic by treatment with silicone oil and hexamethyldisilazane (BET specific surface area after treatment: 120 $m^2/g$) and 0.5 part by weight of dry-process silica with a primary particle diameter of 40 nm treated with hexamethyldisilazane (BET specific surface area after treatment: 40 $m^2/g$) were used as the inorganic fine powder.

Physical properties of the magnetic toner W thus obtained are shown in Table 1 [Table 1(A)–1(B)].

TABLE 1(A)

| | Shape factors | | |
|---|---|---|---|
| | SF-1 | SF-2 | B/A ratio |
| Toner A (magnetic) | 141 | 125 | 0.61 |
| Toner B (magnetic) | 141 | 125 | 0.61 |
| Toner C (magnetic) | 140 | 130 | 0.75 |
| Toner D (magnetic) | 141 | 125 | 0.61 |
| Toner E (magnetic) | 141 | 125 | 0.61 |
| Toner F (magnetic) | 141 | 125 | 0.61 |
| Toner G (magnetic, comparative) | 156 | 151 | 0.91 |
| Toner H (magnetic) | 145 | 135 | 0.78 |
| Toner I (magnetic, comparative) | 154 | 150 | 0.93 |
| Toner J (magnetic, comparative) | 141 | 125 | 0.61 |
| Toner K (non-magnetic cyan) | 107 | 115 | 2.14 |
| Toner L (non-magnetic yellow) | 109 | 113 | 1.44 |
| Toner M (non-magnetic magenta) | 107 | 115 | 2.14 |
| Toner N (non-magnetic black) | 108 | 115 | 1.88 |
| Toner O (non-magnetic cyan) | 170 | 157 | 0.81 |
| Toner P (non-magnetic yellow) | 170 | 157 | 0.81 |
| Toner Q (non-magnetic magenta) | 170 | 157 | 0.81 |
| Toner R (non-magnetic black) | 170 | 157 | 0.81 |
| Toner S (non-magnetic cyan) | 160 | 139 | 0.65 |
| Toner T (non-magnetic yellow) | 160 | 139 | 0.65 |
| Toner U (non-magnetic magenta) | 160 | 139 | 0.65 |
| Toner V (non-magnetic black) | 160 | 139 | 0.65 |
| Toner W (magnetic) | 141 | 125 | 0.61 |

TABLE 1(B)

U/V: unit volume

| | Physical properties | | | | | | | | | |
|---|---|---|---|---|---|---|---|---|---|---|
| | Toner | | | | | | | | Toner particles | |
| | BET specific surface area per U/V Sb ($m^2/cm^3$) | Weight average particle diam. D4 (μm) | Density ($g/cm^3$) | Theoretical specific surface are per U/V St ($m^2/cm^3$) | Sb/St | Glass transition point (°C.) | Low = molecular weight peak | Charge quantity per U/V ($C/m^3$) | BET specif. surface ara per U/V ($m^2/cm^3$) | 60% Average pore radius (nm) |
| Toner A | 5.3 | 6.5 | 1.70 | 0.92 | 5.7 | 57 | 5,000 | −60 | 1.70 | 2.1 |
| Toner B | 5.2 | 6.5 | 1.70 | 0.92 | 5.6 | 57 | 5,000 | −48 | 1.70 | 2.1 |
| Toner C | 4.7 | 7.0 | 1.65 | 0.86 | 5.5 | 61 | 10,000 | −58 | 1.55 | 2.5 |
| Toner D | 5.4 | 6.5 | 1.70 | 0.92 | 5.9 | 57 | 5,000 | −62 | 1.70 | 2.1 |
| Toner E | 4.2 | 6.5 | 1.70 | 0.92 | 4.6 | 57 | 5,000 | −37 | 1.70 | 2.1 |
| Toner F | 3.8 | 6.5 | 1.70 | 0.92 | 4.1 | 57 | 5,000 | −34 | 1.70 | 2.1 |
| Toner G | 6.5 | 6.6 | 1.70 | 0.91 | 7.2 | 57 | 5,000 | −47 | 2.45 | 4.2 |

TABLE 1(B)-continued

| | U/V: unit volume | | | | | | | | | |
|---|---|---|---|---|---|---|---|---|---|---|
| | Physical properties | | | | | | | | | |
| | Toner | | | | | | | | Toner particles | |
| | BET specific surface area per U/V Sb ($m^2/cm^3$) | Weight average particle diam. D4 ($\mu m$) | Density ($g/cm^3$) | Theoretical specific surface are per U/V St ($m^2/cm^3$) | Sb/St | Glass transition point (°C.) | Low = molecular weight peak | Charge quantity per U/V ($C/m^3$) | BET specif. surface ara per U/V ($m^2/cm^3$) | 60% Average pore radius (nm) |
| Toner H | 5.7 | 6.7 | 1.75 | 0.90 | 6.4 | 63 | 7,000 | −65 | 1.90 | 3.0 |
| Toner I | 1.6 | 12.0 | 1.45 | 0.50 | 3.2 | 71 | 18,000 | −50 | 1.10 | 4.5 |
| Toner J | 1.7 | 6.5 | 1.70 | 0.92 | 1.8 | 57 | 5,000 | −25 | 1.70 | 2.1 |
| Toner K | 3.3 | 6.2 | 1.05 | 0.97 | 3.4 | 55 | 21,000 | −45 | 1.15 | 3.0 |
| Toner L | 3.3 | 6.2 | 1.05 | 0.97 | 3.4 | 55 | 21,000 | −45 | 1.15 | 3.0 |
| Toner M | 3.3 | 6.2 | 1.05 | 0.97 | 3.4 | 55 | 21,000 | −46 | 1.15 | 3.0 |
| Toner N | 3.3 | 6.2 | 1.05 | 0.97 | 3.4 | 55 | 21,000 | −43 | 1.15 | 3.0 |
| Toner O | 4.2 | 7.9 | 1.05 | 0.76 | 5.5 | 54 | 6,000 | −52 | 2.60 | 3.7 |
| Toner P | 4.2 | 7.9 | 1.05 | 0.76 | 5.5 | 54 | 6,000 | −53 | 2.60 | 3.7 |
| Toner Q | 4.2 | 7.9 | 1.05 | 0.76 | 5.5 | 54 | 6,000 | −55 | 2.60 | 3.7 |
| Toner R | 4.2 | 7.9 | 1.05 | 0.76 | 5.5 | 54 | 6,000 | −50 | 2.60 | 3.7 |
| Toner S | 3.7 | 7.8 | 1.05 | 0.77 | 4.8 | 54 | 6,000 | −55 | 1.80 | 3.2 |
| Toner T | 3.7 | 7.8 | 1.05 | 0.77 | 4.8 | 54 | 6,000 | −55 | 1.80 | 3.2 |
| Toner U | 3.7 | 7.8 | 1.05 | 0.77 | 4.8 | 54 | 6,000 | −57 | 1.80 | 3.2 |
| Toner V | 3.7 | 7.8 | 1.05 | 0.77 | 4.8 | 54 | 6,000 | −52 | 1.80 | 3.2 |
| Toner W | 5.5 | 6.5 | 1.70 | 0.92 | 6.0 | 57 | 5,000 | −62 | 1.70 | 2.1 |

PHOTOSENSITIVE MEMBER PRODUCTION EXAMPLE 1

Figure 3:
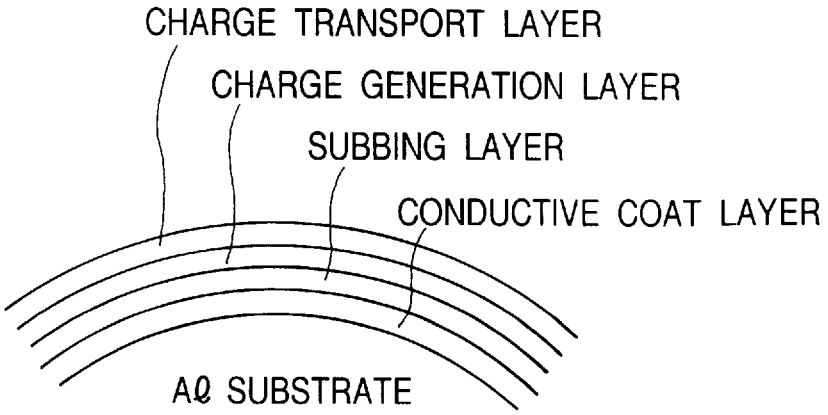
FIG. 3 is a schematic illustration of an example of the constitution of a photosensitive member preferably used in the present invention.

To produce a photosensitive member, an aluminum cylimder of 62 mm diameter was used as substrate. On this substrate, the layer with the configuration as shown in FIG. 3 and the following were successively superposingly formed by dip coating to produce the photosensitive member.

(1) Conductive coat layer: Mainly formed of phenol resin with tin oxide powder and titanium oxide powder dispersed therin. The layer was in a thickness of 15 $\mu$m.

(2) Subbing layer: Mainly formed of modified nylon and copolymer nylon. The layer was in a thickness of 0.6 $\mu$m.

(3) Charge generastion layer: Mainly formed of butyral resin with an azo pigment dispersed therein, the azo pigment having an absorption in the region of long wavelength. The layer was in a thickness of 0.6 $\mu$m.

(4) Charge transport layer: Mainly formed of polycarbonate resin (molecular weight as measured by Ostwald viscometry: 20,000) with a hole-transporting triphenylamine compound dissolved therein a weight ratio of 8:10, followed by further addition of polytetrafluoroethylene powder (average particle diameter: 0.2 $\mu$m) in an amount of 10% by weight based on the total weight of solid contents and then uniform dispersion. The layer was in a thickness of 25 $\mu$m, and had a contact angle to water, of 95 degrees.

The contact angle was measured using pure water, and using as a measuring device a contact angle meter Model CA-DS, manufactured by Kyowa Kaimen Kagaku K.K.

PHOTOSENSITIVE MEMBER PRPDUCTION EXAMPLE 2

The procedure of Photosensitive Member Production Example 1 was repeated to produce a photosensitive member, except that the polytetrafluoroethylene powder was not added. The contact angle to water was 74 degrees.

PHOTOSENSITIVE MEMBER PRODUCTION EXAMPLE 3

To produced a photosensitive member, the procedure of Photosensitive Member Production Example 1 was repeated up to the formation of the charge generation layer. The charge transport layer was formed using a solution prepared by dissolving the hole-transporting triphenylamine compound in the polycarbonate resin in a weight ratio of 10:10, and in a layer thickness of 20 $\mu$m. To further form a protective layer thereon, a composition prepared by dissolving the like materials in a weight ratio of 5:10, followed by addition of polytetrafluoroethylene powder (average particle diameter: 0.2 $\mu$m) in an amount of 30% by weight based on the total weight of solid contents and then uniform dispersion, was spray coated on the charge transport layer. The layer was in a thickness of 5 $\mu$m, and had a contact angle to water, of 102 degrees.

Example 1

Using as the primary charging roller a rubber roller (diameter: 12 mm; contact pressure: 50 g/cm) with conductive carbon dispersed therein, its carbon particles having been coated with nylon resin, and also using as the electrostatic latent image bearing member the OPC (organic photoconductor) photosensitive drum as produced in Photosensitive Member Production Example 3, digital latent images were formed by laser exposure (600 dpi) to provide a dark portion potential $V_D$ of −600 V and a light portion potential $V_L$ of −100 V. As the developing assembly for black color, the developing assembly made up as shown in FIG. 2 was used at the position of the developing assembly 4-4 shown in FIG. 1. As the black toner carrying member, a developing sleeve comprising a stainless steel cylinder of 16 mm diameter with a blast-finished surface and formed thereon a resin layer having the following composition and having a layer thickness of about 7 $\mu$m and a JIS center-line average roughness (Ra) of 2.2 $\mu$m was used as the black-toner carrying member.

| Resin layer composition: | |
|---|---|
| Phenol resin | 100 parts |
| Graphite (particle diameter: about 7 μm) | 90 parts |
| Carbon black | 10 parts |
| | (all by weight) |

Then, the gap between the OPC photosensitive drum and the developing sleeve of the developing assembly 4-4 (S-D gap) was set to be 300 μm, and development magnetic pole, 80 mT (800 gausses). As the toner coat control member, a urethane rubber blade of 1.0 mm thick and 10 mm in free length was brought into touch with the surface of the developing sleeve at a linear pressure of 14.7 N/m (15 g/cm). As development bias, DC bias component Vdc of −450 V and superimposing AC bias component Vpp of 1,200 V and f=2,000 Hz were applied to the developing sleeve.

As the cleaning blade of the OPC photosensitive drum, a urethane rubber blade of 2.0 mm thick and 8 mm in free length was brought into touch with the surface of the photosensitive drum at a linear pressure of 24.5 N/m (25 g/cm). The process speed was set at 94 mm/sec. The developing sleeve was rotated in the regular direction, setting the ratio of its peripheral speed Vt to the peripheral speed V of the photosensitive drum, Vt/V, to 1.5. As the black toner, the magnetic toner A of Toner Prodduction Example 1 was used.

Using as the magenta toner, cyan toner and yellow toner the toners S, T and U of Toner Production Examples 19 to 21, respectively, two-component developers were prepared. These developers were respectively put into the developing assemblies 4-1, 4-2 and 4-3 shown in FIG. 1. Toner images of the respective colors were formed in an environment of 23° C./65%RH by magnetic brush development carried out by reverse development under the image forming conditions as described above. The toner images of the respective colors were successively transferred from the OPC photosensitive drum 1 to the intermediate transfer member 5 coming into pressure contact with the OPC photosensitive drum. The four-color toner images on the intermediate transfer member 5 were transferred to a transfer medium (plain paper) of 75 g/m$^2$ basis weight while pressing the transfer roller 7 to the intermediate transfer member 5, under application of a voltage to the transfer roller 7 so as to cause a transfer current of +6 μA to flow to the drum. Subsequently, the four-color toner images on the transfer medium were thermally fixed by the heat-and-pressure fixing means 11 to form a full-color image.

Here, the transfer efficiency of the toners of the respective colors transferred from the OPC photosensitive drum 1 to the intermediate transfer member 5 was 95 to 98%, and the transfer efficiency of the toners transferred from the intermediate transfer member 5 to the transfer medium 6 was 95 to 98%. As transfer efficiency on the whole, it was as high as 90.3 to 96.0%. The toner images showed a good color mixing performance, and good full-color images were obtained, causing neither blank areas caused by poor transfer nor black spots around images.

In the present Example, the evaluation on the black spots around images are made on minute fine lines concerned with the image quality of graphical images, and are evaluated on 100 μm line images, around which the black spots more tend to occur.

The evaluation on the blank areas caused by poor transfer was made on a transfer medium (plain paper) of 199 g/m$^2$ basis weight. Paper feed was possible also when such transfer paper of 199 g/m$^2$ basis weight was used, and good images were obtained.

To evaluate the transfer performance, solid black toner images formed on the photosensitive member, the toner images transferred onto the intermediate transfer member and the toner images transferred onto the transfer medium were taken off with Mylar tapes, and the tapes thus taken off were stuck on a sheet of paper. From Macbeth density of the tapes stuck on the paper, Macbeth density of a virgin tape stuck on a sheet of paper was subtracted to obtain numerical values, according to which the evaluation was made.

EXAMPLE 2

Images were reproduced in the same manner as in Example 1 except that the magnetic toner B of Toner Production Example 2 was used as the black toner and the OPC photosensitive drum of Photosensitive Member Production Example 1 was used as the electrostatic latent image bearing member.

Here, the transfer efficiency of the toners of the respective colors transferred from the OPC photosensitive drum 1 to the intermediate transfer member 5 was 94 to 97%, and the transfer efficiency of the toners transferred from the intermediate transfer member 5 to the transfer medium 6 was 93 to 97%. As transfer efficiency on the whole, it was as high as 87.4 to 94.1%, and good full-color images were obtained, causing neither blank areas caused by poor transfer on characters or lines nor black spots around images.

Comparative Example 1

Images were reproduced in the same manner as in Example 2 except that the magnetic toner G (SF-2=151) of Toner Production Example 7 was used as the black toner and the toners O, P and Q were used as other color toners. As a result, the transfer efficiency of the toners of the respective colors transferred from the OPC photosensitive drum 1 to the intermediate transfer member 5 was 85 to 90%, and the transfer efficiency of the toners transferred from the intermediate transfer member 5 to the transfer medium 6 was 80 to 85%. As transfer efficiency on the whole, the toner utilization was as low as 68 to 76.5%. Blank areas caused by poor transfer a little occurred on characters or lines.

Comparative Example 2

Images were reproduced in the same manner as in Example 1 except that the magnetic toner I (SF-2=150) of Toner Production Example 9 was used as the black toner and the OPC photosensitive drum of Photosensitive Member Production Example 2 was used as the electrostatic latent image bearing member. As a result, the transfer efficiency of the toners of the respective colors transferred from the OPC photosensitive drum 1 to the intermediate transfer member 5 was 82 to 86%, and the transfer efficiency of the toners transferred from the intermediate transfer member to the transfer medium was 78 to 82%. As transfer efficiency on the whole, it was as poor as 64 to 70.5% compared with Example 1. Blank areas caused by poor transfer a little much occurred on characters or lines and also black spots around line images much occurred.

Comparative Example 3

Images were reproduced in the same manner as in Example 1 except that as the black toner the magnetic toner A was replaced with the magnetic toner J (the inorganic fine powder is not externally added). As a result, each transfer efficiency was as low as less than 70%. As transfer efficiency on the whole, it was as poor as less than 50% compared with Example 1. Also, poor images were formed, having slim lines, many blank areas caused by poor transfer on characters or lines and black spots around images.

EXAMPLES 3 to 6

As the developing assembly for black magnetic toner, a developing sleeve comprising a stainless steel cylinder of 16 mm diameter with a blast-finished surface and formed thereon a resin layer having the following composition and having a layer thickness of about 7 μm and a JIS center-line average roughness (Ra) of 1.5 μm was used as the black-toner carrying member.

| Resin layer composition: | |
|---|---|
| Phenol resin | 100 parts |
| Graphite (particle diameter: about 3 μm) | 45 parts |
| Carbon black | 5 parts |
| | (by weight) |

Images were reproduced in the same manner as in Example 1 except that the above developing sleeve and as the black magnetic toner the magnetic toners C, D, E or F of Toner Production Examples 3 to 6 were used, as development bias DC bias component Vdc of −500 V and superimposing AC bias component Vpp of 1,100 V and f=2,000 Hz were applied, and the developing sleeve was rotated in the regular direction, setting the ratio of its peripheral speed Vt to the peripheral speed V of the photosensitive drum, Vt/V, to 2.0. As a result, in the case of the magnetic toners C and D, good images were obtained in a good transfer efficiency, causing neither blank areas caused by poor transfer on characters or lines nor black spots around images. In the case of the magnetic toners E and F, images had slightly low densities and the transfer efficiency was slightly lower than that in Example 1, but there was no problem in practical use. Good images were also obtained, causing neither blank areas caused by poor transfer on characters or lines nor black spots around images.

EXAMPLE 7

Images were reproduced in the same manner as in Example 1 except that as the black magnetic toner the magnetic toner H of Toner Production Example 8 were used, and as development bias DC bias component Vdc of −450 V and superimposing AC bias component Vpp of 1,300 V and f=2,000 Hz were applied. As a result, like Example 1, good images were obtained in a good transfer efficiency, causing neither blank areas caused by poor transfer on characters or lines nor black spots around images.

EXAMPLE 8

Images were reproduced using the same apparatus and conditions as in Example 2 except that two-component magnetic brush development was carried out using as the black magnetic toner the non-magnetic black toner V of Toner Production Example 22. As a result, like Example 2, good images were obtained in a good transfer efficiency, causing neither blank areas caused by poor transfer on characters or lines nor black spots around images.

EXAMPLE 9

Images were reproduced using the same apparatus and conditions as in Example 1 except that as the color toners the toners K, L and M of Toner Production Examples 11 to 14 were used. As a result, like Example 1, good images were obtained in a good transfer efficiency, causing neither blank areas caused by poor transfer on characters or lines nor black spots around images .

Comparative Example 4

On a commercially available full-color copying machine (CLC-500, manufactured by CANON INC.), image reproduction was tested using the color toner of the four colors as used in Comparative Example 1. In the case of transfer paper with a basis weight of 105 g/m$^2$, the paper was attracted to the surface of a transfer drum by means of an auxiliary means such as a gripper, and the toner images were successively transferred four times to the transfer paper, followed by heat-and-pressure roller fixing of the four-color toner images held on the transfer paper by fixing. As a result, it was possible to obtain full-color images with a high image quality. However, in the case of transfer paper with a basis weight of 199 g/m$^2$, more seriously than in Comparative Example 1, non-uniform faulty transfer locally occurred in conformity with the wild formation of the transfer paper, and faulty attraction of transfer paper to the transfer drum also occurred. In addition, the rear end of the transfer paper separated from the transfer drum to cause faulty attraction, resulting in faulty transfer.

Comparative Example 5

Images were reproduced using the same apparatus and conditions as in Comparative Example 1 except that the toner O, P, Q or R of Toner Production Examples 15 to 18 was used as the toner. As a result, like Comparative Example 1, the transfer efficiency on the whole was less than 85%, and also blank areas caused by poor transfer conspicuously occurred on characters or line images.

Comparative Example 6

Images were reproduced using the same apparatus and conditions as in Comparative Example 5 except that two-component magnetic brush development was carried out using as the black magnetic toner the non-magnetic toner N of Toner Production Example 14. As a result, like Comparative Example 1, the transfer efficiency on the whole was less than 85%, and also blank areas caused by poor transfer conspicuously occurred on characters or line images.

EXAMPLE 10

Images were reproduced in the same manner as in Example 1 except that the magnetic toner W of Toner Production Example 23 was used as the black toner. Here, the transfer efficiency of the toners of the respective colors transferred from the OPC photosensitive drum 1 to the intermediate transfer member 5 was 95 to 98%, and the transfer efficiency of the toners transferred from the intermediate transfer member 5 to the transfer medium 6 was 94 to 97%. As transfer efficiency on the whole, it was 89.3 to 95.1%, showing a high transfer efficiency, and good images were obtained, causing neither blank areas caused by poor transfer on characters or lines nor black spots around images.

Production Examples for Liquid Lubricant Supported Magnetic Material

Based on 100 parts by weight of magnetic iron oxide (average particle diameter: 0.22 μm), a predetermined amount of a liquid lubricant was put into a Simpson mix muller (MPVU-2, manufactured by Matsumoto Chuzo K. K.), and the mixer was operated at room temperature for 30 minutes, followed by loosening of agglomeration of particles by means of a hammer mill to obtain a magnetic material (a) with the liquid lubricant supported thereon. Similarly, various kinds of liquid lubricants were respectively made supported on various kinds of magnetic materials. Magnetic materials (a) to (f) with the liquid lubricant supported thereon, thus obtained, had physical properties as shown in Table 2.

TABLE 2

| Magnetic material | | Liquid lubricant | | |
|---|---|---|---|---|
| Type | Average particle diameter (μm) | Type | Viscosity (cSt) | Support weight (wt. %) |
| (a) | 0.22 | Dimethylsilicone oil | 1,000 | 1.5 |
| (b) | 0.22 | Dimethylsilicone oil | 300 | 1 |
| (c) | 0.22 | Polytetrafluoroethylene oil | 100 | 0.5 |
| (d) | 0.22 | Dimethylsilicone oil | 500 | 1.8 |
| (e) | 0.22 | Dimethylsilicone oil containing trifluoropropyl groups | 450 | 3 |
| (f) | 0.24 | Dimethylsilicone oil | 1,000 | 5 |

Production Examples for Liquid Lubricant Supported Lubricating Particles

While the supporting fine particles (silica) for making the liquid lubricant supported thereon were agitated in a Henschel mixer, a liquid lubricant diluted with n-hexane was dropwise added. After the addition was completed, the n-hexane was removed under reduced pressure with stirring, followed by pulverization using a hammer m iill to obtain lubricating particles (a) with the liquid lubricant supported thereon. Similarly, various kinds of liquid lubricants were respectively made supported on various kinds of supporting fine particles. Physical properties of lubricating particles (a) to (d) with the liquid lubricant supported thereon, thus obtained, are shown in Table 3.

TABLE 3

| | Supporting particles | | Liquid lubricant | | |
|---|---|---|---|---|---|
| Lubricating particles | Type | BET specific surface area | Type | Viscosity (cSt) | Support weight (wt. %) |
| (a) | Fine dry-process silica powder | 200 | Dimethylsilicone oil | 50,000 | 60 |
| (b) | Fine dry-process silica powder | 200 | Dimethylsilicone oil | 10,000 | 50 |
| (c) | Fine dry-process silica powder | 300 | Dimethylsilicone oil | 20,000 | 70 |
| (d) | Fine titanium oxide powder | 130 | Polytetrafluoroethylene oil | 100 | 50 |

TONER PRODUCTION EXAMPLE 24

| | |
|---|---|
| Magnetic material (a) | 100 parts |
| Binder resin (styrene/butyl acrylate/butylmaleic acid half ester copolymer; low-molecular weight side peak: about 5,000; glass transition point Tg: 58° C.) | 100 parts |
| Negative charge control agent (iron complex of monoazo dye) | 2 parts |
| Release agent (low-molecular weight polyolefin) | 2 parts |
| | (all by weight) |

The above materials were mixed using a blender, and then melt-kneaded using a twin-screw extruder heated to 130° C. The kneaded product obtained was c ooled, and then crushed with a hammer mill. The crushed product was finely pulverized by means of a jet mill, and the finely pulverized product obtained was strictly classified using a multi-division classifier utilizi ng the Coanda effect, to obtain magnetic toner particles. The magnetic toner particles obtained w ere surface-treated by thermomechanical impact force (treatment temperature: 60° C.). To 100 parts by weight of the magnetic toner particles thus obtained, 1.8 parts by weight of dry-process silica with a primary particle diameter of 12 nm made hydrophobic by treatment with hexamethyldisilazane (BET specific surface area after treatment: 160 $m^2/g$ ) and 0.5 part by weight of spherical silica (BET specific surface area: 20 $m^2/g$; primary particle diameter: 0.1 μm) were added as the inorganic fine powder, which were then mixed by means of a mixing machine to obtain a magnetic toner 1.

The magnetic toner 1 obtained had a weight average particle diameter of 6.5 μm, a number average particle diameter of 5.3 μm, SF-1 of 142, SF-2 of 126, and a BET specific surface area of 5.3 $m^2/CM^3$. The BET specific surface area of the magnetic toner particles was 1.7 $m^2/cm^3$.

Physical properties of the magnetic toner 1 thus obtained are shown in Table 4.

TONER PRODUCTION EXAMPLE 25

A magnetic toner 2 was obtained in the same manner as in Toner Production Example 24 except that the magnetic material (a) used therein was replaced with magnetic material (b) and 1.3 parts by weight of dry-process silica with a primary particle diameter of 12 nm made hydrophobic by treatment with hexamethyldisilazane (BET specific surface area: 160 $m^2/g$) was used as the inorganic fine powder.

Physical properties of the magnetic toner 2 thus obtained are shown in Table 4.

TONER PRODUCTION EXAMPLE 26

| | |
|---|---|
| Magnetic material (c) | 90 parts |
| Binder resin (styrene/butyl acrylate/butylmaleic acid half ester copolymer; low-molecular weight side peak: about 10,000; glass transition point Tg: 62° C.) | 100 parts |
| Negative charge control agent (iron complex of monoazo dye) | 2 parts |
| Release agent (low-molecular weight polyolefin) | 2 parts |
| | (all by weight) |

A magnetic toner 3 was obtained in the same manner as in Toner Production Example 24 except that the above were used, the surface treatment of the magnetic toner particles by thermomechanical impact force was made at a temperature of 64° C., and the dry-process silica made hydrophobic with hexamethyldisilazane (BET specific surface area after treatment: 160 $m^2/g$) was used in an amount of 1.8 parts by weight as the inorganic fine powder.

Physical properties of the magnetic toner 3 thus obtained are shown in Table 4.

TONER PRODUCTION EXAMPLE 27

A magnetic toner 4 was obtained in the same manner as in Toner Production Example 24 except that the magnetic material (a) used therein was replaced with magnetic material (d).

Physical properties of the magnetic toner 4 thus obtained are shown in Table 4.

TONER PRODUCTION EXAMPLE 28

| | |
|---|---|
| Magnetic material (a) | 110 parts |
| Binder resin (polyester resin; low-molecular weight side peak: about 7,000; glass transition point Tg: 62° C.) | 100 parts |
| Negative charge control agent (chromium complex of monoazo dye) | 2 parts |
| Release agent (low-molecular weight polyolefin) | 2 parts |
| | (all by weight) |

A magnetic toner 5 was obtained in the same manner as in Toner Production Example 24 except that the above materials were used and the surface treatment of the magnetic toner particles by thermomechanical impact force was made at a temperature of 64° C.

Physical properties of the magnetic toner 5 thus obtained are shown in Table 4.

TONER PRODUCTION EXAMPLE 29

| | |
|---|---|
| Binder resin (polyester resin; low-molecular weight side peak: about 6,000; glass transition point Tg: 55° C.) | 100 parts |
| Colorant (Carbon black) | 7 parts |
| Lubricating particles (a) | 4 parts |
| Negative charge control agent (dialkylsalicylic acid metal compound) | 2 parts |
| | (all by weight) |

The above materials were thoroughly melt-kneaded using an extruder. The kneaded product obtained was cooled, and then crushed by a mechanical means. The crushed product was finely pulverized by causing it to collide against an impact plate by the use of jet streams, and the finely pulverized product was classified using an air classifier utilizing the Coanda effect, to obtain black toner particles. The toner particles obtained were surface-treated by thermomechanical impact force (treatment temperature: 60° C.). To 100 parts by weight of the black toner particles thus obtained, 2 parts by weight of fine titanium oxide particles with a primary particle diameter of 20 nm made hydrophobic with isobutyltrimethoxysilane (BET specific surface area: 130 $m^2/g$) was externally added to obtain a non-magnetic black toner 6 having a good fluidity. Then, the above toner 6 was blended with a silicone resin-coated magnetic ferrite carrier having an average particle diameter of about 50$\mu$m, in a weight ratio of 5:95 to produce a two-component developer.

Physical properties of the toner 6 thus obtained are shown in Table 4.

TONER PRODUCTION EXAMPLEs 30 to 32

Toners 7, 8 and 9 were obtained in the same manner as in Toner Production Example 29 except that the lubricating particles (a) used therein was replaced with lubricating particles (b), (c) or (d) and the conditions for the surface treatment by thermomechanical impact force were changed.

Physical properties of the toners 7, 8 and 9 thus obtained are shown in Table 4.

TONER PRODUCTION EXAMPLE 33

| | |
|---|---|
| Binder resin (polyester resin; low-molecular weight side peak: about 6,000; glass transition point Tg: 55° C.) | 100 parts |
| Cyan colorant (C.I. Pigment Blue 15:3) | 7 parts |
| Lubricating particles (a) | 4 parts |
| Negative charge control agent (dialkylsalicylic acid metal compound) | 2 parts |
| | (all by weight) |

The above materials were thoroughly melt-kneaded using an extruder. The kneaded product obtained was cooled, and then crushed by a mechanical means. The crushed product was finely pulverized by causing it to collide against an impact plate by the use of jet streams, and the finely pulverized product was classified using an air classifier utilizing the Coanda effect, to obtain cyan toner particles. The cyan toner particles obtained were surface-treated by thermomechanical impact force (treatment temperature: 60° C.). Thereafter, to 100 parts by weight of the cyan toner particles thus obtained, 2 parts by weight of fine titanium oxide particles with a primary particle diameter of 20 nm made hydrophobic (BET specific surface area: 100 $m^2/g$) was externally added to obtain a cyan color toner 10 having a good fluidity.

Physical properties of the cyan toner 10 thus obtained are shown in Table 4.

TONER PRODUCTION EXAMPLE 34

A yellow color toner 11 was obtained in the same manner as in Toner Production Example 33 except that as the colorant used therein the C.I. Pigment Blue 15:3 was replaced with a yellow colorant C.I. Pigment Yellow 17, and the lubricating particles (a) was replaced with the lubricating particles (b).

Physical properties of the yellow toner 11 thus obtained are shown in Table 4.

TONER PRODUCTION EXAMPLES 35 AND 36

A magenta color toner 12 was obtained in the same manner as in Toner Production Example 33 except that the colorant and lubricating particles used therein were replaced with a magenta colorant C.I. Pigment Red 202 and the lubricating particles (c), respectively, and also a black toner 13 was obtained in the same manner as in Toner Production Example 33 except that the colorant and lubricating particles used therein were replaced with graft carbon black and the lubricating particles (d), respectively.

Physical properties of the magenta toner 12 and black toner 13 thus obtained are shown in Table 4.

TONER PRODUCTION EXAMPLE 37

(Comparative Example)

A magnetic toner 14 with SF-2 of 152 was obtained in the same manner as in Toner Production Example 24 except that the surface treatment of the magnetic toner particles by thermomechanical impact force was not made.

Physical properties of the magnetic toner 14 thus obtained are shown in Table 4.

TONER PRODUCTION EXAMPLE 38

(Comparative Example)

A magnetic toner 15 was obtained in the same manner as in Toner Production Example 24 except that the inorganic fine powder was not added to the toner particles.

Physical properties of the magnetic toner 15 thus obtained are shown in Table 4.

TONER PRODUCTION EXAMPLE 39

(Comparative Example)

A toner 16 with SF-2 of 158 was obtained in the same manner as in Toner Production Example 29 except that the lubricating particles (a) was replaced with 4 parts by weight of the lubricating particles (e) and the surface treatment of the magnetic toner particles by thermomechanical impact force was not made. Then, the above toner was blended with a resin-coated ferrite carrier having an average particle diameter of about 50 $\mu$m, in a weight ratio of 5:95 to produce a two-componet developer.

Physical properties of the toner 16 thus obtained are shown in Table 4.

TONER PRODUCTION EXAMPLES 40 TO 43

| (Comparative Example) | |
|---|---|
| Binder resin (polyester resin; low-molecular weight side peak: about 6,000; glass transition point Tg: 55° C.) | 100 parts |
| Cyan colorant (C.I. Pigment Blue 15:3) | 7 parts |
| Lubricating particles (e) | 4 parts |
| Negative charge control agent (dialkylsalicylic acid metal compound) | 2 parts |
| | (all by weight) |

The above materials were thoroughly melt-kneaded using an extruder. The kneaded product obtained was cooled, and then crushed by a mechanical means. The crushed product was finely pulverized by causing it to collide against an impact plate by the use of jet streams, and the finely pulverized product was classified using an air classifier utilizing the Coanda effect, to obtain a non-magnetic negatively chargeable cyan toner particles by pulverization, having a weight average particle diameter of 7.9 $\mu$m, SF-1 of 170 and SF-2 of 157. To 100 parts by weight of the cyan toner particles thus obtained, 2 parts by weight of fine titanium oxide particles with a primary particle diameter of 20 nm made hydrophobic with isobutyltrimethoxysilane (BET specific surface area: 130 $m^2/g$) was externally added to obtain a cyan color toner 17, having SF-2 of 159.

With regard to yellow toner, magenta toner and black toner, the above procedure was repeated except for replacing the colorant with C.I. Pigment Yellow 17, C.I. Pigment Red 202 and graft carbon black, respectively. Thus, a yellow toner 18, a magenta toner 19 and a black toner 20, produced by pulverization, were obtained. These toners of four colors were each blended with a silicone resin-coated magnetic ferrite carrier having an average particle diameter of about 50 $\mu$m, in a weight ratio of 5:95 to produce two-component developers of the respective colors.

Physical properties of the toners of the respective colors are shown in Table 4.

TONER PRODUCTION EXAMPLE 44

A magnetic toner 21 was obtained in the same manner as in Toner Production Example 24 except that 1.8 parts by weight of dry-process silica with a primary particle diameter of 12 nm made hydrophobic by treatment with hexamethyldisilazane (BET specific surface area after treatment: 160 $m^2/g$) and 0.5 part by weight of dry-process silica with a primary particle diameter of 40 nm treated with hexamethyldisilazane (BET specific surface area after treatment: 40 $m^2/g$) were used as the inorganic fine powder.

Physical properties of the magnetic toner 21 thus obtained are shown in Tables 4(A) and 4(B).

TABLE 4(A)

| | | Shape factors | | |
|---|---|---|---|---|
| Production Example No. | Toner No. | SF-1 | SF-2 | B/A ratio |
| Production Example 24 | Toner 1 | 142 | 126 | 0.62 |
| Production Example 25 | Toner 2 | 139 | 125 | 0.64 |
| Production Example 26 | Toner 3 | 140 | 129 | 0.73 |
| Production Example 27 | Toner 4 | 143 | 127 | 0.63 |
| Production Example 28 | Toner 5 | 145 | 134 | 0.76 |
| Production Example 29 | Toner 6 | 159 | 137 | 0.63 |
| Production Example 30 | Toner 7 | 159 | 139 | 0.66 |
| Production Example 31 | Toner 8 | 160 | 140 | 0.67 |
| Production Example 32 | Toner 9 | 171 | 140 | 0.56 |
| Production Example 33 | Toner 10 | 160 | 139 | 0.65 |
| Production Example 34 | Toner 11 | 159 | 139 | 0.66 |
| Production Example 35 | Toner 12 | 159 | 140 | 0.68 |
| Production Example 36 | Toner 13 | 159 | 139 | 0.66 |
| Production Example 37 | Toner 14 | 156 | 152 | 0.93 |
| Production Example 38 | Toner 15 | 142 | 126 | 0.62 |
| Production Example 39 | Toner 16 | 170 | 158 | 0.83 |
| Production Example 40 | Toner 17 | 170 | 159 | 0.84 |
| Production Example 41 | Toner 18 | 172 | 161 | 0.85 |
| Production Example 42 | Toner 19 | 170 | 160 | 0.86 |
| Production Example 43 | Toner 20 | 171 | 159 | 0.83 |
| Production Example 44 | Toner 21 | 142 | 126 | 0.62 |

TABLE 4(B)

| | U/V: unit volume | | | | | | | | | |
|---|---|---|---|---|---|---|---|---|---|---|
| | Physical properties | | | | | | | | | |
| | Toner | | | | | | | | Toner particles | |
| | BET specific surface area per U/V Sb ($m^2/cm^3$) | Weight average particle diam. D4 ($\mu$m) | Density ($g/cm^3$) | Theoretical specific surface are per U/V St ($m^2/cm^3$) | Sb/St | Glass transition point (°C.) | Low = molecular weight peak | Charge quantity per U/V ($C/m^3$) | BET specif. surface ara per U/V ($m^2/cm^3$) | 60% Average pore radius (nm) |
| Toner 1 | 5.3 | 6.5 | 1.70 | 0.92 | 5.7 | 57 | 5,000 | −58 | 1.70 | 2.2 |

TABLE 4(B)-continued

U/V: unit volume

| | Physical properties | | | | | | | | | |
|---|---|---|---|---|---|---|---|---|---|---|
| | Toner | | | | | | | | Toner particles | |
| | BET specific surface area per U/V Sb ($m^2/cm^3$) | Weight average particle diam. D4 ($\mu m$) | Density ($g/cm^3$) | Theoretical specific surface are per U/V St ($m^2/cm^3$) | Sb/St | Glass transition point (°C.) | Low = molecular weight peak | Charge quantity per U/V ($C/m^3$) | BET specif. surface ara per U/V ($m^2/cm^3$) | 60% Average pore radius (nm) |
| Toner 2 | 5.2 | 6.5 | 1.70 | 0.92 | 5.6 | 61 | 5,000 | −46 | 1.70 | 2.1 |
| Toner 3 | 4.6 | 7.0 | 1.65 | 0.86 | 5.4 | 63 | 10,000 | −57 | 1.90 | 3.0 |
| Toner 4 | 5.3 | 6.5 | 1.70 | 0.92 | 5.7 | 57 | 5,000 | −59 | 1.70 | 2.2 |
| Toner 5 | 5.7 | 6.7 | 1.75 | 0.90 | 6.4 | 63 | 7,000 | −64 | 1.90 | 3.0 |
| Toner 6 | 3.7 | 7.8 | 1.05 | 0.77 | 4.8 | 54 | 6,000 | −53 | 1.80 | 3.2 |
| Toner 7 | 3.7 | 7.8 | 1.05 | 0.77 | 4.8 | 54 | 6,000 | −52 | 1.80 | 3.2 |
| Toner 8 | 3.7 | 7.8 | 1.05 | 0.77 | 4.8 | 54 | 6,000 | −51 | 1.80 | 3.2 |
| Toner 9 | 3.7 | 7.8 | 1.05 | 0.77 | 4.8 | 54 | 6,000 | −51 | 1.80 | 3.2 |
| Toner 10 | 3.7 | 7.8 | 1.05 | 0.77 | 4.8 | 54 | 6,000 | −53 | 1.80 | 3.2 |
| Toner 11 | 3.7 | 7.8 | 1.05 | 0.77 | 4.8 | 54 | 6,000 | −52 | 1.80 | 3.2 |
| Toner 12 | 3.7 | 7.8 | 1.05 | 0.77 | 4.8 | 54 | 6,000 | −51 | 1.80 | 3.2 |
| Toner 13 | 3.7 | 7.8 | 1.05 | 0.77 | 4.8 | 54 | 6,000 | −51 | 1.80 | 3.2 |
| Toner 14 | 6.5 | 6.6 | 1.70 | 0.91 | 7.2 | 57 | 5,000 | −47 | 2.45 | 4.2 |
| Toner 15 | 1.7 | 6.5 | 1.70 | 0.92 | 1.8 | 57 | 5,000 | −26 | 1.70 | 2.1 |
| Toner 16 | 4.2 | 7.9 | 1.05 | 0.76 | 5.5 | 54 | 6,000 | −50 | 2.60 | 3.7 |
| Toner 17 | 4.2 | 7.9 | 1.05 | 0.76 | 5.5 | 54 | 6,000 | −50 | 2.60 | 3.6 |
| Toner 18 | 4.2 | 7.9 | 1.05 | 0.76 | 5.5 | 54 | 6,000 | −50 | 2.60 | 3.6 |
| Toner 19 | 4.2 | 7.9 | 1.05 | 0.76 | 5.5 | 54 | 6,000 | −50 | 2.60 | 3.6 |
| Toner 20 | 4.2 | 7.9 | 1.05 | 0.76 | 5.5 | 54 | 6,000 | −50 | 2.60 | 3.7 |
| Toner 21 | 5.5 | 6.5 | 1.70 | 0.92 | 6.0 | 57 | 5,000 | −59 | 1.70 | 2.2 |

EXAMPLE 11

Using as the primary charging roller a rubber roller (diameter: 12 mm; contact pressure: 50 g/cm) with conductive carbon dispersed therein, its carbon particl es ha ving been coated with nylon resin, and also using as the electrostatic latent image bearing member the OPC (organic photoconductor) photosensitive drum as produced in Photosensitive Member Production Example 3, digital latent images were formed by laser exposure (600 dpi) to provide a dark portion potential $V_D$ of −600 V and a l ight portion potential $V_L$ of −100 V. As the developing assembly for black color, the developing assembly made up as shown in FIG. 2 was used at the position of the developing assembly 4-4 shown in FIG. 1. As the black toner carrying member, a developing sleeve comprising a stainless steel cylinder of 16 mm diameter with a blast-finished surface and formed thereon a resin layer having the following composition and having a layer thickness of about 7 $\mu$m and a JIS center-line average roughness (Ra) of 2.2 $\mu$m was used as the black-toner carrying member.

| Resin layer composition: | |
|---|---|
| Phenol resin | 100 parts |
| Graphite (particle diameter: about 7 $\mu$m) | 90 parts |
| Carbon black | 10 parts |
| | (all by weight) |

Then, the gap (S-D gap) between the OPC photosensitive drum and the developing sleeve of the developing assembly 4-4 was set to be 300 $\mu$m, and development magnetic pole, 80 mT (800 gausses). As the toner coat control member, a urethane rubber blade of 1.0 mm thick and 10 mm in free length was brought into touch with the surface of the developing sleeve at a linear pressure of 14.7 N/m (15 g/cm). As development bias, DC bias component Vdc of −450 V and superimposing AC bias component Vpp of 1,200 V and f=2,000 Hz were applied to the developing sleeve.

As the cleaning blade of the OPC photosensitive drum, a urethane rubber blade of 2.0 mm thick and 8 mm in free length was brought into touch with the surface of the photosensitive drum at a linear pressure of 24.5N/m (25 g/cm). The process speed was set at 94 mm/sec. The developing sleeve was rotated in the regular direction, setting the ratio of its peripheral speed Vt to the peripheral speed V of the photosensitive drum, Vt/V, to 1.5. As the black toner, the magnetic toner 1 of Toner Production Example 24 was used.

Using as the magenta toner, cyan toner and yellow toner, the toners 10, 11 and 12 of Toner Production Examples 33 to 35, respectively, two-component developers were prepared. These developers were respectively put into the developing assemblies 4-1, 4-2 and 4-3 shown in FIG. 1. Toner images of the respective colors were formed in an environment of 23° C./65%RH by magnetic brush development under the image forming conditions as described above. The toner images of the respective colors were successively transferred from the OPC photosensitive drum 1 to the intermediate transfer member 5 coming into pressure contact with the OPC photosensitive drum. The four-color toner images on the intermediate transfer member 5 were transferred to a transfer medium (plain paper) of 75 $g/m^2$ basis weight while pressing the transfer roller 7 to the intermediate transfer member 5, under application of a voltage to the transfer roller 7 so as to cause a transfer current of +6 $\mu$A to flow to the drum. Subsequently, the four-color toner images on the transfer medium were thermally fixed by the heat-and-pressure fixing means 11 to form a full-color image.

Here, the transfer efficiency of the toners of the respective colors transferred from the OPC photosensitive drum 1 to the intermediate transfer member 5 was 95 to 98%, and the transfer efficiency of the toners transferred from the intermediate transfer member 5 to the transfer medium 6 was 95 to 98%. As transfer efficiency on the whole, it was as high as 90 to 96.0%. The toner images showed a good color mixing performance, and good full-color images were obtained, causing neither blank areas caused by poor transfer nor black spots around images.

EXAMPLE 12

Images were reproduced in the same manner as in Example 11 except that the toner 2 of Toner Production Example 25 was used as the black toner and the OPC photosensitive drum of Photosensitive Member Production Example 1 was used as the electrostatic latent image bearing member.

Here, the transfer efficiency of the toners of the respective colors transferred from the OPC photosensitive drum 1 to the intermediate transfer member 5 was 95 to 98%, and the transfer efficiency of the toners transferred from the intermediate transfer member 5 to the transfer medium 6 was 95 to 98%. As transfer efficiency on the whole, it was as high as 90 to 96%, and good full-color images were obtained, causing neither blank areas caused by poor transfer on characters or lines nor black spots around images.

Comparative Example 7

Images were reproduced in the same manner as in Example 12 except that the magnetic toner 14 (SF-2=152) of Toner Production Example 37 was used as the black toner and the toners 17, 18 and 19 were used as other color toners. As a result, the transfer efficiency of the toners of the respective colors transferred from the OPC photosensitive drum 1 to the intermediate transfer member 5 was 85 to 91%, and the transfer efficiency of the toners transferred from the intermediate transfer member 5 to the transfer medium 6 was 80 to 86%. As transfer efficiency on the whole, the toner utilization was as low as 68 to 78%. Blank areas caused by poor transfer a little occurred on characters or lines.

Comparative Example 8

Images were reproduced in the same manner as in comparative Example 7 except that as the black toner the magnetic toner 14 was replaced with the magnetic toner 15 (the inorganic fine powder is not externally added). As a result, each transfer efficiency was as low as less than 70%. As transfer efficiency on the whole, it was less than 50%. Also, poor images were formed, having slim lines, many blank areas caused by poor transfer on characters or lines and black spots around images.

EXAMPLES 13 to 16

As a magnetic-toner carrying member, a developing sleeve comprising a stainless steel cylinder of 16 mm diameter with a blast-finished surface and formed thereon a resin layer having the following composition and having a layer thickness of about 7 $\mu$m and a JIS center-line average roughness (Ra) of 1.5 $\mu$m was used as the black-toner carrying member.

| Resin layer composition: | |
|---|---|
| Phenol resin | 100 parts |
| Graphite (particle diameter: about 3 $\mu$m) | 45 parts |
| Carbon black | 5 parts (by weight) |

Images were reproduced in the same manner as in Example 11 except that the above developing sleeve and as the black magnetic toner the magnetic toners 3 and 4 of Toner Production Examples 26 and 27 were used, as development bias DC bias component Vdc of −500 V and superimposing AC bias component Vpp of 1,100 V and f=2,000 Hz were applied, and the developing sleeve was rotated in the regular direction, setting the ratio of its peripheral speed Vt to the peripheral speed V of the photosensitive drum, Vt/V, to 2.0. As a result, in the case of the magnetic toners 3 and 4, like Example 11, good images were obtained in a good transfer efficiency, causing neither blank areas caused by poor transfer on characters or lines nor black spots around images.

EXAMPLE 17

Images were reproduced in the same manner as in Example 11 except that as the black magnetic toner the magnetic toner 5 of Toner Production Example 28 were used, and as development bias DC bias component Vdc of −450 V and superimposing AC bias component Vpp of 1,300 V and f=2,000 Hz were applied. As a result, like Example 11, good images were obtained in a good transfer efficiency, causing neither blank areas caused by poor transfer on characters or lines nor black spots around images.

EXAMPLE 18

Images were reproduced using the same apparatus and conditions as in Example 12 except that two-component magnetic brush development was carried out using as the black toner the black toner 13 of Toner Production Example 36. As a result, like Example 12, good images were obtained in a good transfer efficiency, causing neither blank areas caused by poor transfer on characters or lines nor black spots around images.

EXAMPLES 19 to 22

Images were reproduced using the same manner as in Example 18 except that as the black toners the toners 6, 7, 8 and 9 of Toner Production Examples 29 to 32 were used. As a result, like Example 18, good images were obtained in a good transfer efficiency, causing neither blank areas caused by poor transfer on characters or lines nor black spots around images. In the case of the toner 9, its transfer efficiency was a little poor, but images substantially as good as those in the case of the toners 6, 7 and 8 were obtained without any problem in practical use.

Comparative Example 9

Images were reproduced using the same apparatus and conditions as in Comparative Example 7 except that the toner 17, 18, 19 or 20 of Toner Production Examples 40 to 43 was used as the toner. As a result, like Comparative Example 7, the transfer efficiency on the whole was less than 85%, and also blank areas caused by poor transfer conspicuously occurred on characters or line images.

Comparative Example 10

Images were reproduced using the same apparatus and conditions as in Comparative Example 9 except that two-component development was carried out using as the black magnetic toner the toner 16 of Toner Production Example 39. As a result, like Comparative Example 7, the transfer efficiency on the whole was less than 85%, and also blank areas caused by poor transfer conspicuously occurred on characters or line images.

EXAMPLE 23

Images were reproduced in the same manner as in Example 11 except that the toner 21 of Toner Production Example 44 was used as the black toner. Here, the transfer efficiency of the toners of the respective colors transferred from the photosensitive member 3 to the intermediate transfer member 5 was 95 to 98%, and the transfer efficiency of the toners transferred from the intermediate transfer member 5 to the transfer medium 6 was 94 to 97%, showing a high transfer efficiency. Good images were obtained, causing neither blank areas caused by poor transfer on characters or lines nor black spots around images.

TONER PRODUCTION EXAMPLE 45

Into 710 parts by weight of ion-exchanged water, 450 parts by weight of an aqueous 0.1M $Na_3PO_4$ solution were introduced, and the mixture was heated to 60° C., followed by stirring by means of a TK-type homomixer (manufactured by Tokushukika Kogyo K.K.) at 12,000 rpm. Then, 68 parts by weight of an aqueous 1.0M $CaCl_2$ solution was added thereto little by little to prepare an aqueous dispersion medium containing fine particles of $Ca_3(PO_4)_2$.

| | |
|---|---|
| Styrene monomers | 165 parts |
| n-Butyl acrylate monomers | 35 parts |
| Magenta colorant (C.I. Pigment Red 202) | 15 parts |
| Negative charge control agent (dialkylsalicylic acid metal compound) | 3 parts |
| Polar resin (saturated polyester resin) | 10 parts |
| Release agent (ester wax; melting point: 70° C.) | 50 parts |
| | (all by weight) |

The above materials were heated to 60° C. and then uniformly dissolved and dispersed by means of a TK-type homomixer (manufactured by Tokushukika Kogyo K.K.) at 12,000 rpm. In the resulting dispersion, 10 parts by weight of a polymerization initiator 2,2'-azobis(2,4-dimethylvaleronitrile) was dissolved to obtain a polymerizable monomer composition.

The polymerizable monomer composition obtained was introduced into the above aqueous dispersion medium, followed by stirring for 10 minutes by means of the TK-type homomixer at 10,000 rpm at 60° C. in an environment of $N_2$ to granulate the polymerizable monomer composition. Thereafter, while stirring with a paddle stirring blade, the temperature was raised to 80° C., and the reaction was carried out for 10 hours. After the polymerization was completed, the residual monomers were removed under reduced pressure. After the reaction product was cooled, hydrochloric acid was added to dissolve the calcium phosphate, followed by filtration, washing with water, and drying to obtain a non-magnetic negatively chargeable magenta toner particles having a weight average particle diameter of 5.8 $\mu$m in a sharp particle size distribution.

To 100 parts by weight of the magenta toner particles thus obtained, 2.0 parts by weight of hydrophobic fine titanium oxide particles made hydrophobic by treatment with isobutyltrimethoxysilane to have a specific surface area of 100 $m^2/g$ as measured by the BET method was externally added to obtain a magenta color toner 22.

Physical properties of the toner thus obtained are shown in Table 5.

Based on 7 parts by weight of this toner, 93 parts by weight of an acrylic resin-coated magnetic ferrite carrier was blended therewith to produce a developer (A).

TONER PRODUCTION EXAMPLE 46

Into 710 parts by weight of ion-exchanged water, 450 parts by weight of an aqueous 0.1M $Na_3PO_4$ solution were introduced, and the mixture was heated to 60° C., followed by stirring by means of a TK-type homomixer (manufactured by Tokushukika Kogyo K.K.) at 12,000 rpm. Then, 68 parts by weight of an aqueous 1.0M $CaCl_2$ solution was added thereto little by little to prepare an aqueous dispersion medium containing fine particles of $Ca_3(PO_4)_2$.

| | |
|---|---|
| Styrene monomers | 165 parts |
| n-Butyl acrylate monomers | 35 parts |
| Cyan colorant (C.I. Pigment Blue 15:3) | 15 parts |
| Negative charge control agent (dialkylsalicylic acid metal compound) | 3 parts |
| Polar resin (saturated polyester resin) | 10 parts |
| Release agent (ester wax; melting point: 70° C.) | 50 parts |
| | (all by weight) |

The above materials were heated to 60° C. and then uniformly dissolved and dispersed by means of a TK-type homomixer (manufactured by Tokushukika Kogyo K.K.) at 12,000 rpm. In the resulting dispersion, 10 parts by weight of a polymerization initiator 2,2'-azobis(2,4-dimethylvaleronitrile) was dissolved to obtain a polymerizable monomer composition.

The polymerizable monomer composition obtained was introduced into the above aqueous dispersion medium, followed by stirring for 10 minutes by means of the TK-type homomixer at 10,000 rpm at 60° C. in an environment of $N_2$ to granulate the polymerizable monomer composition. Thereafter, while stirring with a paddle stirring blade, the temperature was raised to 80° C., and the reaction was carried out for 10 hours. After the polymerization was completed, the residual monomers were removed under reduced pressure. After the reaction product was cooled, hydrochloric acid was added to dissolve the calcium phosphate, followed by filtration, washing with water, and drying to obtain a non-magnetic negatively chargeable cyan toner particles having a weight average particle diameter of 5.5 $\mu$m in a sharp particle size distribution.

To 100 parts by weight of the cyan toner particles thus obtained, 2.0 parts by weight of hydrophobic fine titanium oxide particles made hydrophobic by treatment with isobutyltrimethoxysilane to have a specific surface area of 100 $m^2/g$ as measured by the BET method was externally added to obtain a cyan color toner 23.

Physical properties of the toner thus obtained are shown in Table 5.

Based on 7 parts by weight of this toner, 93 parts by weight of an acrylic resin-coated magnetic ferrite carrier was blended therewith to produce a developer (B).

TONER PRODUCTION EXAMPLE 47

Into 710 parts by weight of ion-exchanged water, 450 parts by weight of an aqueous 0.1M $Na_3PO_4$ solution were introduced, and the mixture was heated to 60° C., followed by stirring by means of a TK-type homomixer (manufactured by Tokushukika Kogyo K.K.) at 12,000 rpm. Then, 68 parts by weight of an aqueous 1.0M $CaCl_2$ solution was added thereto little by little to prepare an aqueous dispersion medium containing fine particles of $Ca_3(PO_4)_2$.

| | |
|---|---|
| Styrene monomers | 165 parts |
| n-Butyl acrylate monomers | 35 parts |
| Yellow colorant (C.I. Pigment Yellow 17) | 15 parts |
| Negative charge control agent (dialkylsalicylic acid | 3 parts |

-continued

| | |
|---|---|
| metal compound) | |
| Polar resin (saturated polyester resin) | 10 parts |
| Release agent (ester wax; melting point: 70° C.) | 50 parts |
| | (all by weight) |

The above materials were heated to 60° C. and then uniformly dissolved and dispersed by means of a TK-type homomixer (manufactured by Tokushukika Kogyo K.K.) at 12,000 rpm. In the resulting dispersion, 10 parts by weight of a polymerization initiator 2,2'-azobis(2,4-dimethylvaleronitrile) was dissolved to obtain a polymerizable monomer composition.

The polymerizable monomer composition obtained was introduced into the above aqueous dispersion medium, followed by stirring for 10 minutes by means of the TK-type homomixer at 10,000 rpm at 60° C. in an environment of $N_2$ to granulate the polymerizable monomer composition. Thereafter, while stirring with a paddle stirring blade, the temperature was raised to 80° C., and the reaction was carried out for 10 hours. After the polymerization was completed, the residual monomers were removed under reduced pressure. After the reaction product was cooled, hydrochloric acid was added to dissolve the calcium phosphate, followed by filtration, washing with water, and drying to obtain a non-magnetic negatively chargeable yellow toner particles having a weight average particle diameter of 5.9 μm in a sharp particle size distribution.

To 100 parts by weight of the yellow toner particles thus obtained, 2.0 parts by weight of hydrophobic fine titanium oxide particles made hydrophobic by treatment with isobutyltrimethoxysilane to have a specific surface area of 100 $m^2/g$ as measured by the BET method was externally added to obtain a yellow color toner 24.

Physical properties of the toner thus obtained are shown in Table 5.

Based on 7 parts by weight of this toner, 93 parts by weight of an acrylic resin-coated magnetic ferrite carrier was blended therewith to produce a developer (C).

TONER PRODUCTION EXAMPLE 48

| | |
|---|---|
| Magnetic material (magnetic iron oxide powder; average particle diameter: 0.22 μm) | 100 parts |
| Binder resin (styrene/butyl acrylate/butylmaleic acid half ester copolymer; low-molecular weight side peak: about 5,000; glass transition point Tg: 58° C.) | 100 parts |
| Negative charge control agent (iron complex of monoazo dye) | 2 parts |
| Release agent (low-molecular weight polyolefin) | 2 parts |
| | (all by weight) |

The above materials were mixed using a blender, and then melt-kneaded using a twin-screw extruder heated to 130° C. The kneaded product obtained was cooled, and then crushed with a hammer mill. The crushed product was finely pulverized by means of a jet mill, and the finely pulverized product obtained was strictly classified using a multi-division classifier utilizing the Coanda effect, to obtain magnetic black toner particles. The magnetic toner particles obtained were surface-treated by thermomechanical impact force (treatment temperature: 60° C.). To 100 parts by weight of the magnetic toner particles thus obtained, 1.8 parts by weight of dry-process silica with a primary particle diameter of 12 nm made hydrophobic by treatment with silicone oil and hexamethyldisilazane (BET specific surface area after treatment: 120 $m^2/g$) and 0.5 part by weight of spherical silica (BET specific surface area: 20 $m^2/g$; primary particle diameter: 0.1 μm) were added as the inorganic fine powder, which were then mixed by means of a mixing machine to obtain black toner 25. This is designated as developer (D).

The black toner 25 obtained had a weight average particle diameter of 6.5 μm, a number average particle diameter of 5.3 μm, SF-1 of 141, SF-2 of 125, and a BET specific surface area of 5.3 $m^2/cm^3$. The BET specific surface area of the magnetic toner particles was 1.0 $m^2/cm^3$.

Physical properties of the toner thus obtained are shown in Table 5.

TONER PRODUCTION EXAMPLE 49

(Comparative Example)

A black toner 26 was obtained in the same manner as in Toner Production Example 48 except that neither dry-process silica nor spherical silica were externally added.

Physical properties of the toner thus obtained are shown in Table 5.

TONER PRODUCTION EXAMPLE 50

(Comparative Example)

| | |
|---|---|
| Binder resin (polyester resin; low-molecular weight side peak: about 6,000; glass transition point Tg: 55° C.) | 100 parts |
| Colorant (C.I. Pigment Blue 15:3) | 7 parts |
| Negative charge control agent (dialkylsalicylic acid metal compound) | 2 parts |
| | (parts: by weight) |

The above materials were thoroughly melt-kneaded using an extruder. The kneaded product obtained was cooled, and then crushed by a mechanical means. The crushed product was finely pulverized by causing it to collide against an impact plate by the use of jet streams, and the finely pulverized product was classified using an air classifier utilizing the Coanda effect, to obtain a cyan toner particles by pulverization, having a weight average particle diameter of 5.8 μm, SF-1 of 165 and SF-2 of 155. To 100 parts by weight of the cyan toner particles thus obtained, 2 parts by weight of fine titanium oxide particles with a primary particle diameter of 20 nm made hydrophobic with isobutyltrimethoxysilane (BET specific surface area: 100 $m^2/g$) was externally added to obtain a cyan toner 27, having a good fluidity.

The above toner was blended with an acrylic resin-coated magnetic ferrite carrier having an average particle diameter of about 35 μm, in a weight ratio of 7:93 to produce two-component developer (E).

Physical properties of the toner thus obtained are shown below in Table 5.

TONER PRODUCTION EXAMPLE 51

| | |
|---|---|
| Carbon black (average particle diameter: 60 nm) | 5 parts |
| Binder resin (styrene/butyl acrylate/butylmaleic acid half ester copolymer; low-molecular weight side peak: molecular weight of about 5,000; glass transition point Tg: 58° C.) | 100 parts |
| Negative charge control agent (iron complex of monoazo dye) | 2 parts |
| Release agent (low-molecular weight polyolefin) | 2 parts |
| | (all by weight) |

The above materials were mixed using a blender, and then melt-kneaded using a twin-screw extruder heated to 130° C.

The kneaded product obtained was cooled, and then crushed with a hammer mill. The crushed product was finely pulverized by means of a jet mill, and the finely pulverized product obtained was strictly classified using a multi-division classifier utilizing the Coanda effect, to obtain black toner particles. The toner particles obtained were surface-treated by thermomechanical impact force (treatment temperature: 60° C.). To 100 parts by weight of the toner particles thus obtained, 1.8 parts by weight of the fine titanium oxide particles as used in Example 50 was added as the inorganic fine powder, which were then mixed by means of a mixing machine to obtain black toner 28.

The black toner obtained had a weight average particle diameter of 5.8 μm, SF-1 of 140 and SF-2 of 130.

Physical properties of the toner thus obtained are shown in Table 5.

Based on 7 parts by weight of this toner, 93 parts by weight of an acrylic resin-coated magnetic ferrite carrier was blended therewith to produce a developer (F).

TONER PRODUCTION EXAMPLE 52

Into 710 parts by weight of ion-exchanged water, 450 parts by weight of an aqueous 0.1M $Na_3PO_4$ solution were introduced, and the mixture was heated to 60° C., followed by stirring by means of a TK-type homomixer (manufactured by Tokushukika Kogyo K.K.) at 12,000 rpm. Then, 68 parts by weight of an aqueous 1.0M $CaCl_2$ solution was added thereto little by little to prepare an aqueous dispersion medium containing fine particles of $Ca_3(PO_4)_2$. To this medium, 0.1 part by weight of sodium dodecylbenzenesulfonate was added, and mixed together.

| | |
|---|---|
| Styrene monomers | 165 parts |
| n-Butyl acrylate monomers | 35 parts |
| Colorant (carbon black; average particle diameter: 60 nm) | 15 parts |
| Negative charge control agent (dialkylsalicylic acid metal compound) | 3 parts |
| Polar resin (saturated polyester resin) | 10 parts |
| Release agent (ester wax; melting point: 70° C.) | 50 parts |
| | (all by weight) |

The above materials were heated to 60° C. and then uniformly dissolved and dispersed by means of a TK-type homomixer (manufactured by Tokushukika Kogyo K.K.) at 12,000 rpm. In the resulting dispersion, 10 parts by weight of a polymerization initiator 2,2'-azobis(2,4-dimethylvaleronitrile) was dissolved to obtain a polymerizable monomer composition.

The polymerizable monomer composition obtained was introduced into the above aqueous dispersion medium, followed by stirring for 10 minutes by means of the TK-type homomixer at 10,000 rpm at 60° C. in an environment of $N_2$ to granulate the polymerizable monomer composition. Thereafter, while stirring with a paddle stirring blade, the temperature was raised to 80° C., and the reaction was carried out for 10 hours. After the polymerization was completed, the residual monomers were removed under reduced pressure. After the reaction product was cooled, hydrochloric acid was added to dissolve the calcium phosphate to thereafter obtain colored suspended particles. Subsequently, the suspended particles were heated to 60° C., which were then adjusted to pH 7, further heated to 90° C., and maintained at this temperature for 2 hours, followed by filtration, washing with water, and drying to obtain a non-magnetic negatively chargeable black toner particles formed of agglomerate particles having a weight average particle diameter of 6.3 μm.

To 100 parts by weight of the black toner particles thus obtained, 2.0 parts by weight of hydrophobic fine titanium oxide particles made hydrophobic by treatment with isobutyltrimethoxysilane to have a specific surface area of 100 $m^2/g$ as measured by the BET method was externally added to obtain a black toner 29.

Physical properties of the toner thus obtained are shown in Table 5.

Based on 7 parts by weight of this toner, 93 parts by weight of an acrylic resin-coated magnetic ferrite carrier of 35 82 m average particle diameter was blended therewith to produce a developer (G).

TONER PRODUCTION EXAMPLE 53

A black toner 30 was obtained in the same manner as in Toner Production Example 48 except that fine silica particles not made hydrophobic (BET specific surface area: 180 $m^2/g$). This is designated as developer (H).

Physical properties of the toner are shown in Table 5.

TONER PRODUCTION EXAMPLE 54

A cyan toner 31 was obtained in the same manner as in Toner Production Example 46 except that fine alumina particles made hydrophobic by treatment with isobutyltrimethoxysilane (BET specific surface area: 160 $m^2/g$) were used. The subsequent procedure was repeated to produce a developer (I).

Physical properties of the toner are shown in Table 5.

TONER PRODUCTION EXAMPLE 55

A cyan toner 32 was obtained in the same manner as in Toner Production Example 46 except that the fine titanium oxide particles were replaced with the hydrophobic fine silica particles as used in Toner Production Example 48. The subsequent procedure was repeated to produce a developer (J).

Physical properties of the toner are shown in Table 5.

TONER PRODUCTION EXAMPLES 56, 57 and 58

Toners 33, 34 and 35 of the respective colors were produced in the same manner as in Toner Production Examples 45, 46 and 47, respectively, except that after the polymerization reaction at 80° C. the reaction product was further reacted at 120° C. for 5 hours in an autoclave. The subsequent procedure was repeated to obtain a magenta developer (K), a cyan developer (L) and a yellow developer (M),respectively.

Physical properties of the toners are shown in Table 5.

TONER PRODUCTION EXAMPLE 59

A black toner 36 was produced in the same manner as in Toner Production Example 45 except that carbon black was used as the colorant. The subsequent procedure was repeated to produce a black developer (N). Physical properties of the toner are shown in Table 5.

TABLE 5

| Toner No. | Color | Developer | Weight average particle diameter (μm) | SF-1 | SF-2 | B/A ratio |
|---|---|---|---|---|---|---|
| 22 | Magenta | (A) | 5.8 | 107 | 114 | 2.0 |
| 23 | Cyan | (B) | 5.5 | 107 | 115 | 2.1 |
| 24 | Yellow | (C) | 5.9 | 108 | 113 | 1.6 |
| 25 | Black | (D) | 6.5 | 141 | 125 | 0.6 |
| 26 | Black* | — | 6.5 | 141 | 126 | 0.6 |
| 27 | Cyan* | (E) | 5.8 | 165 | 155 | 0.8 |
| 28 | Black | (F) | 5.8 | 140 | 130 | 0.8 |
| 29 | Black | (G) | 6.3 | 140 | 139 | 1.0 |
| 30 | Black | (H) | 6.3 | 140 | 126 | 0.7 |
| 31 | Cyan | (I) | 5.5 | 107 | 115 | 2.1 |
| 32 | Cyan | (J) | 5.5 | 107 | 115 | 2.1 |
| 33 | Magenta | (K) | 5.7 | 106 | 107 | 1.2 |
| 34 | Cyan | (L) | 5.4 | 105 | 107 | 1.4 |
| 35 | Yellow | (M) | 5.7 | 107 | 108 | 1.1 |
| 36 | Black | (N) | 5.9 | 114 | 112 | 0.9 |

*Comparative Example

EXAMPLE 24

Using as the primary charging roller a rubber roller (diameter: 12 mm; contact pressure: 50 g/cm) with conductive carbon dispersed therein, its carbon particles having been coated with nylon resin, and also using as the electrostatic latent image bearing member the OPC (organic photoconductor) photosensitive drum 3 as produced in Photosensitive Member Production Example 3, digital latent images were formed by laser exposure (600 dpi) to provide a dark portion potential $V_D$ of −600 V and a light portion potential $V_L$ of −100 V. As the developing assembly for black color, the developing assembly made up as shown in FIG. 2 was used at the position of the developing assembly 4-4 shown in FIG. 1. As the black magnetic toner carrying member, a developing sleeve comprising a stainless steel cylinder of 16 mm diameter with a blast-finished surface and formed thereon a resin layer having the following composition and having a layer thickness of about 7 μm and a JIS center-line average roughness (Ra) of 2.2 μm was used as the black-toner carrying member.

| Resin layer composition: | |
|---|---|
| Phenol resin | 100 parts |
| Graphite (particle diameter: about 7 μm) | 90 parts |
| Carbon black | 10 parts |
| | (all by weight) |

Then, the gap (S-D gap) between the OPC photosensitive drum and the developing sleeve of the developing assembly 4-4 was set to be 300 μm, and development magnetic pole, 80 mT (800 gausses). As the toner coat control member, a urethane rubber blade of 1.0 mm thick and 10 mm in free length was brought into touch with the surface of the developing sleeve at a linear pressure of 14.7 N/m (15 g/cm). As development bias, DC bias component Vdc of −450 V and superimposing AC bias component Vpp of 1,200 V and f=2,000 Hz were applied to the developing sleeve.

As the cleaning blade of the OPC photosensitive drum, a urethane rubber blade of 2.0 mm thick and 8 mm in free length was brought into touch with the surface of the photosensitive drum at a linear pressure of 24.5 N/m (25 g/cm). The process speed was set at 94 mm/sec. The developing sleeve was rotated in the regular direction, setting the ratio of its peripheral speed Vt to the peripheral speed V of the photosensitive drum, Vt/V, to 1.5. As the magnetic toner, the developer (D) was used.

Using two-component developers prepared as the developers (A) to (C) using the magenta toner, cyan toner and yellow toner in Toner Production Examples 45 to 47, respectively, the developers were respectively put into the developing assemblies 4-1, 4-2 and 4-3 shown in FIG. 1. Toner images of the respective colors were formed in an environment of 23° C./65%RH by reversal development carried out by magnetic brush development under the image forming conditions as described above. The toner images of the respective colors were successively transferred from the OPC photosensitive drum to the intermediate transfer member 5 coming into pressure contact with the OPC photosensitive drum. The four-color toner images on the intermediate transfer member 5 were transferred to a transfer medium (plain paper) of 75 g/m$^2$ basis weight while pressing the transfer roller 7 to the intermediate transfer member 5. Subsequently, the four-color toner images were thermally fixed by the heat-and-pressure fixing means to form a full-color image.

Here, the transfer efficiency of the toners of the respective colors transferred from the OPC photosensitive drum to the intermediate transfer member 5 was 95 to 98%, and the transfer efficiency of the toners transferred from the intermediate transfer member 5 to the transfer medium 6 was 95 to 98%. As transfer efficiency on the whole, it was as high as 90.3 to 96.0%. The toner images showed a good color mixing performance, and good full-color images were obtained, causing neither blank areas caused by poor transfer nor black spots around images.

Comparative Example 11

Images were reproduced in the same manner as in Example 24 except that the cyan developer and the black toner magnetic developer were replaced with the developer (E) and the developer (G) (SF-2=151), respectively. The transfer efficiency of a solid images was lowered. As a result, there were no problem in practical use in the case of 200 dpi. In the case of 400 dpi, black spots around images did not occur, but the highlight reproduction slightly lowered.

Now, the transfer current was raised in order to improve transfer performance, but it was impossible to achieve both the improvement of transfer performance and the prevention of black spots around images.

This is presumably because the SF-2 of the toner of the cyan developer was so much greater than the SF-2 of the black toner that it was impossible to set proper transfer conditions, resulting in a lowering of the transfer performance in the state where the black spots around images were prevented.

Comparative Example 12

Images were reproduced in the same manner as in Example 24 except that the developer (D) was replaced with the toner 26 (the inorganic fine powder is not externally added). As a result, the transfer efficiency extremely lowered in respect of solid images. Blank areas caused by poor transfer seriously occurred, and coarse images were conspicuous at highlight areas.

EXAMPLE 25

Images were reproduced in the same manner as in Example 24 except that the developing assembly for black color was changed with a two-component type developing assembly and the developer (F) was used therefor. As a result, the transfer efficiency of the black toner was good, and good results were obtained without any blank areas caused by poor transfer, coarse images at highlight areas and black spots around images.

EXAMPLE 26

Images were reproduced in the same manner as in Example 24 except that the developing assemblies for magenta, cyan and yellow colors were modified into non-magnetic one-component development systems, and, as development conditions, keeping the gap between each OPC photosensitive drum and each developing sleeve to 300 μm, an DC electric field of 300 V and an AC electric field of 2 KDpp at 2 kHz were superimposingly applied as a development electric field (no carrier was used). As a result, the same good results as in Example 24 were obtained.

EXAMPLE 27

Images were reproduced in the same manner as in Example 24 except that the black developer was replaced with the black developer (G). As a result, the transfer efficiency slightly lowered to 95%.

EXAMPLE 28

Images were reproduced in the same manner as in Example 24 except that the black developer was replaced with the black developer (H). As a result, the transfer efficiency at solid images was lower than, and the blank areas caused by poor transfer more occurred than, in Example 24.

EXAMPLE 29

Images were reproduced in the same manner as in Example 24 except that the cyan developer was replaced with the cyan developer (I). As a result, good results were obtained.

EXAMPLE 30

Images were reproduced in the same manner as in Example 24 except that the cyan developer was replaced with the cyan developer (J). As a result, good results were obtained.

EXAMPLE 31

Images were reproduced in the same manner as in Example 25 except that the developers were replaced with the developers (K) to (N). As a result, good results were obtained.

The results of evaluation obtained in the above Examples and Comparative Examples are shown in Table 6 together with the physical properties of the toners.

In Table 6, the evaluation ranks indicate that "AA": Excellent; "A": Good; "B": Average; "C": Poor.

TABLE 6

| Toner kit | Developer | Toner color | Weight average particle diam. (μm) | SF-1 | SF-2 | B/A ratio | Transfer efficiency Primary (%) | Transfer efficiency Secondary (%) | Blank areas caused by poor transf. | Black spots around images | Coarse images | Full-color image overall evaluation |
|---|---|---|---|---|---|---|---|---|---|---|---|---|
| Example: | | | | | | | | | | | | |
| 24 | (A) | M | 5.8 | 107 | 114 | 2.0 | 98 | 97 | AA | AA | AA | AA |
| | (B) | C | 5.5 | 107 | 115 | 2.1 | 98 | 97 | AA | AA | AA | |
| | (C) | Y | 5.9 | 108 | 113 | 1.6 | 98 | 97 | AA | AA | AA | |
| | (D) | B | 6.5 | 141 | 125 | 0.6 | 96 | 95 | AA | AA | AA | |
| Comparative Example: | | | | | | | | | | | | |
| 11 | (A) | M | 5.8 | 107 | 114 | 2.0 | 98 | 97 | AA | AA | AA | C |
| | (E) | C | 5.8 | 165 | 155 | 0.8 | 91 | 85 | A | A | A | |
| | (C) | Y | 5.9 | 108 | 113 | 1.6 | 98 | 97 | AA | AA | AA | |
| | (G)* | B | 6.6 | 156 | 151 | 0.9 | 85 | 80 | C | A | C | |
| 12 | (A) | M | 5.8 | 107 | 114 | 2.0 | 98 | 97 | AA | AA | AA | C |
| | (B) | C | 5.5 | 107 | 115 | 2.0 | 98 | 97 | AA | AA | AA | |
| | (C) | Y | 5.9 | 108 | 113 | 1.6 | 98 | 97 | AA | AA | AA | |
| | (26)** | B | 6.5 | 141 | 126 | 0.6 | 75 | 60 | C | B | C | |
| Example: | | | | | | | | | | | | |
| 25 | (A) | M | 5.8 | 107 | 114 | 2.0 | 98 | 97 | AA | AA | AA | AA |
| | (B) | C | 5.5 | 107 | 115 | 2.1 | 98 | 97 | AA | AA | AA | |
| | (C) | Y | 5.9 | 108 | 113 | 1.6 | 98 | 97 | AA | AA | AA | |
| | (F) | B | 5.8 | 140 | 130 | 0.8 | 97 | 97 | AA | AA | AA | |
| 26 | (A) | M | 5.8 | 107 | 114 | 2.0 | 98 | 97 | AA | AA | AA | AA |
| | (B) | C | 5.5 | 107 | 115 | 2.1 | 98 | 97 | AA | AA | AA | |
| | (C) | Y | 5.9 | 108 | 113 | 1.6 | 98 | 97 | AA | AA | AA | |
| | (D) | B | 6.5 | 141 | 125 | 0.6 | 98 | 95 | AA | AA | AA | |
| Example: | | | | | | | | | | | | |
| 27 | (A) | M | 5.8 | 107 | 114 | 2.0 | 98 | 97 | AA | AA | AA | A |
| | (B) | C | 5.5 | 107 | 115 | 2.1 | 98 | 97 | AA | AA | AA | |
| | (C) | Y | 5.9 | 108 | 113 | 1.6 | 98 | 97 | AA | AA | AA | |
| | (G) | B | 6.3 | 140 | 139 | 1.0 | 95 | 93 | AA | A | A | |
| 28 | (A) | M | 5.8 | 107 | 114 | 2.0 | 98 | 97 | AA | AA | AA | B |

TABLE 6-continued

| Toner kit | Developer | Toner color | Weight average particle diam. (μm) | SF-1 | SF-2 | B/A ratio | Transfer efficiency Primary (%) | Transfer efficiency Secondary (%) | Blank areas caused by poor transf. | Black spots around images | Coarse images | Full-color image overall evaluation |
|---|---|---|---|---|---|---|---|---|---|---|---|---|
| | (B) | C | 5.5 | 107 | 115 | 2.1 | 98 | 97 | AA | AA | AA | |
| | (C) | Y | 5.9 | 108 | 113 | 1.6 | 98 | 97 | AA | AA | AA | |
| | (H) | B | 6.3 | 140 | 126 | 0.7 | 91 | 90 | B | A | A | |
| 29 | (A) | M | 5.8 | 107 | 114 | 2.0 | 98 | 97 | AA | AA | AA | AA |
| | (I) | C | 5.5 | 107 | 115 | 2.1 | 98 | 96 | AA | AA | AA | |
| | (C) | Y | 5.9 | 108 | 113 | 1.6 | 98 | 97 | AA | AA | AA | |
| | (D) | B | 6.5 | 141 | 125 | 0.6 | 96 | 95 | AA | AA | AA | |
| 30 | (A) | M | 5.8 | 107 | 114 | 2.0 | 98 | 97 | AA | AA | AA | AA |
| | (J) | C | 5.5 | 107 | 115 | 2.1 | 99 | 97 | AA | AA | A | |
| | (C) | Y | 5.9 | 108 | 113 | 1.6 | 98 | 97 | AA | AA | AA | |
| | (D) | B | 6.5 | 141 | 125 | 0.6 | 96 | 95 | AA | AA | AA | |
| 31 | (K) | M | 5.7 | 106 | 107 | 1.2 | 99 | 98 | AA | A | AA | A |
| | (L) | C | 5.4 | 105 | 107 | 1.4 | 99 | 98 | AA | A | AA | |
| | (M) | Y | 5.7 | 107 | 108 | 1.1 | 99 | 98 | AA | A | AA | |
| | (N) | B | 5.9 | 114 | 112 | 0.9 | 98 | 97 | AA | A | AA | |

M: Magenta
C: Cyan
Y: Yellow
B: Black
*(magnetic toner)
**(toner)

What is claimed is:

1. An image forming method comprising;

a developing step of developing an electrostatic latent image by the use of a developer to form a toner image on an electrostatic latent image bearing member;

a primary transfer step of transferring the toner image onto an intermediate transfer member to which a voltage is applied; and a secondary transfer step of transferring onto a transfer medium the toner image held on the intermediate transfer member, while a transfer means to which a voltage is applied is pressed against the transfer medium;

wherein said developer has a toner, and the toner is a black magnetic toner having at least i) black magnetic toner particles formed of 100 parts by weight of a binder resin with 30 to 200 parts by weight of a magnetic material dispersed therein and ii) an inorganic fine powder; said black magnetic toner having the value of shape factor SF-1 of $120 \leqq SF\text{-}1 \leqq 160$, the value of shape factor SF-2 of $115 \leqq SF\text{-}2 \leqq 140$, and the value of ratio B/A of 1.0 or less which is the ratio of a value B obtained by subtracting 100 from the value of SF-2 to a value A obtained by subtracting 100 from the value of SF-1.

2. The image forming method according to claim 1, wherein said black magnetic toner satisfies the following conditions $3.0 \leqq Sb/St \leqq 7.0$ $Sb \geqq St \times 1.5 + 1.5$ wherein Sb represents a specific surface area ($m^2/cm^3$) per unit volume of said black magnetic toner, as measured by the BET method; and St represents a specific surface area ($m^2/cm^3$) per unit volume as calculated from weight average particle diameter on the assumption that the black magnetic toner particles are truly spherical.

3. The image forming method according to claim 1, wherein black magnetic toner has the value of ratio B/A of from 0.20 to 0.90.

4. The image forming method according to claim 1, wherein said toner has a charge quantity per unit volume of from 30 $C/m^3$ to −80 $C/m^3$.

5. The image forming method according to claim 1, wherein said inorganic fine powder is an inorganic fine powder of a material selected from the group consisting of titania, alumina, silica, and double oxides of any of these.

6. The image forming method according to claim 1 or 6, wherein said inorganic fine powder is an inorganic fine powder having been subjected to hydrophobic treatment.

7. The image forming method according to claim 6, wherein said inorganic fine powder is an inorganic fine powder having been treated with at least silicone oil.

8. The image forming method according to claim 1, wherein said inorganic fine powder has an average primary particle diameter of 30 nm or smaller, and said toner further contains a second fine powder having an average particle diameter larger than 30 nm.

9. The image forming method according to claim 8, wherein said second fine powder having an average particle diameter larger than 30 nm is an inorganic fine powder.

10. The image forming method according to claim 9, wherein said second fine powder having an average particle diameter larger than 30 nm is a fine resin powder.

11. The image forming method according to claim 8, wherein said second fine powder having an average particle diameter larger than 30 nm has substantially a spherical particle shape.

12. The image forming method according to claim 1, wherein said black magnetic toner particles have has a specific surface area per unit volume, of from 1.2 $m^2/cm^3$ to 2.5 $m^2/cm^3$ as measured by the BET method.

13. The image forming method according to claim 1 or 12, wherein said black magnetic toner particles have has a 60% pore radius of 3.5 nm or smaller in the integrating pore area percentage curve of pores of from 1 nm to 100 nm in size.

14. The image forming method according to claim 1, wherein said black magnetic toner particles have has a peak of low-molecular weight in its molecular weight distribution as measured by gel permeation chromatography, in the range of from 3,000 to 15,000.

15. The image forming method according to claim 1, wherein:

an electrostatic latent image is developed with a developer having a yellow toner to form a yellow toner image on the electrostatic latent image bearing member, and the yellow toner image is transferred onto the intermediate transfer member;

an electrostatic latent image is developed with a developer having a magenta toner to form a magenta toner image on the electrostatic latent image bearing member, and thereafter the magenta toner image is transferred onto the intermediate transfer member;

an electrostatic latent image is developed with a developer having a cyan toner to form a cyan toner image on the electrostatic latent image bearing member, and thereafter the cyan toner image is transferred onto the intermediate member;

an electrostatic latent image is developed with a developer having the black magnetic toner to form a black magnetic toner image on the electrostatic latent image bearing member, and thereafter the black magnetic toner image is transferred onto the intermediate transfer member; and the yellow toner image, magenta toner image, cyan toner image and black magnetic toner image held on the intermediate transfer member are transferred onto the transfer medium.

16. The image forming method according to claim 15, wherein said black magnetic toner has the value of SF-2 greater by at least 5 than the value of SF-2 of said yellow toner, magenta toner or cyan toner.

17. The image forming method according to claim 15, wherein said yellow toner has SF-1 of from 100 to 170 and SF-2 of from 100 to 139, said magenta toner has SF-1 of from 100 to 170 and SF-2 of from 100 to 139, and said cyan toner has SF-1 of from 100 to 170 and SF-2 of from 100 to 139.

18. The image forming method according to claim 15, wherein said yellow toner has SF-1 of from 100 to 160 and SF-2 of from 100 to 130, said magenta toner has SF-1 of from 100 to 160 and SF-2 of from 100 to 130, and said cyan toner has SF-1 of from 100 to 160 and SF-2 of from 100 to 130.

19. The image forming method according to claim 16, wherein said yellow toner has SF-1 of from 100 to 150 and SF-2 of from 100 to 125, said magenta toner has SF-1 of from 100 to 150 and SF-2 of from 100 to 125, and said cyan toner has SF-1 of from 100 to 150 and SF-2 of from 100 to 125.

20. The image forming method according to claim 15, wherein said black toner is a magnetic toner, said wherein said yellow toner is a non-magnetic toner, said magenta toner is a non-magnetic toner, and said cyan toner is a non-magnetic toner.

21. The image forming method according to claim 15, wherein said black magnetic toner has black magnetic toner particles produced by melt-kneading a mixture having at least a binder resin and a magnetic material, cooling the resulting melt-kneaded product, and pulverizing the melt-kneaded product cooled; said yellow toner has yellow toner particles produced by forming fine particles by polymerization in an aqueous medium of a polymerizable monomer composition containing at least a polymerizable monomer and a yellow colorant; said magenta toner has magenta toner particles produced by forming fine particles by polymerization in an aqueous medium of a polymerizable monomer composition containing at least a polymerizable monomer and a magenta colorant; and said cyan toner has cyan toner particles produced by forming fine particles by polymerization in an aqueous medium of a polymerizable monomer composition containing at least a polymerizable monomer and a cyan colorant.

22. The image forming method according to claim 1, wherein the surface of said electrostatic latent image bearing member has a contact angle to water, of not smaller than 85 degrees.

23. The image forming method according to claim 22, wherein said electrostatic latent image bearing member has a surface layer containing a material having fluorine atoms.

24. The image forming method according to claim 23, wherein said material having fluorine atoms is a fine powder of a compound or resin having fluorine atoms.

25. The image forming method according to claim 1, wherein said intermediate transfer member and said transfer means each have a surface formed of an elastic layer, said intermediate transfer member shows a volume resistivity lower than the volume resistivity of the transfer means, said intermediate transfer member has a surface hardness ranging from 10 to 40 as measured according to JIS K-6301, said transfer means has a surface hardness greater than the surface hardness of the intermediate transfer member, said transfer means is pressed against said intermediate transfer member so as to form a concave nip on the side of the intermediate transfer member, and said toner image is transferred to the transfer medium while applying a voltage to the transfer means.

26. The image forming method according to claim 1, wherein said intermediate transfer member has a cylindrical drum for holding the toner image thereon.

27. The image forming method according to claim 1, wherein said intermediate transfer member has an endless belt for holding the toner image thereon.

28. The image forming method according to claim 1, wherein said intermediate transfer member has a cylindrical drum for holding the toner image thereon, and said transfer means has a transfer belt by which the toner image held on the cylindrical drum is transferred to the transfer medium.

29. The image forming method according to claim 1, wherein said intermediate transfer member has an endless belt for holding the toner image thereon, and said transfer means has a transfer roller by which the toner image held on the endless belt is transferred to the transfer medium.

30. The image forming method according to claim 1, wherein said black magnetic toner contains a liquid lubricant.

31. The image forming method according to claim 30, wherein said liquid lubricant is contained in the toner in the form of lubricant-supported particles containing from 20 to 90 parts by weight of the liquid lubricant.

32. The image forming method according to claim 30, wherein said liquid lubricant is supported on the magnetic material contained in the black magnetic toner.

33. The image forming method according to claim 30, wherein said liquid lubricant has a viscosity at 25° C. of from 10 cSt to 200,000 cSt.

34. An image forming apparatus comprising:

an electrostatic latent image bearing member;

a developing means having a developer for forming a toner image on the electrostatic latent image bearing member;

an intermediate transfer member for holding the toner image transferred from the electrostatic latent image bearing member; said intermediate transfer member having a bias applying means; and a transfer means for transferring the toner image held on the intermediate transfer member, onto a transfer medium; said transfer means having a bias applying means and being provided in the manner that it is pressed against the intermediate transfer member;

wherein said developer has a toner, and the toner is a black magnetic toner having at least i) black magnetic toner particles formed of 100 parts by weight of a binder resin with 30 to 200 parts by weight of a magnetic material dispersed therein and ii) an inorganic fine powder; said black magnetic toner having the value of shape factor SF-1 of $120 \leqq SF\text{-}1 \leqq 160$, the value of shape factor SF-2 of $115 \leqq SF\text{-}2 \leqq 140$, and the value of ratio B/A of 1.0 or less which is the ratio of a value B obtained by subtracting 100 from the value of SF-2 to a value A obtained by subtracting 100 from the value of SF-1 .

35. The image forming apparatus according to claim 34, wherein said black magnetic toner satisfies the following conditions $3.0 \leqq Sb/St \leqq 7.0$ $Sb \geqq St \times 1.5 + 1.5$ wherein Sb represents a specific surface area per ($m^2/cm^3$) unit volume of said black magnetic toner, as measured by the BET method; and St represents a specific surface area ($m^2/cm^3$) per unit volume as calculated from weight average particle diameter on the assumption that the black magnetic toner particles are truly spherical.

36. The image forming apparatus according to claim 34, wherein said black magnetic toner has the value of ratio B/A of from 0.20 to 0.90.

37. The image forming apparatus according to claim 34, wherein said toner has a charge quantity per unit volume of from 30 $C/m^3$ to −80 $C/m^3$.

38. The image forming apparatus according to claim 34, wherein said inorganic fine powder is an inorganic fine powder of a material selected from the group consisting of titania, alumina, silica, and double oxides of any of these.

39. The image forming apparatus according to claim 34 or 38, wherein said inorganic fine powder is an inorganic fine powder having been subjected to hydrophobic treatment.

40. The image forming apparatus according to claim 39, wherein said inorganic fine powder is an inorganic fine powder having been treated with at least silicone oil.

41. The image forming apparatus according to claim 34, wherein said inorganic fine powder has an average primary particle diameter of 30 nm or smaller, and said toner further contains a second fine powder having an average particle diameter larger than 30 nm.

42. The image forming apparatus according to claim 41, wherein said second fine powder having an average particle diameter larger than 30 nm is an inorganic fine powder.

43. The image forming apparatus according to claim 41, wherein said second fine powder having an average particle diameter larger than 30 nm is a fine resin powder.

44. The image forming apparatus according to claim 41, wherein said second fine powder having an average particle diameter larger than 30 nm has substantially a spherical particle shape.

45. The image forming apparatus according to claim 34, wherein said black magnetic toner particles have a specific surface area per unit volume, of from 1.2 $m^2/cm^3$ to 2.5 $m^2/cm^3$ as measured by the BET method.

46. The image forming apparatus according to claim 34 or 49, wherein said black magnetic toner particles have a 60% pore radius of 3.5 nm or smaller in the integrating pore area percentage curve of pores of from 1 nm to 100 nm in size.

47. The image forming apparatus according to claim 34, wherein said black magnetic toner particles have a peak of low-molecular weight in its molecular weight distribution as measured by gel permeation chromatography, in the range of from 3,000 to 15,000.

48. The image forming apparatus according to claim 34, wherein said developing means has a yellow developing assembly having a developer for forming a yellow toner image on the electrostatic latent image bearing member, a magenta developing assembly having a developer for forming a magenta toner image on the electrostatic latent image bearing member, a cyan developing assembly having a developer for forming a cyan toner image on the electrostatic latent image bearing member, and a black developing assembly having a developer for forming a black magnetic toner image on the electrostatic latent image bearing member.

49. The image forming apparatus according to claim 48, wherein said black magnetic toner has the value of SF-2 greater by at least 5 than the value of SF-2 of said yellow toner, magenta toner or cyan toner.

50. The image forming apparatus according to claim 48, wherein said yellow toner has SF-1 of from 100 to 170 and SF-2 of from 100 to 139, said magenta toner has SF-1 of from 100 to 170 and SF-2 of from 100 to 139, and said cyan toner has SF-1 of from 100 to 170 and SF-2 of from 100 to 139.

51. The image forming apparatus according to claim 48, wherein said yellow toner has SF-1 of from 100 to 160 and SF-2 of from 100 to 130, said magenta toner has SF-1 of from 100 to 160 and SF-2 of from 100 to 130, and said cyan toner has SF-1 of from 100 to 160 and SF-2 of from 100 to 130.

52. The image forming apparatus according to claim 48, wherein said yellow toner has SF-1 of from 100 to 150 and SF-2 of from 100 to 125, said magenta toner has SF-1 of from 100 to 150 and SF-2 of from 100 to 125, and said cyan toner has SF-1 of from 100 to 150 and SF-2 of from 100 to 125.

53. The image forming apparatus according to claim 48, wherein said black toner is a magnetic toner, said wherein said yellow toner is a non-magnetic toner, said magenta toner is a non-magnetic toner, and said cyan toner is a non-magnetic toner.

54. The image forming apparatus according to claim 41, wherein said black magnetic toner has black magnetic toner particles produced by melt-kneading a mixture having at least a binder resin and a magnetic material, cooling the resulting melt-kneaded product, and pulverizing the melt-kneaded product cooled; said yellow toner has yellow toner particles produced by forming fine particles by polymerization in an aqueous medium of a polymerizable monomer composition containing at least a polymerizable monomer and a yellow colorant; said magenta toner has magenta toner particles produced by forming fine particles by polymerization in an aqueous medium of a polymerizable monomer composition containing at least a polymerizable monomer and a magenta colorant; and said cyan toner has cyan toner particles produced by forming fine particles by polymerization in an aqueous medium of a polymerizable monomer composition containing at least a polymerizable monomer and a cyan colorant.

55. The image forming apparatus according to claim 34, wherein the surface of said electrostatic latent image bearing member has a contact angle to water, of not smaller than 85 degrees.

56. The image forming apparatus according to claim 55, wherein said electrostatic latent image bearing member has a surface layer containing a material having fluorine atoms.

57. The image forming apparatus according to claim 56, wherein said material having fluorine atoms is a fine powder of a compound or resin having fluorine atoms.

58. The image forming apparatus according to claim 34, wherein said intermediate transfer member and said transfer means each have a surface formed of an elastic layer, said intermediate transfer member shows a volume resistivity lower than the volume resistivity of the transfer means, said intermediate transfer member has a surface hardness ranging from 10 to 40 as measured according to JIS K-6301, said transfer means has a surface hardness greater than the surface hardness of the intermediate transfer member, said transfer means is pressed against said intermediate transfer member so as to form a concave nip on the side of the intermediate transfer member, and said toner image is transferred to the transfer medium while applying a voltage to the transfer means.

59. The image forming apparatus according to claim 34, wherein said intermediate transfer member has a cylindrical drum for holding the toner image thereon.

60. The image forming apparatus according to claim 34, wherein said intermediate transfer member has an endless belt for holding the toner image thereon.

61. The image forming apparatus according to claim 34, wherein said intermediate transfer member has a cylindrical drum for holding the toner image thereon, and said transfer means has a transfer belt by which the toner image held on the cylindrical drum is transferred to the transfer medium.

62. The image forming apparatus according to claim 34, wherein said intermediate transfer member has an endless belt for holding the toner image thereon, and said transfer means has a transfer roller by which the toner image held on the endless belt is transferred to the transfer medium.

63. The image forming apparatus according to claim 34, wherein said black magnetic toner contains a liquid lubricant.

64. The image forming apparatus according to claim 63, wherein said liquid lubricant is contained in the black magnetic toner in the form of lubricant-supported particles containing from 20 to 90 parts by weight of the liquid lubricant.

65. The image forming apparatus according to claim 63, said liquid lubricant is supported on the magnetic material contained in the black magnetic toner.

66. The image forming apparatus according to claim 63, wherein said liquid lubricant has a viscosity at 25° C. of from 10 cSt to 200,000 cSt.

* * * * *

UNITED STATES PATENT AND TRADEMARK OFFICE

CERTIFICATE OF CORRECTION

PATENT NO. : 5,774,771
DATED : June 30, 1998
INVENTOR(S) : TSUTOMU KUKIMOTO, ET AL.

It is certified that error appears in the above-identified patent and that said Letters Patent is hereby corrected as shown below:

COLUMN 1

Line 26, "photoconductivity" should read --photoconductive--.

COLUMN 2

Line 43, "just" should be deleted;
Line 50, "account" should be deleted;
Line 61, "toner of" should read --toner employed in the--.

COLUMN 3

Line 8, "contracting" should read --contacting--; and
Line 67, "high-quality." should read --high quality.--.

COLUMN 5

Line 31, "SF-2of" should read --SF-2 of--.

COLUMN 6

Line 61, "causes," should read --cause,--.

COLUMN 7

Line 53, "in a" should read --in--.

COLUMN 8

Line 22, "2" should read --two--.

UNITED STATES PATENT AND TRADEMARK OFFICE

CERTIFICATE OF CORRECTION

PATENT NO. : 5,774,771

DATED : June 30, 1998

INVENTOR(S) : TSUTOMU KUKIMOTO, ET AL.

It is certified that error appears in the above-identified patent and that said Letters Patent is hereby corrected as shown below:

COLUMN 9

Line 30, "shaked" should read --shaken--;
Line 37, "apart" should read --part--;
Line 41, "1" should read --one--; and
Line 49, "expression. Quantity" should read --expression. [[BREAK, NO INDENT]] Quantity--.

COLUMN 10

Line 20, "Measured" should read --measured--.

COLUMN 11

Line 17, "caster" should read --castor--; and
Line 52, "6-13945," should read --56-13945,-- (not bold

COLUMN 12

Line 58, "endot-" should read --endo--; and
Line 59, "hermic" should read --thermic--.

COLUMN 17

Line 12, "magnetic materials having" should read --have--; and
Line 66, "making" should read --making it--.

COLUMN 22

Line 64, "collapses" should read --collapse--.

UNITED STATES PATENT AND TRADEMARK OFFICE

CERTIFICATE OF CORRECTION

PATENT NO. : 5,774,771

DATED : June 30, 1998

INVENTOR(S) : TSUTOMU KUKIMOTO, ET AL.

It is certified that error appears in the above-identified patent and that said Letters Patent is hereby corrected as shown below:

COLUMN 23

Line 56, "produced" should read --produce--.

COLUMN 29

Line 56, "is formed" should be deleted.

COLUMN 32

Line 45, "Each" should read --each--.

COLUMN 34

Line 4, "$Ca_3(PO_4)_2$." should not be in boldface type;
Line 23, "revolution" should read --revolutions--; and
Line 32, "obtain a" should read --obtain--.

COLUMN 36

Table 1(B), "are" should read --area-- and
"ara" should read --area--.

COLUMN 37

Table 1(B), "are" should read --area-- and
"ara" should read --area--;
Line 32, "cylim-" should read --cylin- --;
Line 33, "as" should read --as the--;
Line 41, "generastion" should read --generation--;
Line 48, "therein a" should read --therein in a--;
Line 57, "PRPDUCTION" should read --PRODUCTION--; and
Line 66, "produced" should read --produce--.

UNITED STATES PATENT AND TRADEMARK OFFICE

CERTIFICATE OF CORRECTION

PATENT NO. : 5,774,771

DATED : June 30, 1998

INVENTOR(S) : TSUTOMU KUKIMOTO, ET AL.

It is certified that error appears in the above-identified patent and that said Letters Patent is hereby corrected as shown below:

COLUMN 39

Line 20, "8" should not be in boldface type; and
Line 27, "Prodduction" should read --Production--.

COLUMN 40

Line 59, "a little much" should read --to some extent--

COLUMN 42

Line 5, "images ." should read --images.--;

COLUMN 43

Line 36, "m iill" should read --mill--.

COLUMN 44

Line 14, "c ooled," should read --cooled,--;
Line 18, "utilizi ng" should read --utilizing--;
Line 20, "w ere" should read --were--; and
Line 63, "were" should read --materials were--.

COLUMN 45

Line 60, "50μm," should read --50 μm,--; and
Line 64, "EXAMPLEs" should read --EXAMPLES--.

UNITED STATES PATENT AND TRADEMARK OFFICE

CERTIFICATE OF CORRECTION

PATENT NO. : 5,774,771

DATED : June 30, 1998

INVENTOR(S) : TSUTOMU KUKIMOTO, ET AL.

It is certified that error appears in the above-identified patent and that said Letters Patent is hereby corrected as shown below:

COLUMN 46

Line 1, "was" should read --were--; and
Line 40, "was" should read --were--.

COLUMN 47

Line 15, "was" should read --were--;
Line 21, "componet" should read --component--.

COLUMN 48

Table 4(B), "are" should read --area-- and
"ara" should read --area--.

COLUMN 49

Table 4(B), "are" should read --area-- and
"ara" should read --area--;
Line 36, "particl es ha ving" should read
--particles having--;
Line 41, "l ight" should read --light--.

COLUMN 50

Line 37, "24.5N/m" should read --24.5 N/m--.

COLUMN 51

Line 40, "com-" should read --Com--

UNITED STATES PATENT AND TRADEMARK OFFICE

CERTIFICATE OF CORRECTION

PATENT NO. : 5,774,771

DATED : June 30, 1998

INVENTOR(S) : TSUTOMU KUKIMOTO, ET AL.

It is certified that error appears in the above-identified patent and that said Letters Patent is hereby corrected as shown below:

COLUMN 54

Line 36, "obtain a" should read --obtain--.

COLUMN 55

Line 26, "obtain a" should read --obtain--.

COLUMN 56

Line 38, "obtain a" should read --obtain--.

COLUMN 57

Line 10, "was" should read --were--

COLUMN 58

Line 15, "82m" should read --μm-- (not boldface);
Line 22, "not" should read --are not--;
Line 57, "(M),respectively." should read --(M), respectively.--.

COLUMN 59

Line 62, "8" should not be in boldface type.

COLUMN 60

Line 38, "of a" should read --of--; and
Line 39, "problem" should read --problems--.

UNITED STATES PATENT AND TRADEMARK OFFICE

CERTIFICATE OF CORRECTION

PATENT NO. : 5,774,771

DATED : June 30, 1998

INVENTOR(S) : TSUTOMU KUKIMOTO, ET AL.

It is certified that error appears in the above-identified patent and that said Letters Patent is hereby corrected as shown below:

COLUMN 61

Line 14, "an DC" should read --a DC--.

COLUMN 63

Line 66, "black" should read --said black--.

COLUMN 64

Line 31, "30" should read -- -30--;
Line 36, "6," should read --5,--;
Line 58, "has" should be deleted;
Line 62, "has" should be deleted; and
Line 66, "has" should be deleted.

COLUMN 65

Line 54, "said" (second occurrence) should be deleted.

COLUMN 67

Line 36, "30" should read -- -30--; and
Line 67 "49," should read --45,--.

COLUMN 68

Line 42, "said" (second occurrence) should be deleted;
Line 46, "41," should read --48,--.

UNITED STATES PATENT AND TRADEMARK OFFICE

CERTIFICATE OF CORRECTION

PATENT NO. : 5,774,771

DATED : June 30, 1998

INVENTOR(S) : TSUTOMU KUKIMOTO, ET AL.

It is certified that error appears in the above-identified patent and that said Letters Patent is hereby corrected as shown below:

COLUMN 70

Line 20, "said" should read --wherein said--.

Signed and Sealed this

Fourth Day of May, 1999

*Attest:*

*Attesting Officer*

Q. TODD DICKINSON

*Acting Commissioner of Patents and Trademarks*